US008518617B2

(12) United States Patent
Miyamoto et al.

(10) Patent No.: US 8,518,617 B2
(45) Date of Patent: Aug. 27, 2013

(54) ELECTROPHOTOGRAPHIC PHOTORECEPTOR, PROCESS CARTRIDGE, AND IMAGE FORMING APPARATUS

(75) Inventors: Tsuyoshi Miyamoto, Kanagawa (JP); Wataru Yamada, Kanagawa (JP); Takatsugu Doi, Kanagawa (JP); Kenya Sonobe, Kanagawa (JP); Katsumi Nukada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 391 days.

(21) Appl. No.: 12/877,608

(22) Filed: Sep. 8, 2010

(65) Prior Publication Data

US 2011/0207041 A1 Aug. 25, 2011

(30) Foreign Application Priority Data

Feb. 25, 2010 (JP) ..... 2010-040799

(51) Int. Cl.
*G03G 5/00* (2006.01)

(52) U.S. Cl.
USPC ..... 430/66; 430/56; 430/58.05; 430/69; 399/159

(58) Field of Classification Search
USPC ..... 430/56, 58.05, 66, 69; 399/159
See application file for complete search history.

(56) References Cited

U.S. PATENT DOCUMENTS

| | | | |
|---|---|---|---|
| 5,411,827 | A | 5/1995 | Tamura et al. |
| 5,496,671 | A | 3/1996 | Tamura et al. |
| 2004/0126687 | A1 | 7/2004 | Ikegami et al. |
| 2005/0008957 | A1 | 1/2005 | Ikegami et al. |

FOREIGN PATENT DOCUMENTS

| | | |
|---|---|---|
| JP | A-05-216249 | 8/1993 |
| JP | A-05-323630 | 12/1993 |
| JP | A-08-179451 | 7/1996 |
| JP | A-11-052603 | 2/1999 |
| JP | A-2000-264961 | 9/2000 |
| JP | A-2001-175016 | 6/2001 |
| JP | A-2004-102080 | 4/2004 |
| JP | A-2004-102199 | 4/2004 |
| JP | A-2004-233955 | 8/2004 |
| JP | A-2004-258253 | 9/2004 |
| JP | A-2005-003910 | 1/2005 |
| JP | A-2005-003924 | 1/2005 |
| JP | A-2006-145865 | 6/2006 |
| JP | A-2007-086522 | 4/2007 |
| JP | A-2008-058779 | 3/2008 |
| JP | A-2008-261933 | 10/2008 |
| JP | A-2009-025382 | 2/2009 |

OTHER PUBLICATIONS

Tanaka et al., "Hybrid Sol-gel Coating with Dispersed Fluoropolymer latex," *The Society of Polymer Science, Japan*, Compilation of Lecture Briefs From the 8$^{th}$ Polymer Materials Forum, Oct. 13, 1999 (With Partial Translation).

*Primary Examiner* — Thorl Chea
(74) *Attorney, Agent, or Firm* — Oliff & Berridge, PLC

(57) ABSTRACT

The present invention provides an electrophotographic photoreceptor including at least an electroconductive substrate and a photosensitive layer provided on or above the electroconductive substrate, wherein an outermost layer of the electrophotographic photoreceptor is a layer composed of a cured film of a composition including at least one of compound having a chain-polymerizable functional group and a charge-transportable backbone in the molecule thereof, a polymerization initiator and a radical deactivator.

18 Claims, 6 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This Application is based on and claims priority under 35 USC 119 from Japanese Patent Application No. 2010-040799 filed on Feb. 25, 2010.

BACKGROUND

1. Technical Field

The present invention relates to an electrophotographic photoreceptor, a process cartridge, and an image forming apparatus.

2. Related Art

Generally, an electrophotographic image forming apparatus has the following structure and processes. Specifically, an image-formed material is obtained by charging the surface of an electrophotographic photoreceptor by a charging unit; forming an electrostatic latent image on the charged surface of the electrophotographic photoreceptor by exposing image-wise the surface to light so as to selectively discharge the surface; developing the latent image by attaching a toner thereto by a developing unit to form a toner image; and transferring the toner image onto a transferred image-receiving medium by a transfer unit.

In recent, electrophotographic photoreceptors (organic photoreceptors) using organic photoconductive materials are mainly used.

As a material for the outermost layer of the electrophotographic photoreceptor, various materials have been suggested.

According to an aspect of the invention, there is provided an electrophotographic photoreceptor including at least an electroconductive substrate and a photosensitive layer provided on or above the electroconductive substrate, wherein an outermost layer of the electrophotographic photoreceptor is a layer composed of a cured film of a composition including at least one compound having a chain-polymerizable functional group and a charge-transportable backbone in the molecule thereof, a polymerization initiator and a radical deactivator.

BRIEF DESCRIPTION OF THE DRAWINGS

Exemplary embodiment(s) of the present invention will be described in detail based on the following figures, wherein.

DETAILED DESCRIPTION

Electrophotographic Photoreceptor

Figure 1:
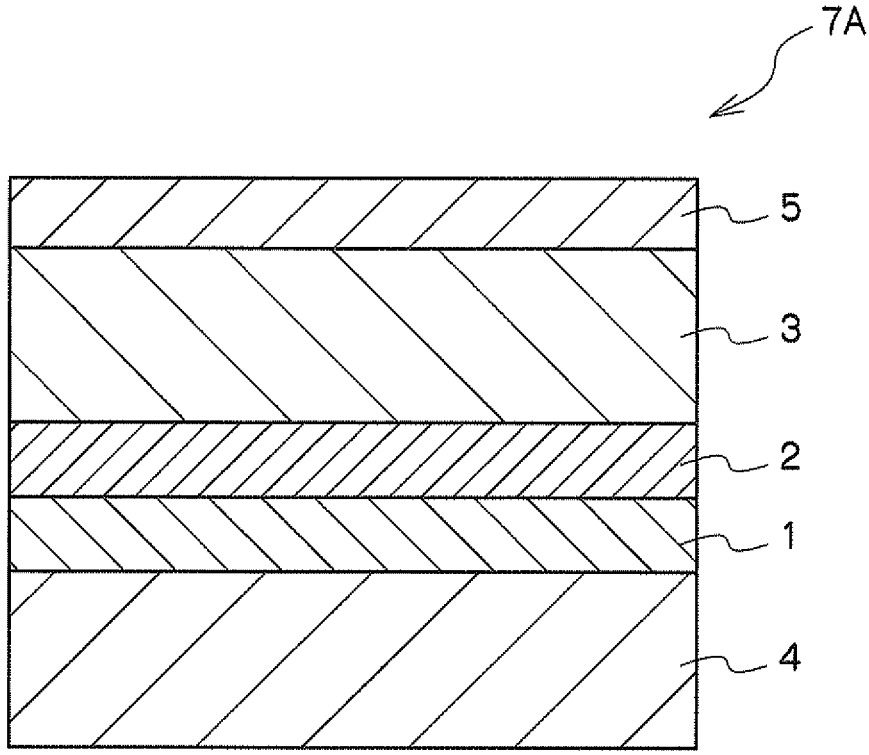
FIG. 1 is a schematic partial cross sectional view showing an electrophotographic photoreceptor according to an exemplary embodiment of the invention.

The electrophotographic photoreceptor according to the present exemplary embodiment includes at least an electroconductive substrate and a photosensitive layer provided on the electroconductive substrate. Furthermore, the outermost layer is constituted by a layer composed of a cured film of a composition including at least one compound having a chain-polymerizable functional group and a charge-transportable backbone (skeleton) in the molecule thereof, a polymerization initiator and a radical deactivator.

An electrophotographic photoreceptor including, as the outermost surface layer, a cured film of a composition containing a charge transporting material having a chain polymerizable functional group has a high mechanical strength, but may cause the deterioration in electrical properties, especially occurrence of an afterimage (ghost image) due to a residual history of the former image.

Therefore, in the electrophotographic photoreceptor according to the present exemplary embodiment, occurrence of an afterimage phenomenon (ghosting) which is caused by a residual history of the former image is suppressed by applying a cured film of a composition including a charge-transportable material having a chain-polymerizable functional group and a polymerization initiator together with a radical deactivator as an outermost layer. Although the reason is unclear it is presumed as follows.

It is known that, during a process of curing a charge-transportable material having a chain-polymerizable functional group in the form of a film, an active radical generated by the cleavage of a polymerization initiator attacks the chain-polymerizable functional group to initiate chain polymerization. It is presumed that the charge-transportable moiety (charge-transportable backbone) in the charge-transportable material is also attacked by the active radical during that process, whereby the charge-transportable backbone is modified to generate a trap site to lead deterioration of electric properties.

On the other hand, it is presumed that, when a radical deactivator is incorporated, the radical deactivator binds to the active radical which attacks the charge-transportable backbone of the charge-transportable material to deactivate the active radical during chain polymerization, and at the same time, it binds to a reaction active point which is generated by the reaction between the active radical and chain-polymerizable functional group whereby the active radical is stabilized.

Therefore, it is presumed that the active radical generated by the cleavage of the polymerization initiator selectively attacks the chain-polymerizable functional group to initiate chain polymerization, and the attack of the active radical on the charge-transportable backbone of the charge-transportable material is suppressed, whereby generation of the trap site due to the modification of the charge-transportable backbone is suppressed, and a cured film whose strength is ensured without impairing the charge-transporting property is obtained.

Especially, in a case in which a chain polymerization reaction (crosslinking reaction) stimulated by heat is used, it is presumed that the radical deactivator accelerates a conformational change in the polymerized molecule (crosslinked molecule) and also suppresses the generation of a charge-transportable trap site in accordance with the chain polymerization reaction (crosslinking reaction).

As a result, it is presumed that the generation of an afterimage phenomenon (ghosting) which is caused by a residual history of the former image is suppressed in the electrophotographic photoreceptor according to the present exemplary embodiment. Therefore, in the process cartridge and the image forming apparatus equipped with the electrophotographic photoreceptor according to the present exemplary embodiment, an image in which the generation of the afterimage phenomenon (ghosting) which is caused by a residual history of the former image is suppressed is obtained.

In addition, since the electrophotographic photoreceptor according to the present exemplary embodiment does not impair the charge-transporting property of the charge-transportable material and does not cause deterioration of the electric properties, generation of unevenness in concentration, stripes, image flow and fogging is also suppressed in addition to the generation of an afterimage phenomenon (ghosting) which is caused by a residual history of the former image.

Furthermore, in the electrophotographic photoreceptor according to the present exemplary embodiment, it is presumed that the active radical generated by the cleavage of the polymerization initiator selectively attacks on the chain-polymerizable functional group to initiate chain polymerization, whereby the strength of the film is increased to give a cured film having a high mechanical strength, and as a result, images in which deterioration of the image property is suppressed, are repeatedly given by the outermost layer composed of this cured film for a long time period.

The electrophotographic photoreceptor according to the present exemplary embodiment includes, as described above, an outermost surface layer made of a cured film of the specific composition. The outermost surface layer preferably forms the top surface of the electrophotographic photoreceptor, and particularly preferably functions as a protective layer or a charge transport layer.

When the outermost surface layer functions as a protective layer, for example, a photosensitive layer and the protective layer as the outermost surface layer are provided on or above a conductive substrate, the protective layer being made of a cured film of the specific composition.

When the outermost surface layer functions as a charge transport layer, for example, a charge generating layer and the charge transport layer as the outermost surface layer are provided on or above a conductive substrate, wherein the charge transport layer is made of a cured film of the specific composition.

Hereinafter, an electrophotographic photoreceptor directed to the exemplary embodiment in which an outermost surface layer is a layer that functions as a protective layer will be detailed with reference to the drawings. In the drawings, same or corresponding portions are provided with same reference marks and omitted from duplicating descriptions.

Figure 2:
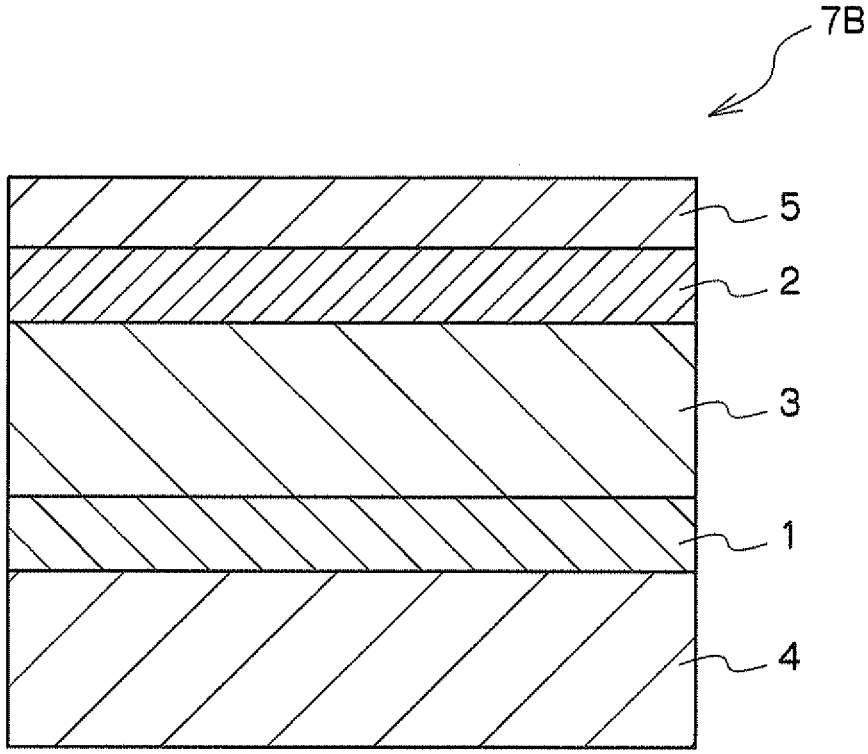
FIG. 2 is a schematic partial cross sectional view showing an electrophotographic photoreceptor according to an exemplary embodiment of the invention.
Figure 3:
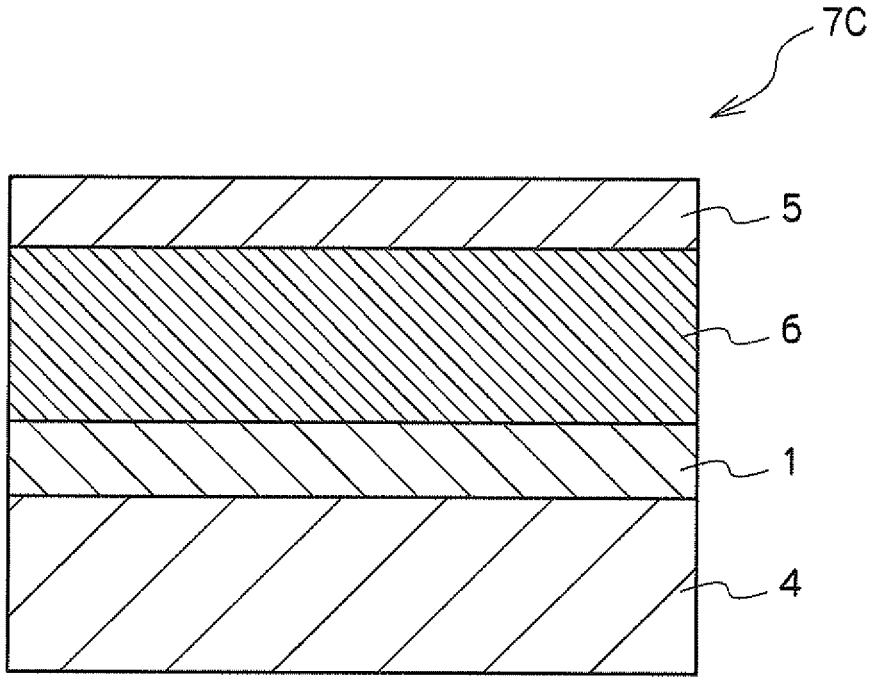
FIG. 3 is a schematic partial cross sectional view showing an electrophotographic photoreceptor according to an exemplary embodiment of the invention.

FIG. 1 is a schematic sectional view showing a preferable exemplary embodiment of an electrophotographic photoreceptor involved in an exemplary embodiment. FIG. 2 and FIG. 3 each are a schematic sectional view showing an electrophotographic photoreceptor involved in another exemplary embodiment.

An electrophotographic photoreceptor 7A shown in FIG. 1 is a so-called function separation type photoreceptor (or a multilayer type photoreceptor) and has a structure where an undercoat layer 1 is formed on a conductive substrate 4, and further thereon, a charge generating layer 2, a charge transport layer 3 and a protective layer 5 are sequentially formed. In the electrophotographic photoreceptor 7A, a photosensitive layer is constituted of the charge generating layer 2 and the charge transport layer 3.

An electrophotographic photoreceptor 7B shown in FIG. 2 is a function separation type photoreceptor where, similar to the electrophotographic photoreceptor 7A shown in FIG. 1, a function is divided into a charge generating layer 2 and a charge transport layer 3. An electrophotographic photoreceptor 7C shown in FIG. 3 contains a charge generating material and a charge transporting material in the same layer (monolayer type photosensitive layer 6 (charge generating/charge transport layer)).

The electrophotographic photoreceptor 7B shown in FIG. 2 has a structure where an undercoat layer 1 is formed on a conductive substrate 4, and, further thereon, a charge transport layer 3, a charge generating layer 2 and a protective layer 5 are sequentially formed. In the electrophotographic photoreceptor 7B, a photosensitive layer is formed of the charge transport layer 3 and the charge generating layer 2.

Furthermore, an electrophotographic photoreceptor 7C shown in FIG. 3 has a structure where an undercoat layer 1 is formed on a conductive substrate 4 and further thereon a monolayer type photosensitive layer 6 and a protective layer 5 are sequentially formed.

In the electrophotographic photoreceptors 7A to 7C shown in FIGS. 1 to 3, the protective layer 5 is the outermost surface layer located farthest from the conductive substrate 4, the outermost surface layer being made of a cured film of the specific composition.

In the electrophotographic photoreceptors shown in FIGS. 1 to 3, the undercoat layer 1 may be omitted.

Taking the electrophotographic photoreceptor 7A shown in FIG. 1 as a representative example, its components are described below.

Conductive Substrate

The conductive substrate may be freely selected from existing ones, such as plastic films having thereon a thin film (for example, a metal such as aluminum, nickel, chromium, stainless steel, or a film of aluminum, titanium, nickel, chromium, stainless steel, gold, vanadium, tin oxide, indium oxide, or indium tin oxide (ITO)), paper coated or impregnated with a conductivity-imparting agent, and plastic films coated or impregnated with a conductivity-imparting agent. The substrate may be in the form of a cylinder, a sheet, or a plate.

The conductive substrate particles preferably have a volume resistivity of, for example, less than $10^7$ Ω·cm.

When the conductive substrate is a metal pipe, the surface thereof may be untreated or treated by mirror finishing, etching, anodic oxidation, rough cutting, centerless grinding, sandblast, or wet honing.

Undercoat Layer

The undercoat layer is formed if necessary for the purpose of preventing light reflection on the conductive substrate surface, and inflow of unnecessary carriers from the conductive substrate into the photosensitive layer.

The undercoat layer is composed of, for example, a binder resin and, if needed, other additives.

Examples of the binder resin contained in the undercoat layer include known polymer resin compounds such as acetal resins such as polyvinyl butyral, polyvinyl alcohol resins, casein, polyamide resin, cellulose resin, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicon-alkyd resins, phenolic resins, phenol-formaldehyde resins, melamine resins, and urethane resins; charge transporting resins having a charge transporting group; and conductive resins such as polyaniline. Among them, resins insoluble in a coating solvent used in the upper layer are preferred. In particular, phenolic resins, phenol-formaldehyde resins, melamine resins, urethane resins, and epoxy resins are preferred.

The undercoat layer may contain a metal compound such as a silicon compound, an organozirconium compound, an organotitanium compound, or an organoaluminium compound.

The ratio of the metal compound to the binder resin is not specified, and is selected so as to achieve intended electrophotographic photoreceptor properties.

The undercoat layer may contain resin particles for controlling the surface roughness. Examples of the resin particles include silicone resin particles and crosslinked poly(methyl methacrylate) (PMMA) resin particles. For the purpose of controlling the surface roughness, the surface of the undercoat layer provided on a conductive substrate may be polished by, for example, buff polishing, sandblasting, wet honing, or grinding.

The undercoat layer may contain, for example, at least a binder resin and conductive particles. The conductive particles preferably have, for example, a volume resistivity of less than $10^7$ Ω·cm.

Examples of the conductive particles include metal particles (for example, aluminium, copper, nickel, and silver particles), conductive metal oxide particles (for examples, antimony oxide, indium oxide, tin oxide, and zinc oxide particles), and conductive substance particles (carbon fiber, carbon black, and graphite powder particles). Among them, conductive metal oxide particles are preferred. The conductive particles may be used in combination of two or more thereof.

The conductive particles may be subjected to surface treatment with a hydrophobizing agent (for example, a coupling agent), thereby controlling the resistance.

The content of the conductive particles is, for example, preferably from 10% by weight to 80% by weight with respect to the binder resin, and more preferably from 40% by weight to 80% by weight.

The undercoat layer is formed using a undercoat layer forming coating liquid that contains the above components in the solvent.

Examples of the method for dispersing particles in the undercoat layer forming coating liquid include media dispersers such as a ball mill, a vibrating ball mill, an attritor, a sand mill, and a horizontal sand mill; and medialess dispersers such as a stirrer, an ultrasonic disperser, a roll mill, and a high pressure homogenizer. The high pressure homogenizer may be of a collision type which achieves dispersion by liquid-liquid collision or liquid-wall collision under high pressure, or of a penetrating type which achieves dispersion by penetrating through fine channels under high pressure.

Examples of the method for coating the undercoat layer forming coating liquid to the conductive substrate include dip coating, push-up coating, wire-bar coating, spray coating, blade coating, knife coating, and curtain coating.

The thickness of the undercoat layer is preferably 15 μm or more, and more preferably from 20 μm to 50 μm.

Although not shown, an intermediate layer may be formed between the undercoat layer and the photosensitive layer. Examples of the binder resin contained in the intermediate layer include: polymer resin compounds such as acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins; and organometallic compounds containing zirconium, titanium, aluminium, manganese, or silicon atoms. These compounds may be used alone, or a mixture or a polycondensate of two or more thereof. Among them, organometallic compounds containing zirconium or silicon are preferred, because they have a low residual electric potential and thus potential change caused by the environment or repeated use is suppressed.

The intermediate layer is formed using an intermediate layer forming coating liquid that contains the above components in the solvent.

Examples of the method for coating the intermediate layer forming coating liquid include ordinary methods such as dip coating, push-up coating, wire-bar coating, spray coating, blade coating, knife coating, and curtain coating.

The intermediate layer functions as an electrical blocking layer in addition to improvement of spreadability of the upper layer. If the film thickness is too large, the electrical barrier may become too high, whereby desensitization and increase of potential due to repetitions may be caused. Accordingly, if formed, the intermediate layer is preferably provided so as to have a thickness of from 0.1 μm to 3 μm. In this case, the intermediate layer may be used as the undercoat layer.

Charge Generating Layer

The charge generating layer is composed of, for example, a charge-generating material and a binder resin. Examples of the charge-generating material include phthalocyanine pigments such as metal-free phthalocyanine, chlorogallium phthalocyanine, hydroxygallium phthalocyanine, dichlorotin phthalocyanine, and titanylphthalocyanine. Specific examples include chlorogallium phthalocyanine crystals having strong diffraction peaks at a Bragg angle (2θ±0.2°) of at least 7.4°, 16.6°, 25.5°, and 28.3° with respect to CuKα characteristic x-ray, metal-free phthalocyanine crystals having strong diffraction peaks at a Bragg angle (2θ±0.2°) of at least 7.7°, 9.3°, 16.9°, 17.5°, 22.4°, and 28.8° with respect to CuKα characteristic x-ray, hydroxygallium phthalocyanine crystals having strong diffraction peaks at a Bragg angle (2θ±0.2°) of at least 7.5°, 9.9°, 12.5°, 16.3°, 18.6°, 25.1°, and 28.3° with respect to CuKα characteristic x-ray, and titanylphthalocyanine crystals having strong diffraction peaks at a Bragg angle (2θ±0.2°) of at least 9.6°, 24.1°, and 27.2° with CuKα x-ray radiation. Other examples of the charge-generating material include quinone pigments, perylene pigments, indigo pigments, bisbenzimidazole pigments, anthrone pigments, and quinacridone pigments. These charge-generating materials may be used alone or in combination of two or more thereof.

Examples of the binder resin composing the charge generating layer include polycarbonate resins such as those of bisphenol A type or bisphenol Z type, acrylic resins, methacrylic resins, polyarylate resins, polyester resins, polyvinyl chloride resins, polystyrene resins, acrylonitrile-styrene copolymer resins, acrylonitrile-butadiene copolymers, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinyl carbazole resins. These binder resins may be used alone or in combination of two or more thereof.

The mixing ratio of the charge-generating material to the binder resin is preferably, for example, from 10:1 to 1:10.

The charge generating layer is formed using a charge generating layer forming coating liquid that contains the above components in the solvent.

Examples of the method for dispersing particles (for example, a charge generating material) in the charge generating layer forming coating liquid include media dispersers such as a ball mill, a vibrating ball mill, an attritor, a sand mill, and a horizontal sand mill; and medialess dispensers such as a stirrer, an ultrasonic disperser, a roll mill, and a high pressure homogenizer. The high pressure homogenizer may be of a collision type which achieves dispersion by liquid-liquid collision or liquid-wall collision under high pressure, or of a penetrating type which achieves dispersion by penetrating through fine channels under high pressure.

Examples of the method for coating the charge generating layer forming coating liquid on or above the undercoat layer include dip coating, push-up coating, wire-bar coating, spray coating, blade coating, knife coating, and curtain coating.

The thickness of the charge generating layer is preferably from 0.01 μm to 5 μm, and more preferably from 0.05 μm to 2.0 μm.

Charge Transport Layer

The charge transport layer is composed of a charge transporting material and, if needed, a binder resin. When the charge transport layer is the outermost surface layer, as described above, the charge transport layer is made of a cured film of the specific composition.

Examples of the charge transporting material include: hole transporting substances such as oxadiazole derivatives such as 2,5-bis(p-diethyl aminophenyl)-1,3,4-oxadiazole; pyrazoline derivatives such as 1,3,5-triphenyl-pyrazoline and 1-[pyridyl-(2)]-3-(p-diethylaminostyryl)-5-(p-diethylaminostyryl)pyrazoline; aromatic tertiary amino compounds such as triphenylamine, N,N'-bis(3,4-dimethylphenyl)biphenyl-4-amine, and tri(p-methylphenyl)aminyl-4-amine, and dibenzylaniline; aromatic tertiary diamino compounds such as N,N'-bis(3-methylphenyl)-N,N'-diphenylbenzidine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone; quinazoline derivatives such as 2-phenyl-4-styryl-quinazoline; benzofuran derivatives such as 6-hydroxy-2,3-di(p-methoxyphenyl)benzofuran; α-stilbene derivatives such as p-(2,2-diphenylvinyl)-N,N-diphenylaniline; enamine derivatives; carbazole derivatives such as N-ethylcarbazole; poly-N-vinyl carbazole and derivatives thereof; and electron transporting substances such as quinone compounds such as chloranil and bromoanthraquinone; tetracyanoquinodimethane compounds; fluorenone compounds such as 2,4,7-trinitrofluorenone and 2,4,5,7-tetranitro-9-fluorenone; xanthone compounds; thiophene compounds; and polymers having a group derived from any of the above compound in the main chain or side chain. These charge transporting materials may be used alone or in combination of two or more thereof.

Examples of the binder resin composing the charge transporting layer include: insulative resins such as polycarbonate resins such as those of bisphenol A type or bisphenol Z type; acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chlorine rubber; and organic photoconductive polymers such as polyvinylcarbazole, polyvinylanthracene, and polyvinylpyrene. These binder resins may be used alone or in combination of two or more thereof.

The mixing ratio of the charge transporting material to the binder resin is, for example, preferably from 10:1 to 1:5.

The charge transport layer is formed using a charge transporting layer forming coating liquid that contains the above components in the solvent.

Examples of the method for dispersing particles (for example, fluorine resin particles) in the charge transport layer forming coating liquid include media dispersers such as a ball mill, a vibrating ball mill, an attritor, a sand mill, and a horizontal sand mill; and medialess dispersers such as a stirrer, an ultrasonic disperser, a roll mill, and a high pressure homogenizer. The high pressure homogenizer may be of a collision type which achieves dispersion by liquid-liquid collision or liquid-wall collision under high pressure, or of a penetrating type which achieves dispersion by penetrating through fine channels under high pressure.

Examples of the method for coating the charge transport layer forming coating liquid to the charge generating layer include ordinary methods such as dip coating, push-up coating, wire-bar coating, spray coating, blade coating, knife coating, and curtain coating.

The thickness of the charge transport layer is preferably from 5 μm to 50 μm and more preferably from 10 μm to 40 μm.

Protective Layer

The protective layer is a layer composed of a cured film of a composition including at least one compound having a chain-polymerizable functional group and a charge-transportable backbone in the molecule, a polymerization initiator and a radical deactivator.

First, the radical deactivator is explained.

The radical deactivator is also referred to as a radical quencher, and refers to a compound which binds to an active radical generated by the cleavage of a polymerization initiator, or to a reaction active point generated by a reaction between the active radical and the chain-polymerizable functional group to negate the active radical. Specifically, the radical deactivator includes a type which negates the generated active radical by directly binding to the generated active radical, and a type which reacts with a peroxide (—O—O—) generated by the active radical to decompose and deactivate the active radical. Furthermore, the radical deactivator is defined as an agent which has an effect of suppressing various reactions due to a radical such as an oxidation reaction, polymerization reactions of an acrylic group or the like, by deactivating the radical generated in a system by the action of irradiation of light, irradiation of electron beam, heating or the like, by incorporating the agent in a preparation.

A method for confirming the radical deactivating ability (radical quenching ability) of the radical deactivator is as follows.

A radical deactivator is incorporated in a radical polymerizable monomer such as methyl methacrylate and methyl acrylate having radical reactivity in an amount of from about 1 ppm to 100 ppm, and a time taken to produce a polymer is measured in a container sealed with nitrogen gas at 135° C. The effect is confirmed by comparing the above-described time with a time taken to produce a polymer in a comparative sample in which the radical deactivator is not incorporated. If the time taken to produce a polymer in the sample to which the radical deactivator is incorporated is longer than that of the comparative sample, occurrence of polymerization shall be deemed to be suppressed, and radical deactivating ability of the radical deactivator is confirmed.

Examples of the radical deactivator include phenol-based radical deactivators, amine-based radical deactivators, hydroxyacetophenone-based radical deactivators, benzoin-based radical deactivators and peroxide-type radical deactivators.

Of these, the phenol-based radical deactivators and amine-based radical deactivators are desirable from the viewpoints that they have high radical deactivating ability (radical quenching ability) and that the electric properties and film strength are improved.

The phenol-based radical deactivators and amine-based radical deactivators each may be used singly, or they may be used in combination.

Examples of the phenol-based radical deactivators may include monophenol-based radical deactivators, bisphenol-based radical deactivators and polymer type phenol-based radical deactivators.

Examples of the monophenol-based radical inactivators may include 2,6-di-t-butyl-cresol (BHT) butylatedhydroxyanisole (BHA), 2,6-di-t-butyl-4-ethylphenol, stearyl-β-(3,5-di-t-butyl-4-hydroxyphenyl)propionate and the like.

Examples of the bisphenol-based radical deactivator include 2,2'-methylenebis(4-methyl-6-t-butylphenol), 2,2'-methylenebis(4-ethyl-6-t-butylphenol), 4,4'-thiobis(3-methyl-6-t-butylphenol), 4,4'-butylidenebis(3-methyl-6-t-butylphenol), 3,9-bis[1,1-dimethyl-2-[β-(3-t-butyl-4-hydroxy-5-methylphenyl)propionyloxy]ethyl]2,4,8,10-tetraoxaspiro[5,5]undecane and the like.

Examples of the polymer type phenol-based radical deactivators include 1,1,3-tris(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4-hydroxyphenyl)propionate]methane, bis[3,3'-bis-(4'-hydroxy-3'-t-butylphenyl)butyric acid]glycol, 1,3,5-tris(3',5'-di-t-butyl-4'-hydroxybenzyl)-sec-triazine-2,4,6-(1H,3H,5H)trione, tocophenols and the like.

Examples of commercial products of the phenol-based radical deactivator include "IRGANOX 1076", "IRGANOX 1010", "IRGANOX 1098", "IRGANOX 245", "IRGANOX. 1330", "IRGANOX 3114", "IRGANOX 1076", "IRGANOX 245FF", "IRGANOX 259", "IRGANOX 565", "IRGANOX 565FF", "IRGANOX 1010FF", "IRGANOX 1010DD", "IRGANOX 1035", "IRGANOX 1076", "IRGANOX 1076FF", "IRGANOX 1076FD", "IRGANOX 1098", "IRGANOX 1222", "IRGANOX 1425", "IRGANOX 3114", "IRGANOX 5057", "IRGANOX 1520L", "IRGANOX 1520LR" and "IRGANOX 1135" and the like (trade names, all manufactured by Ciba Specialty Chemicals Inc.).

Examples of the amine-based radical deactivators may include hindered amine-based radical deactivators.

Examples of the hindered amine-based radical deactivators include "SANOL LS2626", "SANOL LS765", "SANOL LS770" and "SANOL LS744" (trade names, all manufactured by Sankyo Lifetec Co., Ktd.), "TINUVIN 144" and "TINUVIN 622LD" (trade names, all manufactured by Ciba Japan K.K.), "MARK LA57", "MARK LA67", "MARK LA62", "MARK LA68" and "MARK LA63" (trade names, all manufactured by ADEKA CORPORATION), and the like.

Examples of other radical deactivators may include thioether-based radical deactivators, phosphite-based radical deactivators and phenoxyalkyl-based radical deactivators, or those composed of a chemical species formed by combination of these structures.

Examples of the thioether-based radical deactivators may include "SUMILIZER TPS" and "SUMILIZER TP-D" (trade names, all manufactured by Sumitomo Chemical Co., Ltd.).

Examples of the phosphite-based radical deactivators may include "MARK 2112", "MARK PEP-8", "MARK PEP-24G", "MARK PEP-36", "MARK 329K" and "MARK HP-10" (trade names, all manufactured by ADEKA CORPORATION), and the like.

Of these radical deactivators, in view of high radical inactivating ability (radical quenching ability) and improved electric properties and film strength, at least one selected from the group consisting of the following compounds represented by Formulae (M-1) to (M-8) is specifically preferable.

(M-1)

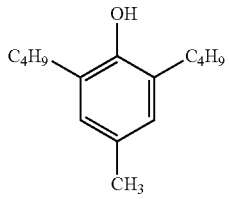

(M-2)

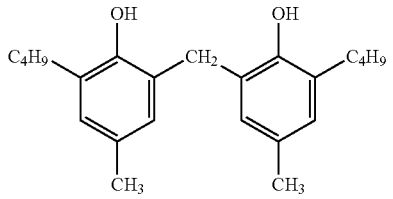

(M-3)

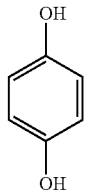

(M-4)

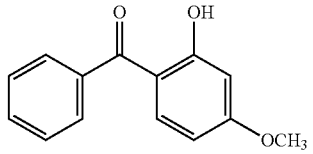

(M-5)

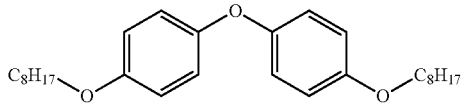

(M-6)

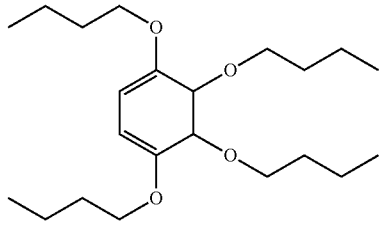

(M-7)

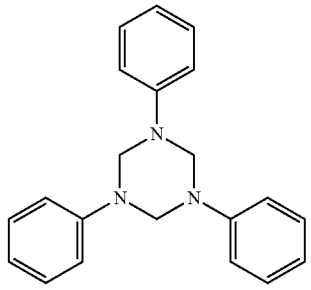

-continued (M-8)

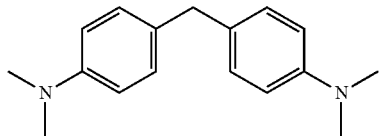

The content of the radical deactivator is preferably from equal mol number to 5-fold mol number of the content of the polymerization initiator in the composition used for forming the protective layer, more preferably from equal mol number to 3-fold mol number of the content of the polymerization initiator, further preferably from equal mol number to 2-fold mol number of the content of the polymerization initiator.

The charge transporting material having a chain polymerizable functional group and a charge-transportable skeleton (backbone) in the molecule thereof is further described below.

The charge transporting skeleton may be a skeleton derived from a nitrogen-containing hole-transporting compound such as a triarylamine compound, a benzidine compound, or a hydrazone compound, wherein the structure is conjugated to a nitrogen atom. Among these, a triarylamine skeleton is preferable.

Examples of the chain polymerizable functional group include an acryloyl group, a methacryloyl group, a styrene group and their derivatives. Particularly a methacryloyl group or its derivative is preferable.

Specific examples of the charge transporting material having a chain polymerizable functional group are preferably a compound represented by the following Formula (I).

(I)

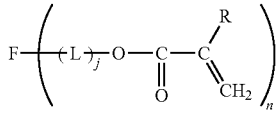

In Formula (I), F represents a hole-transporting organic group having an n valence, R represents a hydrogen atom or an alkyl group, L represents a divalent organic group, n represents an integer of 1 or more, and j represents 0 or 1.

F in Formula (1) represents an n-valent organic group having a hole transporting property. Examples of the organic group include an organic group derived from an arylamine derivative, that is, an organic group obtained by removing n hydrogen atoms from an arylamine derivative. Among arylamine derivatives, an n-valent organic group derived from an arylamine derivative such as a triphenylamine derivative or a tetraphenylbenzidine derivative is preferable.

Then, n in Formula (I) represents an integer of 1 or more. However, n is preferably 2 or more and more preferably 4 or more from the viewpoint of improving a crosslinking density and thereby obtaining a stronger crosslinked film (cured film). An upper limit value of n is preferably 20 and more preferably 10 from the viewpoints of stability of a coating solution and electric characteristics.

When n is set in the preferable range as described above, rotating torque of an electrophotographic photoreceptor is reduced in particular when a blade cleaner is used; accordingly, damage to a blade and wear of the electrophotographic photoreceptor are suppressed. The mechanisms thereof are not clear. However, it is assumed that when the number of reactive functional groups increases, a cured film having a high crosslinking density is obtained, and thereby a molecular motion of a very surface of the electrophotographic photoreceptor is suppressed to weaken an interaction with molecules in a surface of a blade member.

Furthermore, R in Formula (I) represents a hydrogen atom or an alkyl group. As the alkyl group, straight chain or branched alkyl groups having from 1 to 5 carbon atoms are preferable.

Among these, R is preferably a methyl group. That is, in a compound represented by Formula (I), a terminal of a substituent in a parenthesis is preferably a methacryloyl group. Although a reason for this is not clear, inventors consider as shown below.

Usually, an acryl group having a high reactivity is often used in a curing reaction. However, it is thought that, when an acryl group having a high reactivity is used as a substituent of a bulky charge transporting material like a compound represented by Formula (I), an inhomogeneous curing reaction tends to occur, which results in a micro (or macro)-sea-island structure. The sea-island structure like this is not particularly problematic in a field other than an electronic field. However, when the sea-island structure is used for an electrophotographic photoreceptor, disadvantages such as unevenness or crimp in the outmost surface layer or density unevenness are caused. Accordingly, R is preferable to be a methyl group.

It is thought that formation of such sea-island structure is particularly noticeable when plural functional groups attaches to one charge transporting skeleton (F in formula (I)).

Furthermore, L in Formula (I) represents a divalent organic group. As the divalent organic group, an organic group containing an alkylene group having 2 or more carbon atoms is preferable. Still furthermore, j is preferably 1 from the viewpoints of electric characteristics and mechanical strength. A reason why such a structure is preferable is not necessarily clear. However, the inventors consider as shown below.

That is, it is thought that, in the case where, like a compound represented by Formula (I), a radically polymerizable substituent is polymerized, when a radical generated during polymerization has a structure readily moving to a charge transporting skeleton (F in Formula (I)), the generated radical deteriorates a charge transporting function, which results in deterioration of electric characteristics. Furthermore, concerning the mechanical strength, it is thought that, when a bulky charge transporting skeleton and a polymerizable site are near to each other and rigid, polymerizable sites are difficult to move each other, which results in remarkable reduction of reaction probability. From these reasons, it is thought that it is preferable for L to contain an alkylene group having two or more carbon atoms and for j to be 1.

Herein, when L is an organic group containing an alkylene group having two or more carbon atoms, the organic group may be constituted of only an alkylene group having two or more carbon atoms, or may be a combination of an alkylene group having two or more carbon atoms and a divalent group such as alkenylene, alkynylene, ether, thioether, ester or arylene (for example, phenylene). An upper limit value of a number of carbon atoms of an alkylene group is preferably 20 and more preferably 10 from the viewpoint of mechanical strength.

The compound represented by Formula (I) is preferably a compound represented by Formula (II) shown below.

The compound represented by Formula (II) is excellent in particular in the stability to charge mobility and oxidation.

(II)

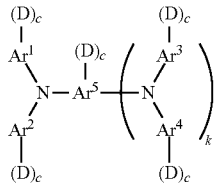

In Formula (II), $Ar^1$ to $Ar^4$ each independently represent a substituted or unsubstituted aryl group, $Ar^5$ represents a substituted or unsubstituted aryl group or a substituted or unsubstituted arylene group, D represents $-(L)_j-O-CO-C(R)=CH_2$, j represents 0 or 1, five es each independently represent 0 or 1, k represents 0 or 1, and the total number of Ds is 1 or more, and L, R and j each have the same definitions as those of L, R and j in Formula (II). Furthermore, R is preferably a hydrogen atom or a straight chain or branched alkyl group having from 1 to 5 carbon atoms.

The total number of Ds in Formula (II) corresponds to n in Formula (I) and is preferably 2 or more and more preferably 4 or more from the viewpoint of improving a crosslinking density and being able to obtain a crosslinked film (cured film) having a higher mechanical strength as mentioned above.

R is, as mentioned above, preferably a methyl group.

In Formula (II), $Ar^1$ to $Ar^4$ each independently represent a substituted or unsubstituted aryl group. $Ar^1$ to $Ar^4$ may be the same or different from each other.

Herein, with respect to a substituent in the substituted aryl group, examples of the substituent other than D: $-(L)_3-O-CO-C(R)=CH_2$ include an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, and a halogen atom are cited.

$Ar^1$ to $Ar^4$ each are preferably any one of structural formulas (1) to (7) shown below. The structural formulas (1) to (7) shown below are shown together with "-(D)c" that is linkable with each of $Ar^1$ to $Ar^4$. Herein, "-(D)c" has the same meaning as "-(D)c" in Formula (II), and preferable examples are also the same as those of "-(D)c" in Formula (II).

(1)

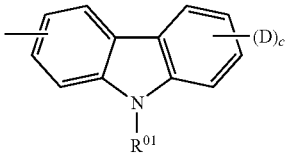

(2)

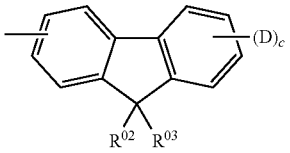

-continued (3)

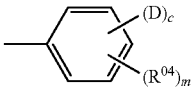

(4)

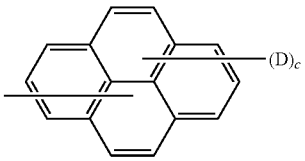

(5)

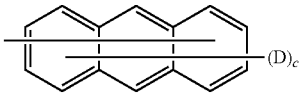

(6)

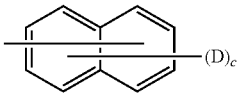

(7)

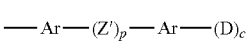

In structural formula (1), $R^{01}$ represents one selected from the group consisting of a hydrogen atom, an alkyl group having from 1 to 4 carbon atoms, a phenyl group substituted by an alkyl group having from 1 to 4 carbon atoms or an alkoxy group having from 1 to 4 carbon atoms, an unsubstituted phenyl group, and an aralkyl group having from 7 to 10 carbon atoms.

In structural formulas (2) and (3), $R^{02}$ to $R^{04}$ each independently represent one selected from the group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms and a halogen atom. Furthermore, m represents an integer of from 1 to 3.

In structural formula (7), Ar represents a substituted or unsubstituted arylene group.

Herein, Ar in formula (7) is preferably represented by structural formula (8) or (9) shown below.

(8)

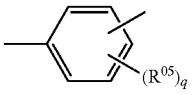

(9)

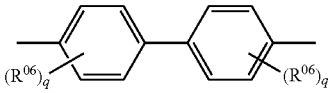

In structural formulas (8) and (9), $R^{05}$ and $R^{06}$ each independently represent one selected from the group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms and a halogen atom. Furthermore, q's each represent an integer of from 1 to 3.

In structural formula (7), Z' represents a divalent organic linking group and is preferably represented by any one of structural formulas (10) to (17) shown below. Furthermore, p represents 0 or 1.

(10) $-(CH_2)_r-$

(11) $-(CH_2CH_2O)_s-$ (12)

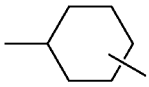

(13)

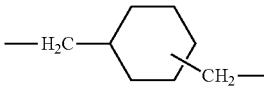

(14)

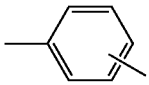

(15)

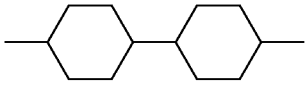

(16)

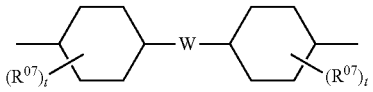

(17)

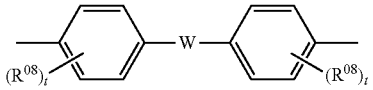

In structural formulas (10) to (17), $R^{07}$ and $R^{08}$ each independently represent one selected from a group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms and a halogen atom, W represents a divalent group, r and s each independently represent an integer of from 1 to 10, and is each represent an integer of from 1 to 3.

Furthermore, W in structural formulas (16) to (17) is preferably any one of divalent groups represented by any one of structural formulas (18) to (26) shown below. However, in formula (25), u represents an integer of from 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

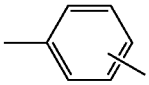

(25)

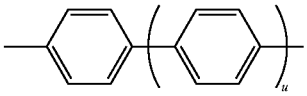

(26)

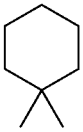

In formula (II), $Ar^5$ is a substituted or unsubstituted aryl group when k is 0, and, examples of the aryl group are the same as those of aryl groups in $Ar^1$ to $Ar^4$. $Ar^5$ is a substituted or unsubstituted arylene group when k is 1, and, as the arylene group, an arylene group obtained by removing one hydrogen atom at a predetermined site from an aryl group exemplified in the description of $Ar^1$ to $Ar^4$ is cited.

Hereinafter, specific examples of the compound represented by Formula (I) will be shown. Compounds represented by Formula (I) are not at all restricted thereto.

In the beginning, specific examples (compounds i-1 to i-14) when n in Formula (I) is 1 are shown without restricting thereto.

| No. | |
|---|---|
| i - 1 | 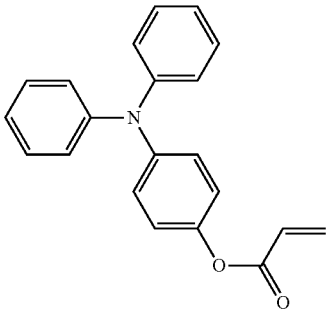 |

-continued
| No. | |
|---|---|
| i - 2 | 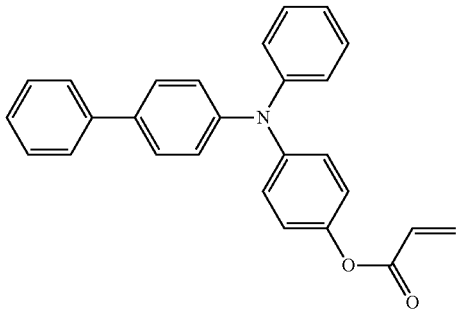 |
| i - 3 | 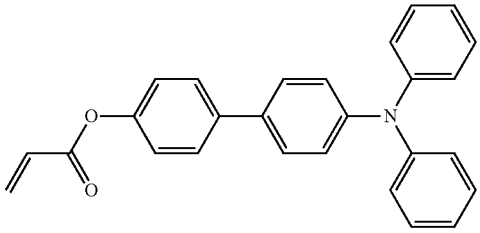 |
| i - 4 | 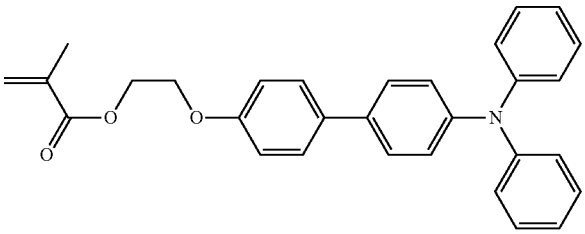 |
| i - 5 | 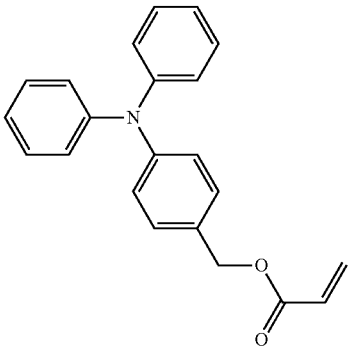 |
| i - 6 | 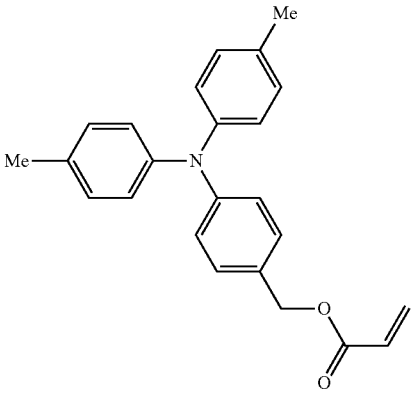 |

-continued
| No. | |
|---|---|
| i - 7 | 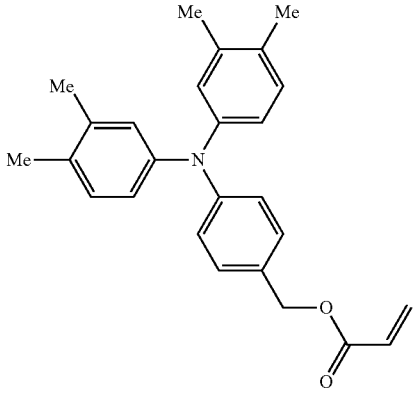 |
| i - 8 | 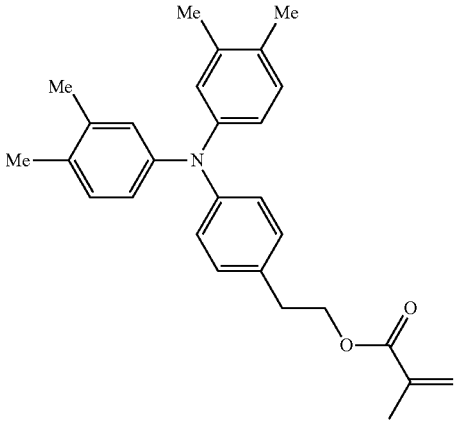 |
| i - 9 | 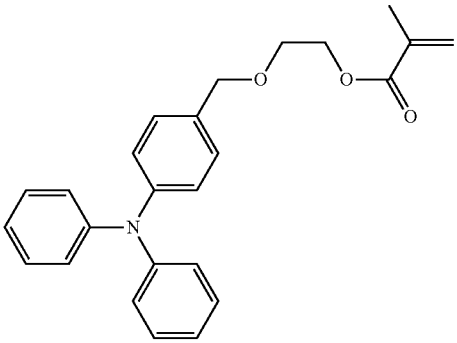 |
| i - 10 | 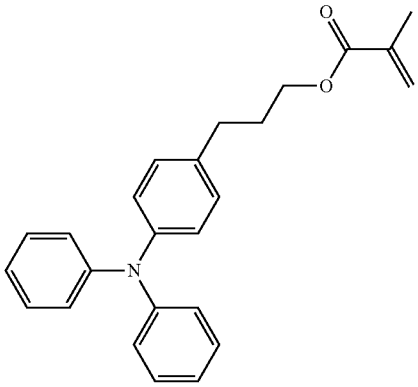 |

-continued
| No. | |
|---|---|
| i - 11 | 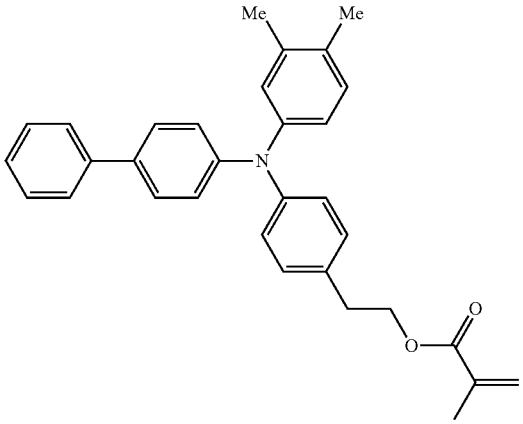 |
| i - 12 | 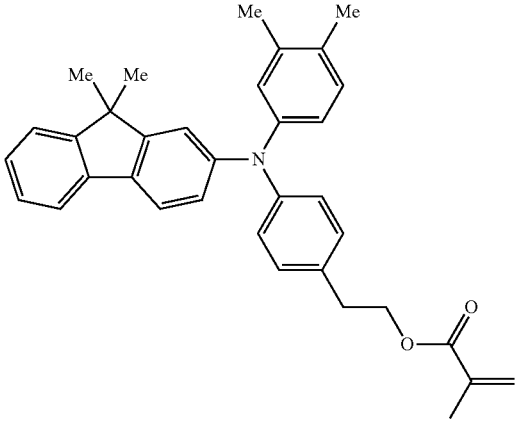 |
| i - 13 | 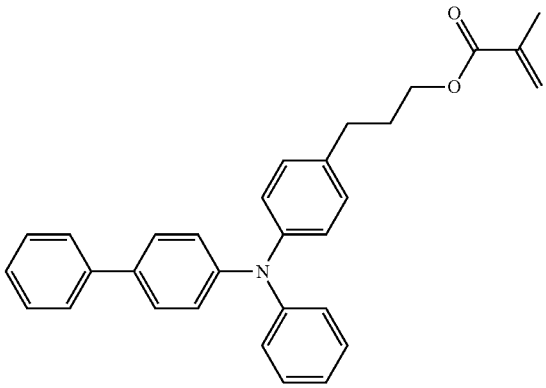 |

-continued
| No. | |
|---|---|
| i - 14 | 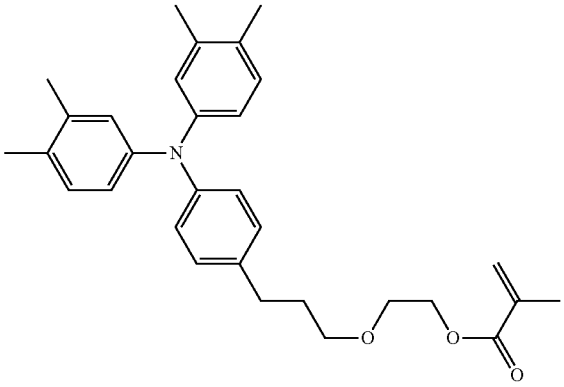 |
The following compounds are the specific examples of the compound represented by Formula (I) wherein n is 2 (compounds ii-1 to ii-26). However, the compound will not be limited to these examples.
| No. | |
|---|---|
| ii-1 | 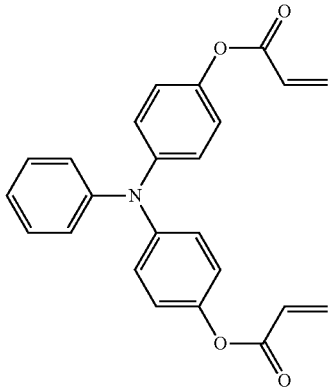 |
| ii-2 | 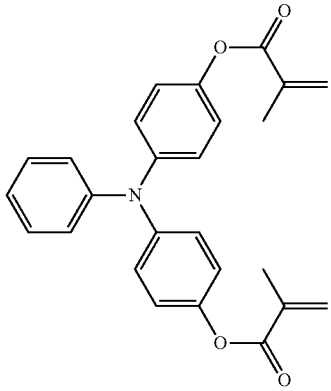 |

-continued
| No. | |
|---|---|
| ii-3 | 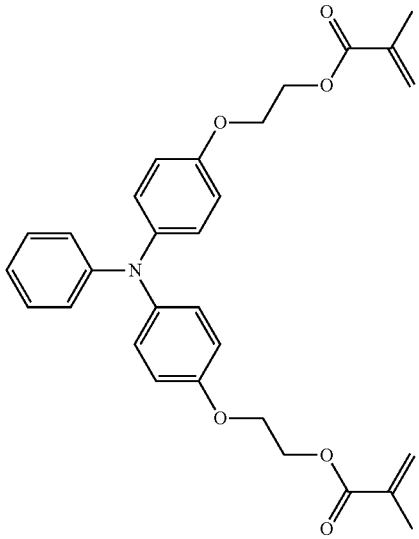 |
| ii-4 | 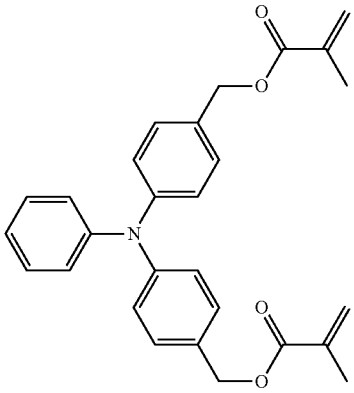 |
| ii-5 | 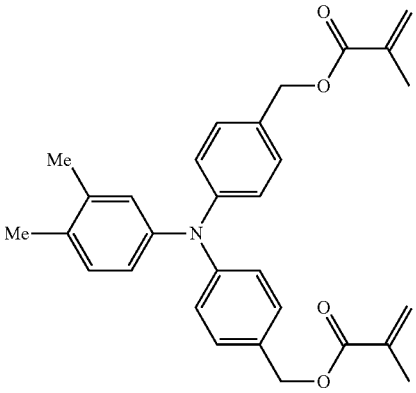 |

-continued
| No. | |
|---|---|
| ii-6 | 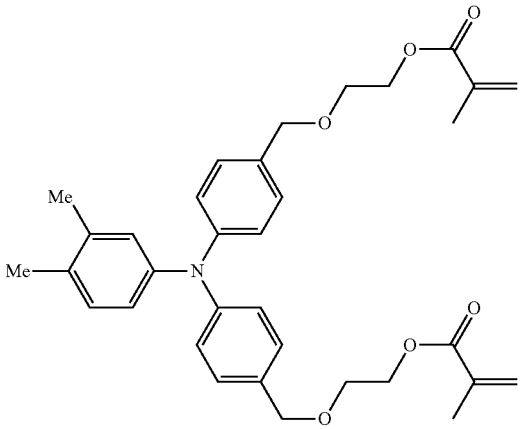 |
| ii-7 | 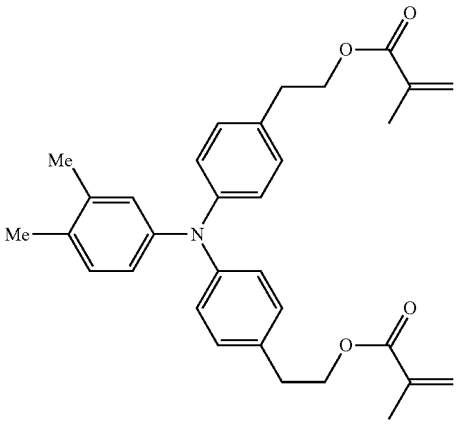 |
| ii-8 | 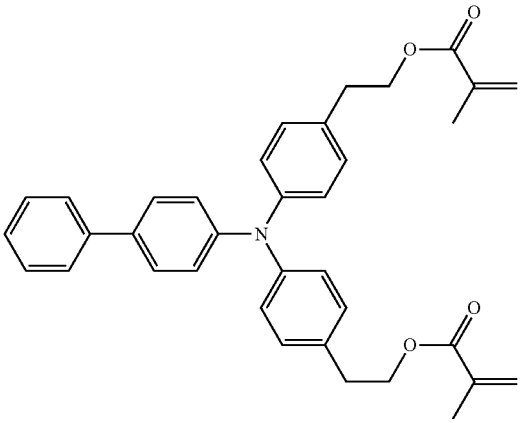 |

-continued
| No. | |
|---|---|
| ii-9 | 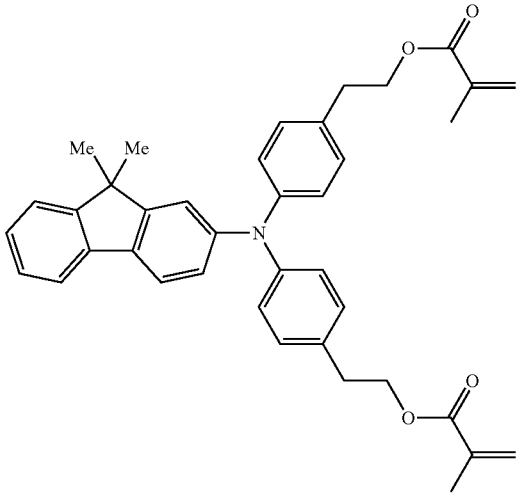 |
| ii-10 | 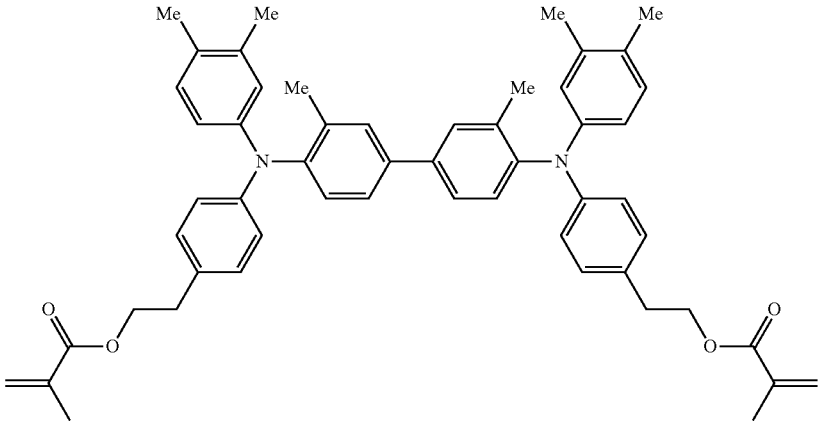 |
| ii-11 | 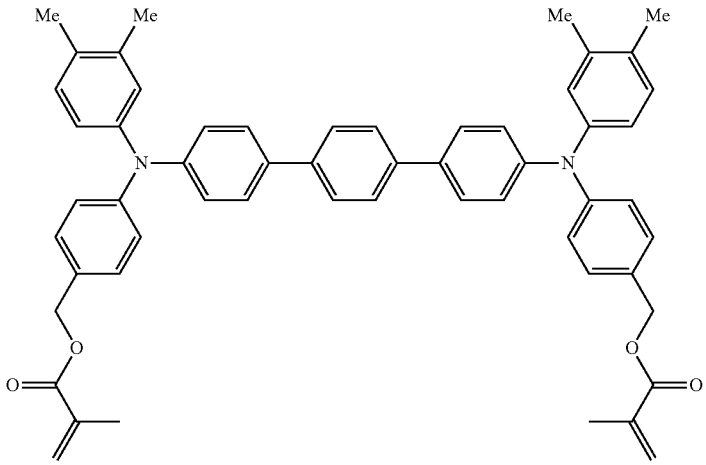 |

-continued
| No. | |
|---|---|
| ii-12 | 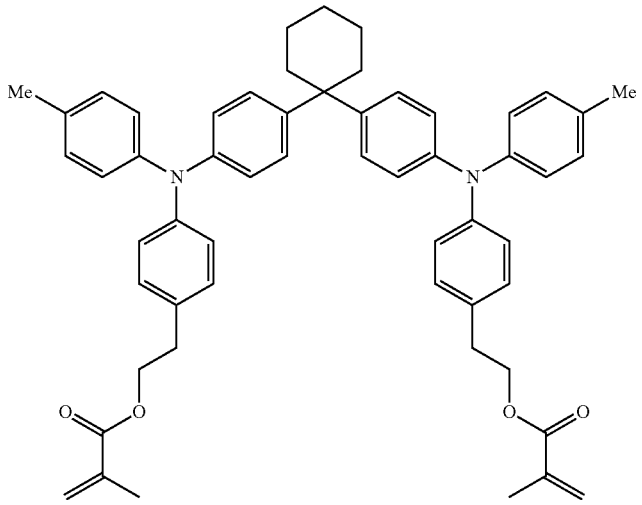 |
| ii-13 | 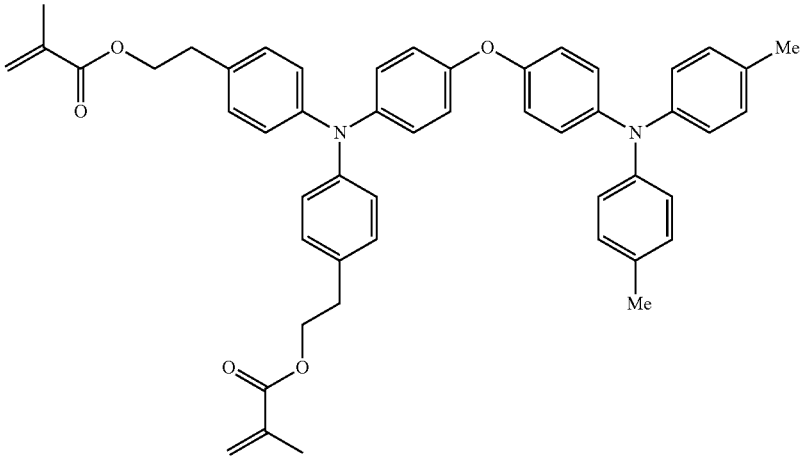 |
| ii-14 | 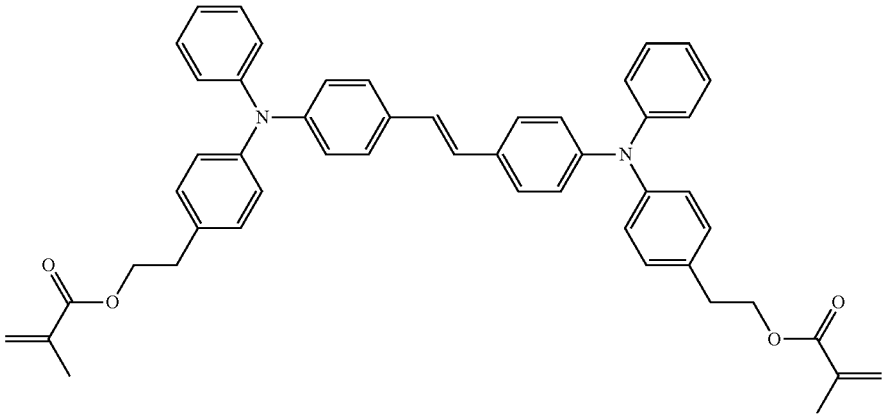 |

-continued
| No. | |
|---|---|
| ii-15 | 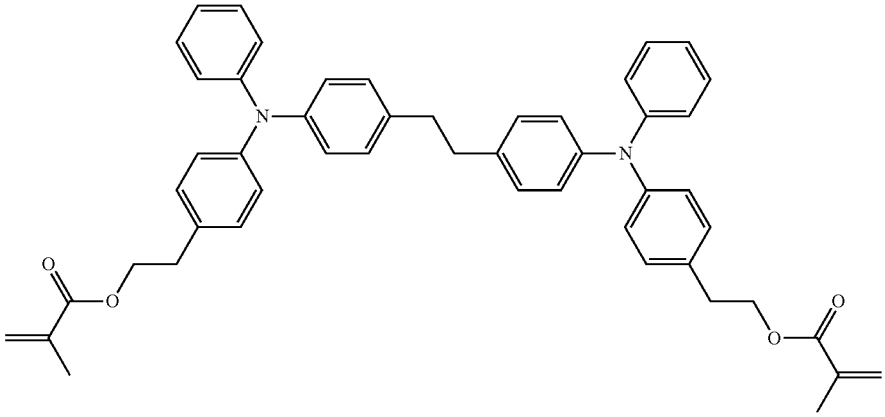 |
| ii-16 | 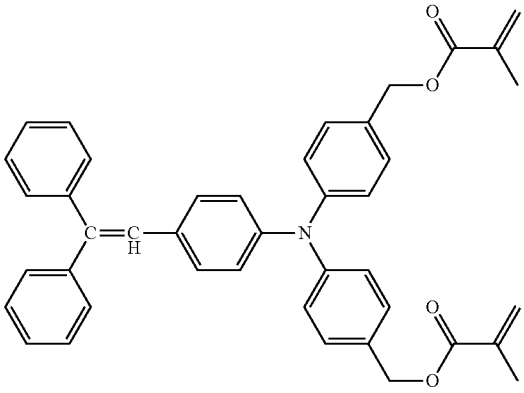 |
| ii-17 | 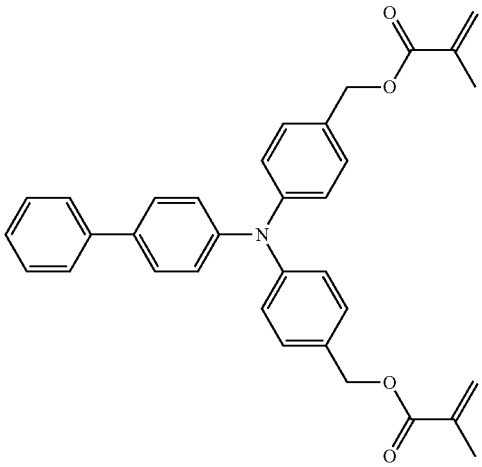 |

-continued
| No. | |
|---|---|
| ii-18 | 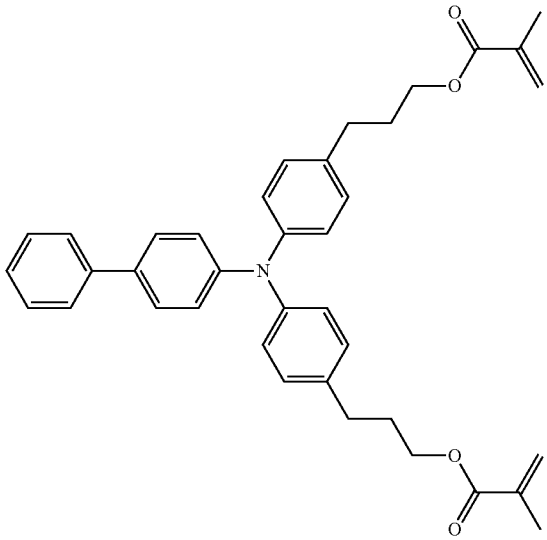 |
| ii-19 | 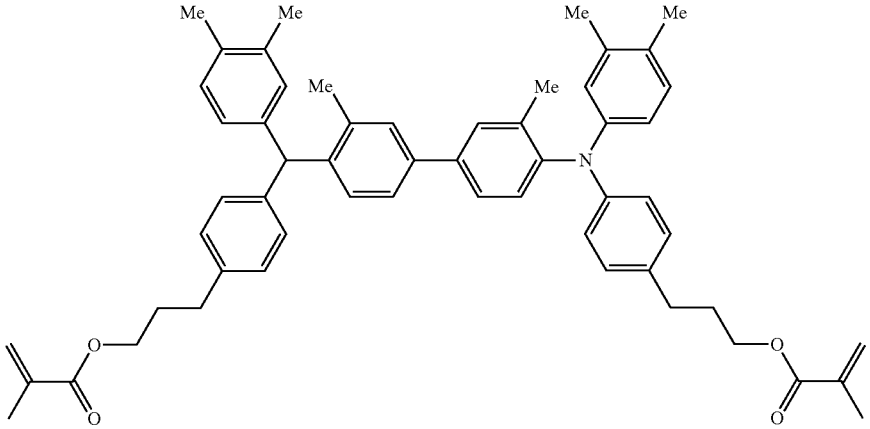 |
| ii-20 | 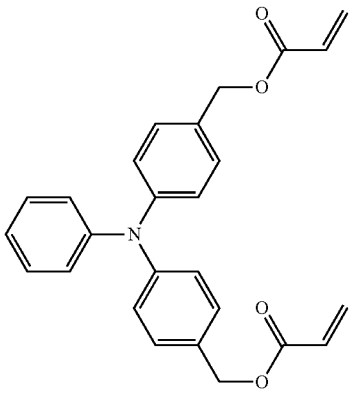 |

-continued
| No. | |
|---|---|
| ii-21 | 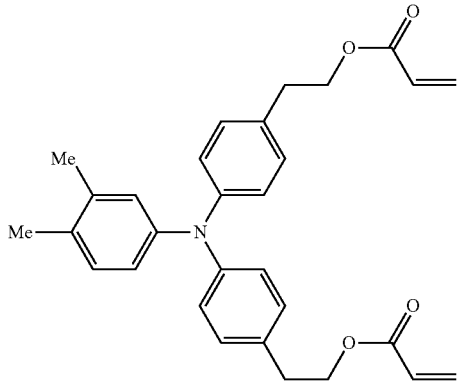 |
| ii-22 | 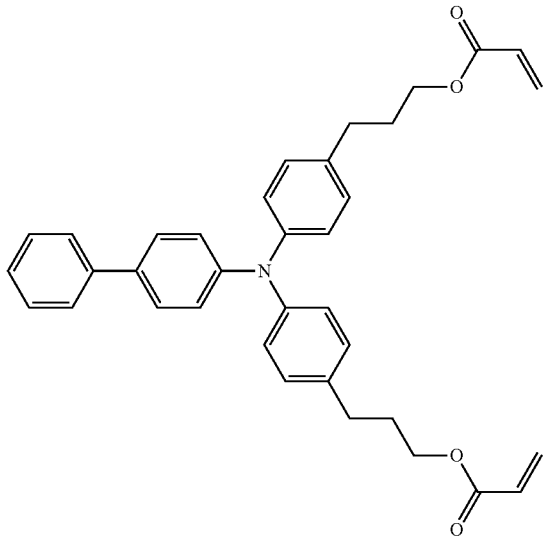 |
| ii-23 | 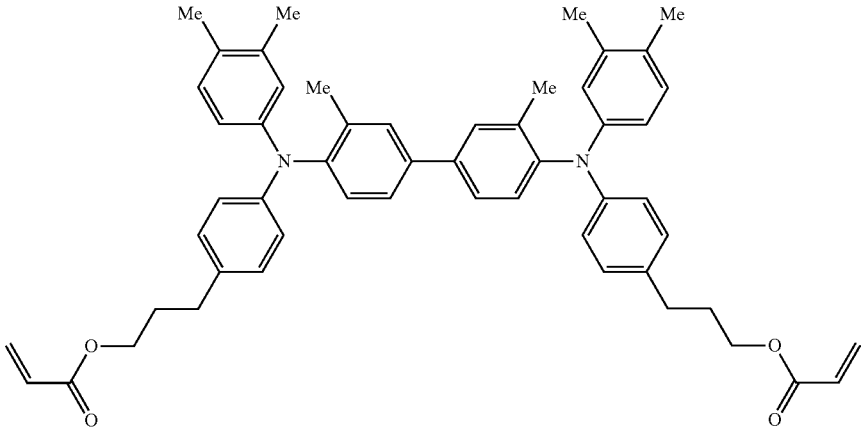 |

-continued
| No. | |
|---|---|
| ii-24 | 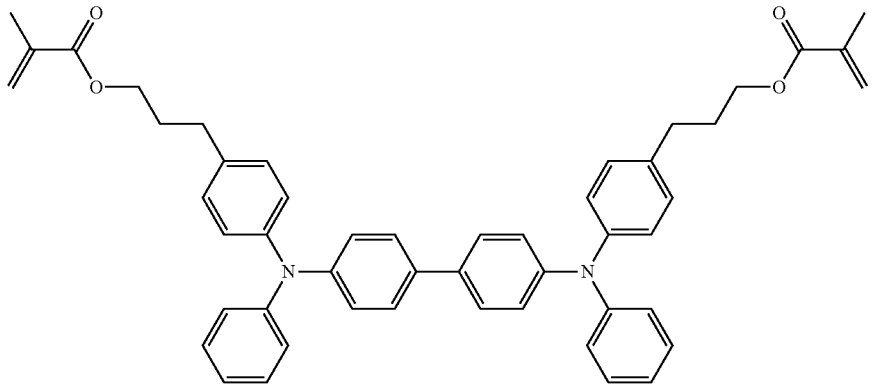 |
| ii-25 | 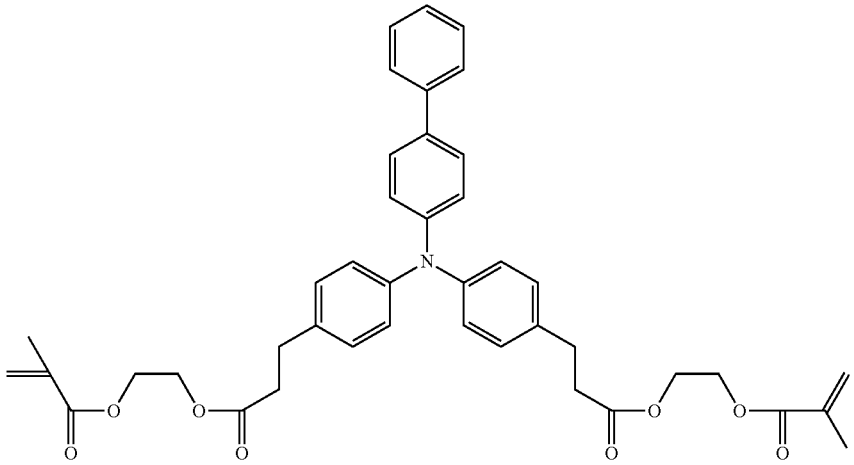 |
| ii-26 | 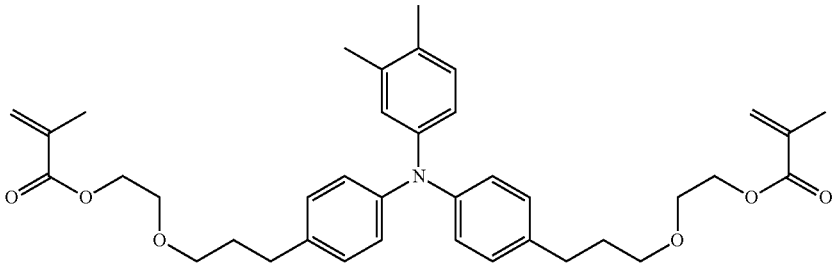 |

The following compounds are the specific examples of the compound represented by Formula (I) wherein n is 3 (compounds iii-1 to iii-11). However, the compound will not be limited to these examples.
| No. | |
|---|---|
| iii-1 | 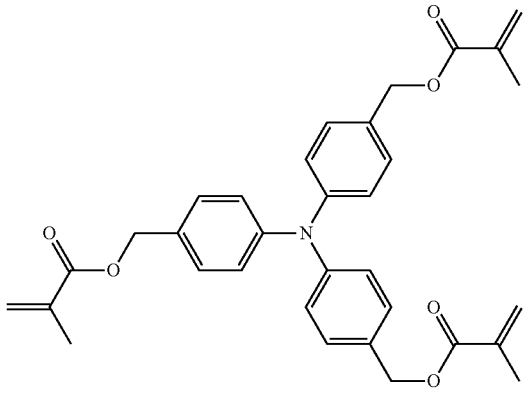 |
| iii-2 | 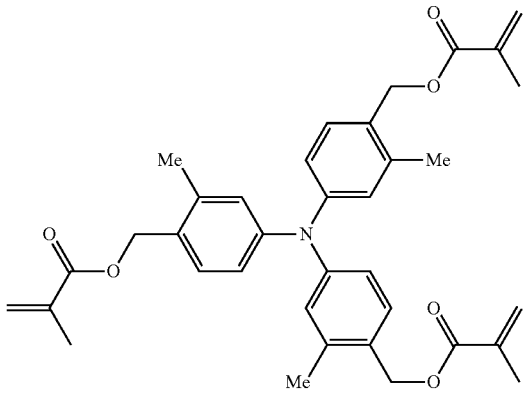 |
| iii-3 | 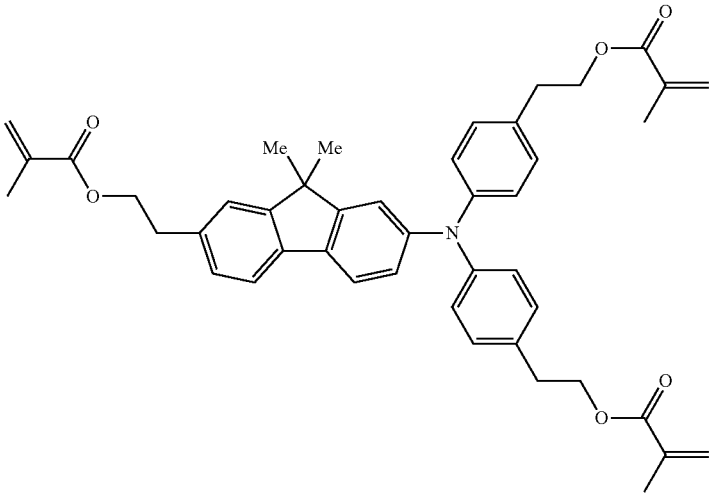 |

-continued
| No. |
| --- |
| iii-4 |
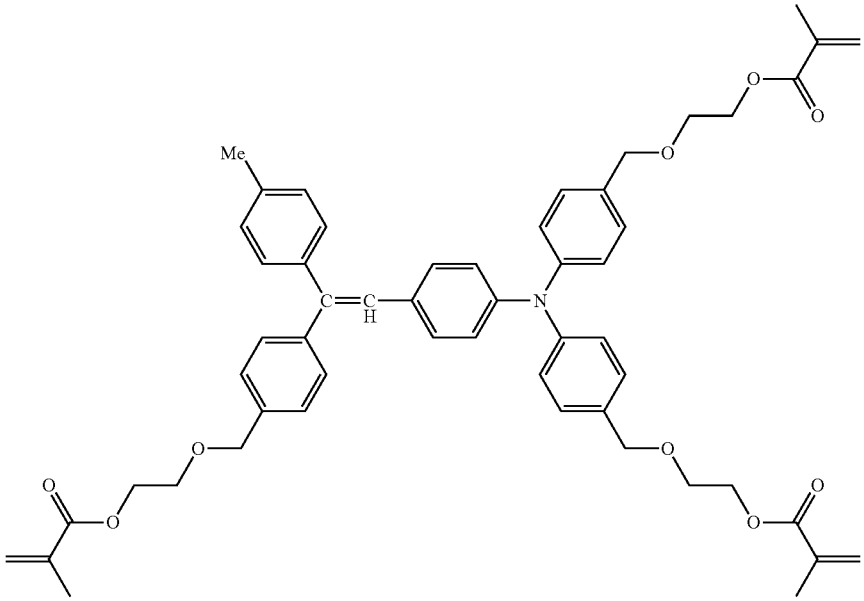
iii-5
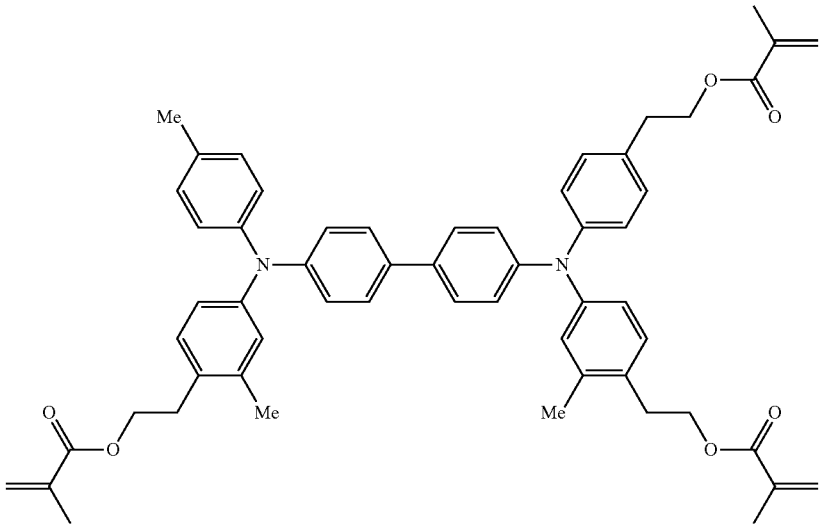

-continued
| No. | |
|---|---|
| iii-6 | 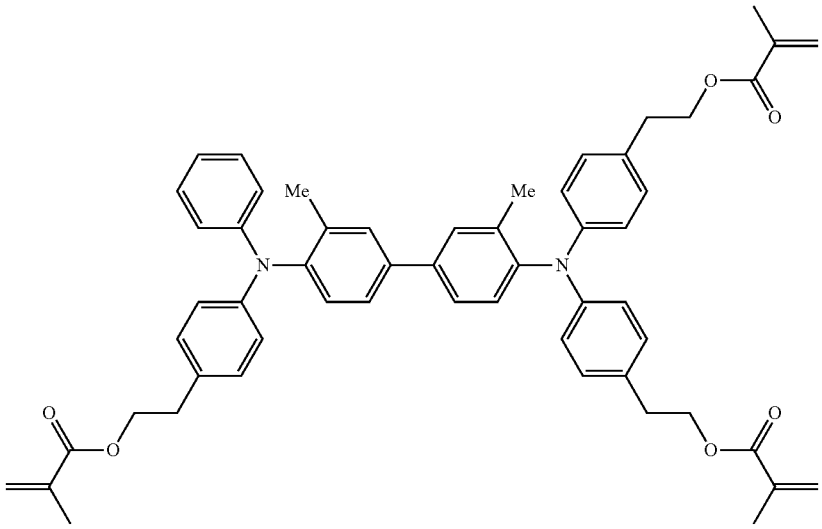 |
| iii-7 | 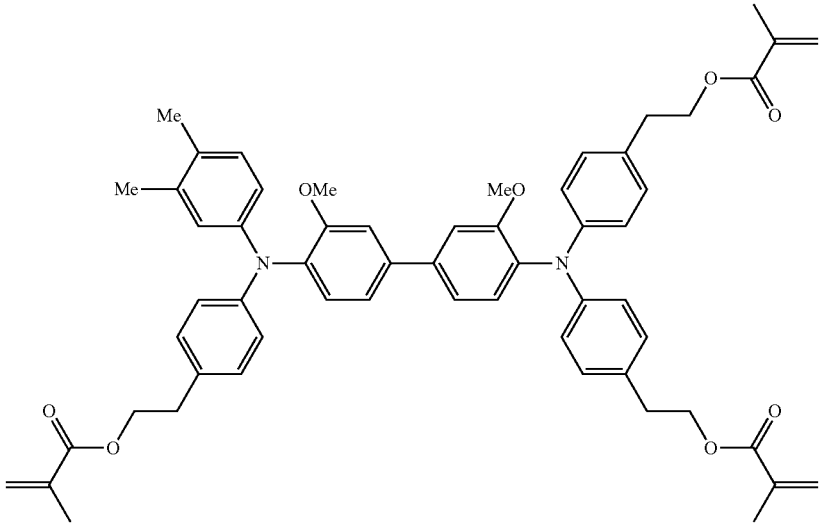 |
| iii-8 | 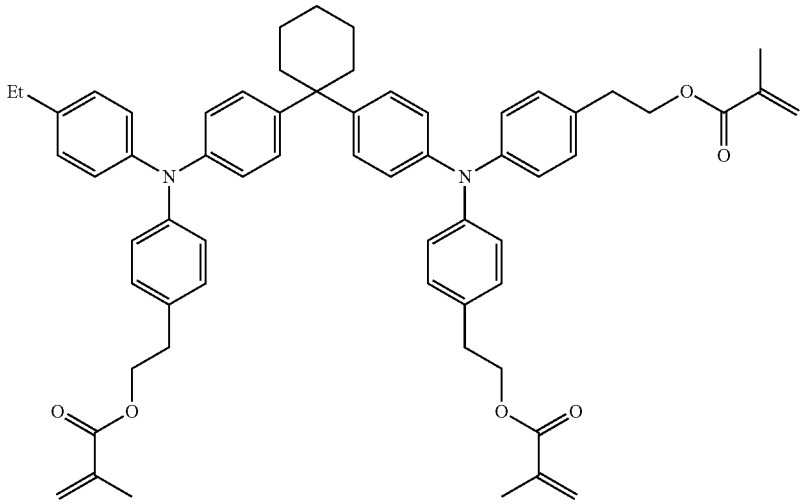 |

-continued
| No. | |
|---|---|
| iii-9 | 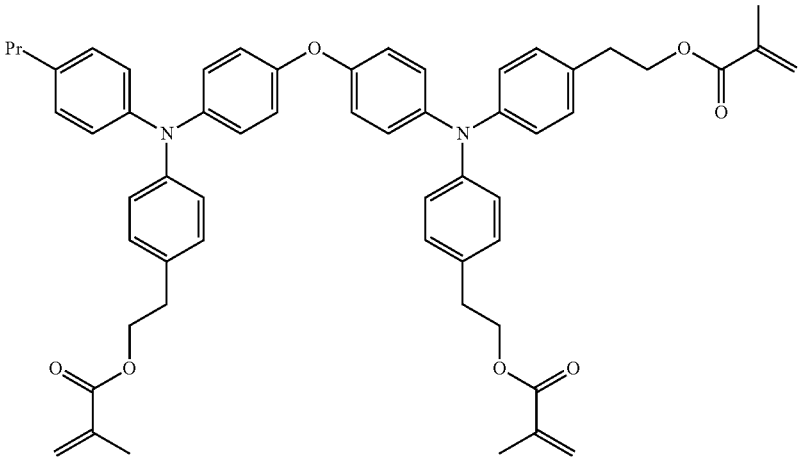 |
| iii-10 | 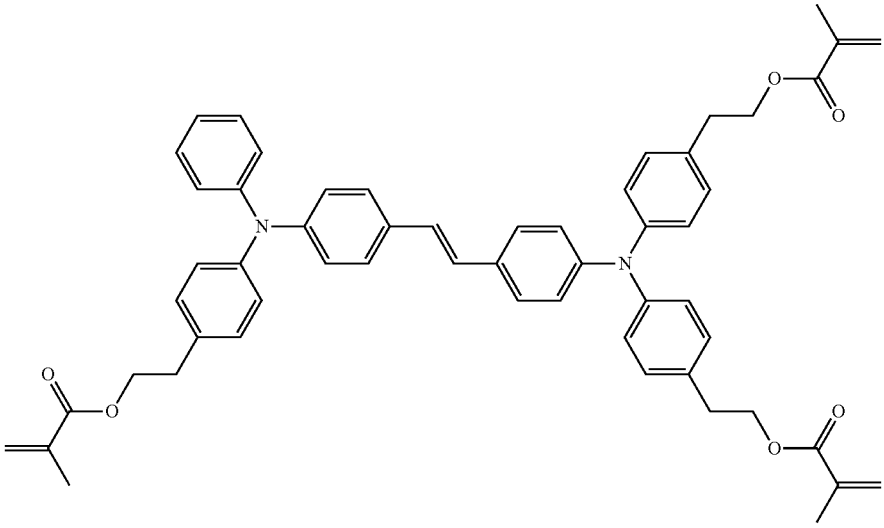 |
| iii-11 | 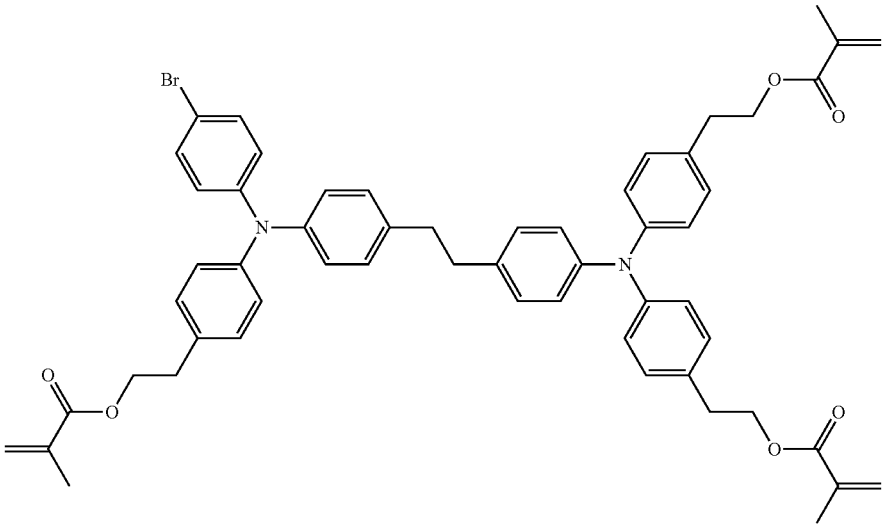 |

The following compounds are specific examples of the compound represented by Formula (I) wherein n is 4 (compounds iv-1 to iv-18), n is 5 (compound v-1), and n is 6 (compounds vi-1 to vi-2).
| No. | |
|---|---|
| iv-1 | 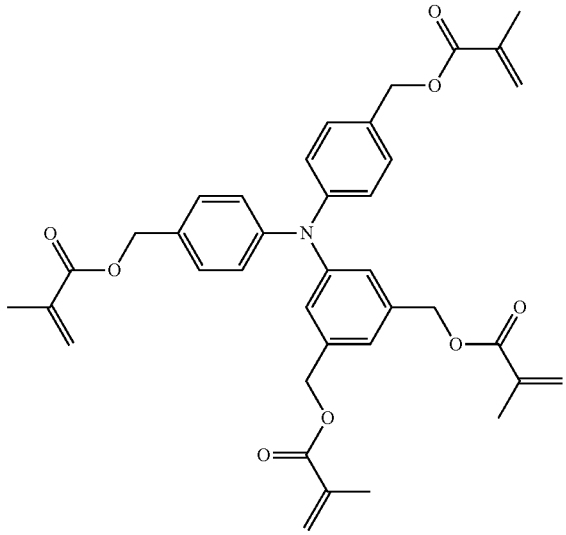 |
| iv-2 | 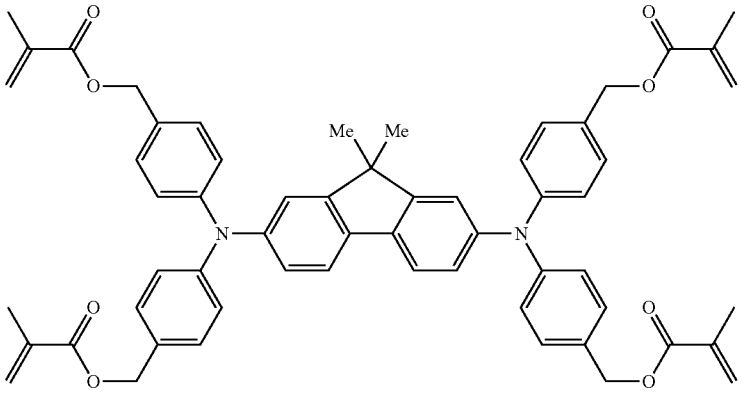 |
| iv-3 | 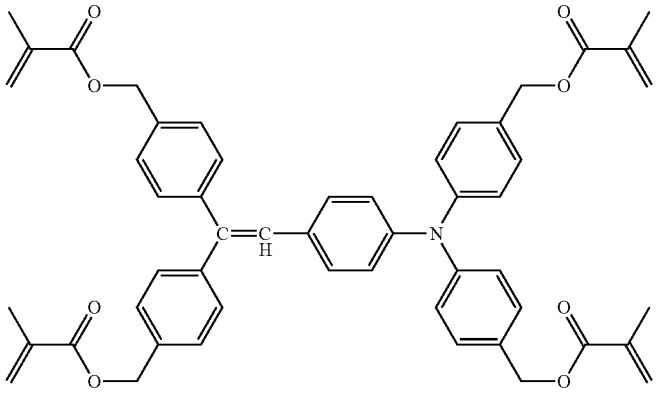 |

-continued
| No. | |
|---|---|
| iv-4 | 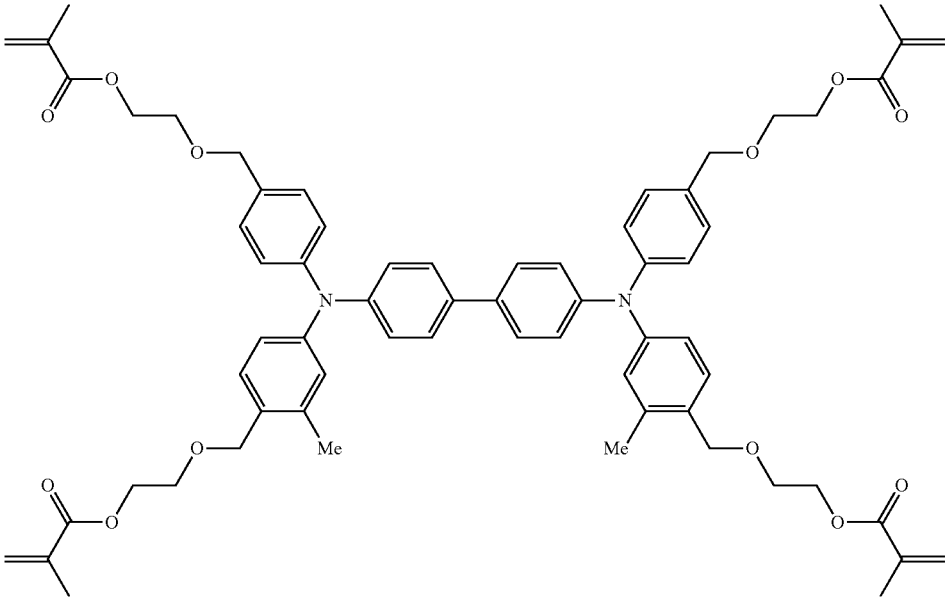 |
| iv-5 | 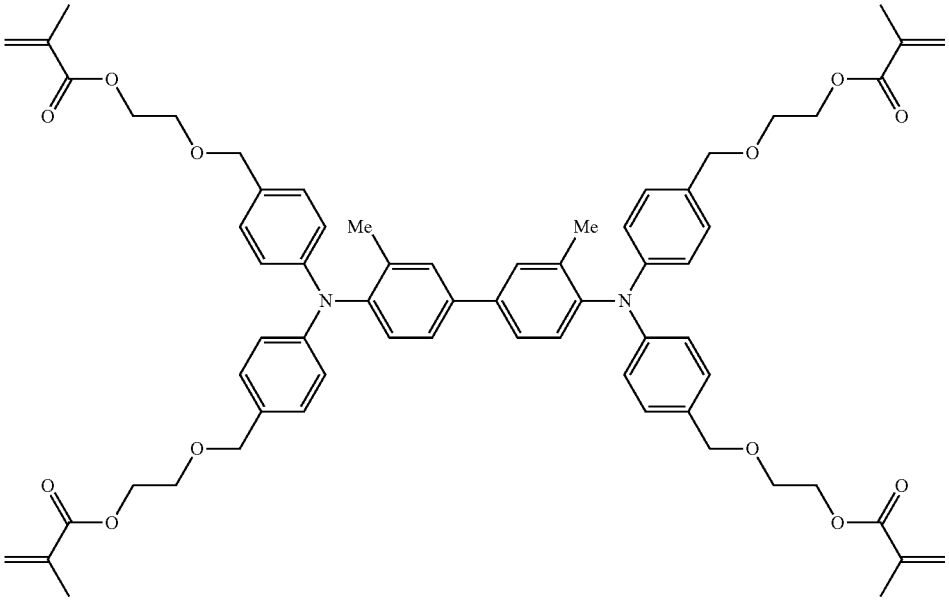 |

-continued
| No. | |
|---|---|
| iv-6 | 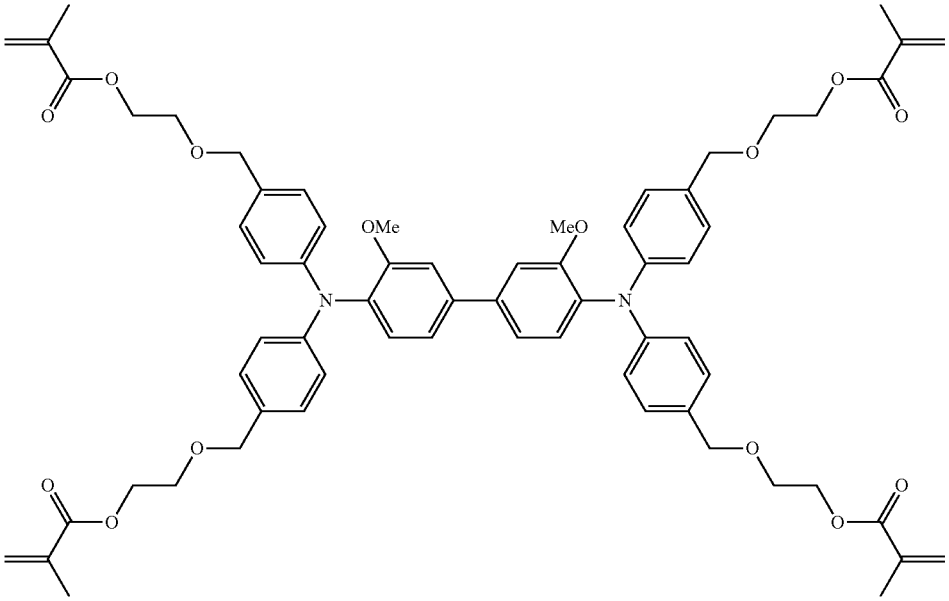 |
| iv-7 | 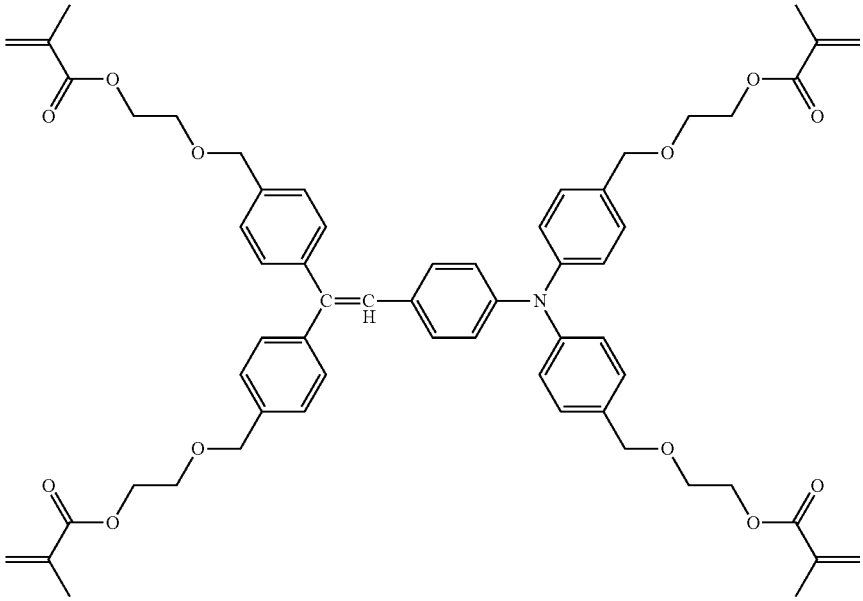 |

-continued
| No. | |
|---|---|
| iv-8 | 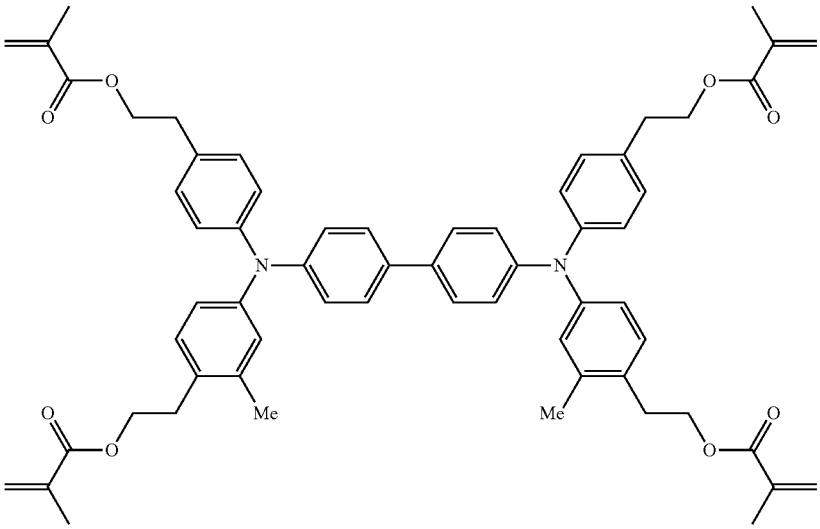 |
| iv-9 | 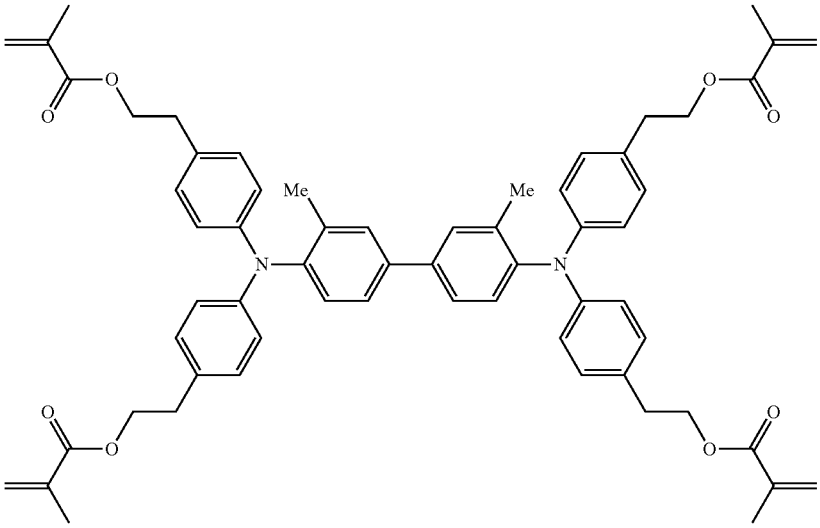 |
| iv-10 | 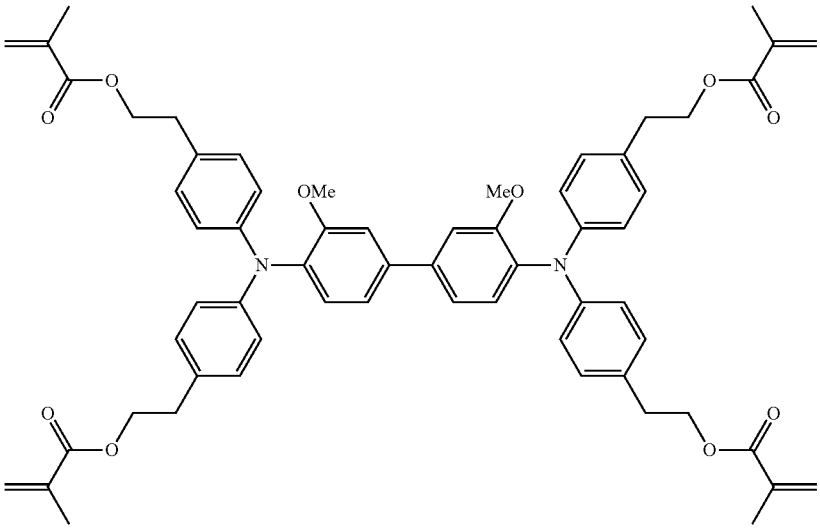 |

-continued

| No. |
| --- |
| iv-11 |
| iv-12 |
| iv-13 |

-continued
| No. | |
|---|---|
| iv-14 | 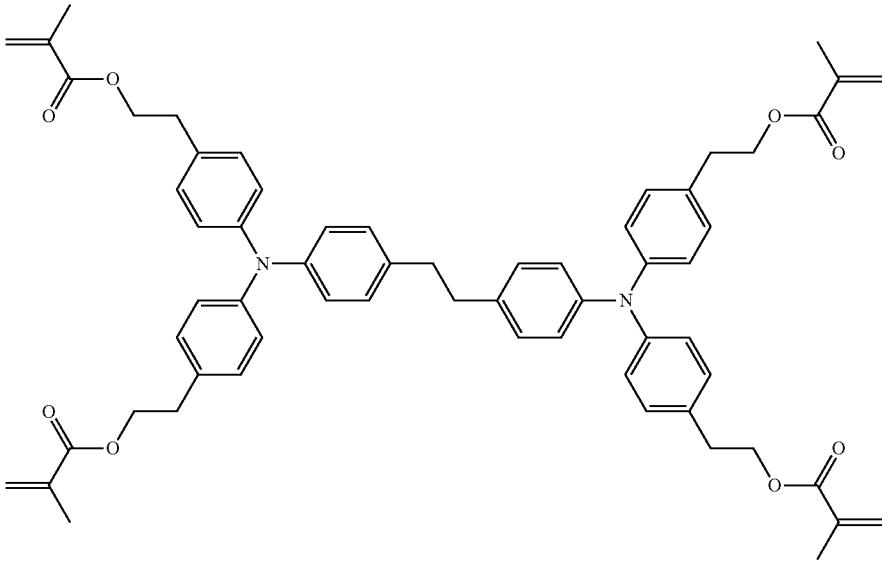 |
| iv-15 | 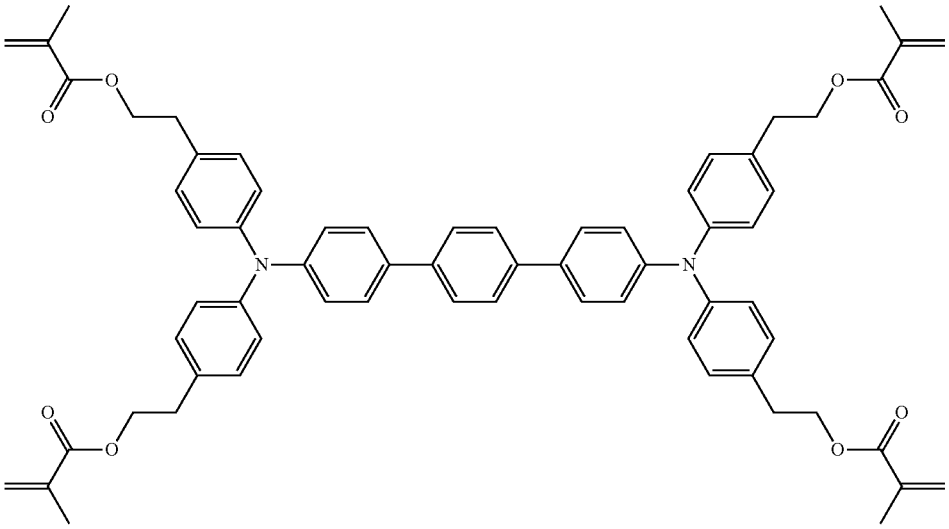 |

-continued
| No. | |
|---|---|
| iv-16 | 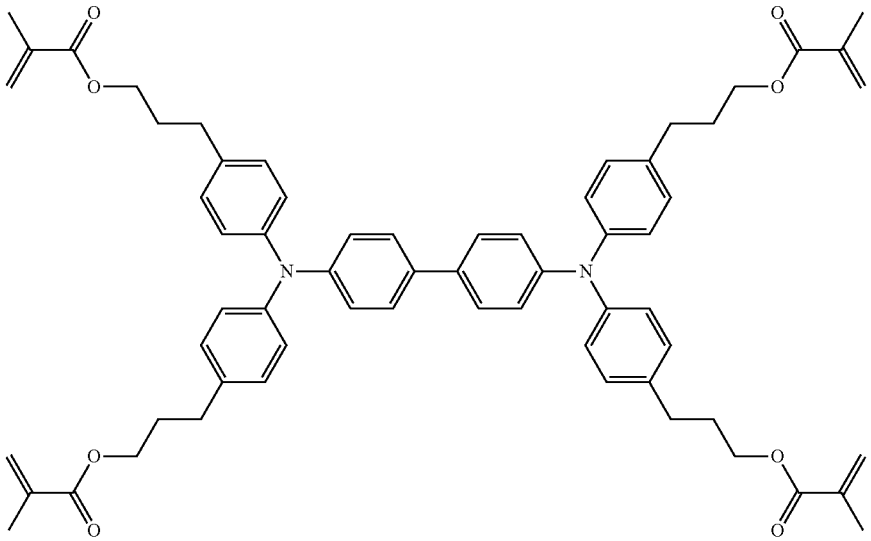 |
| iv-17 | 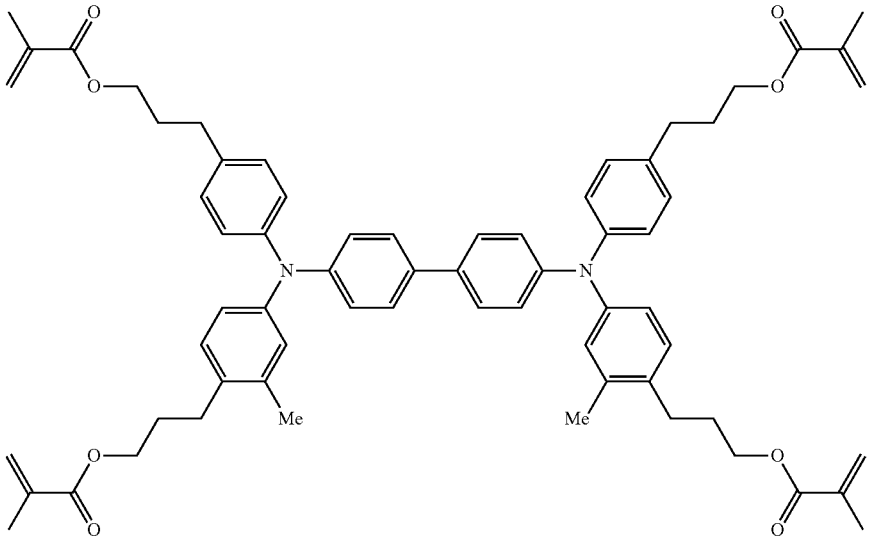 |
| iv-18 | 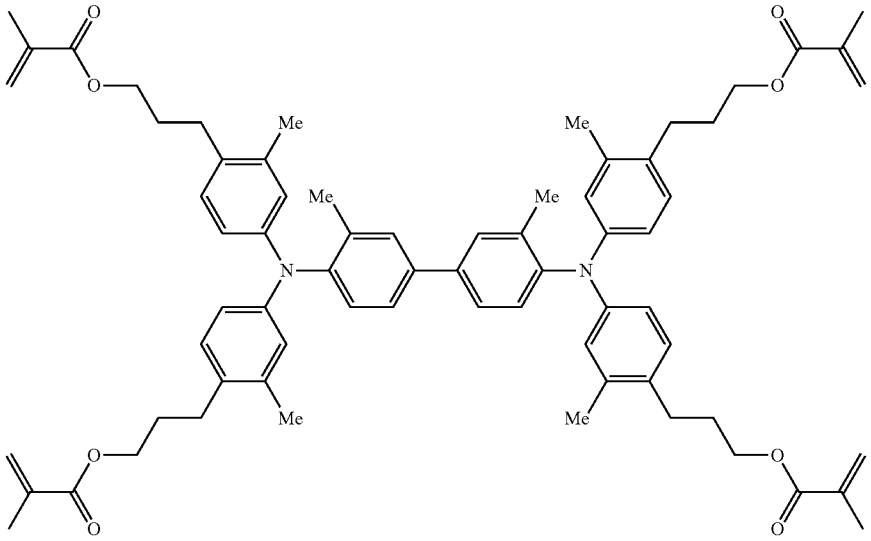 |

-continued
| No. | |
|---|---|
| v-1 | 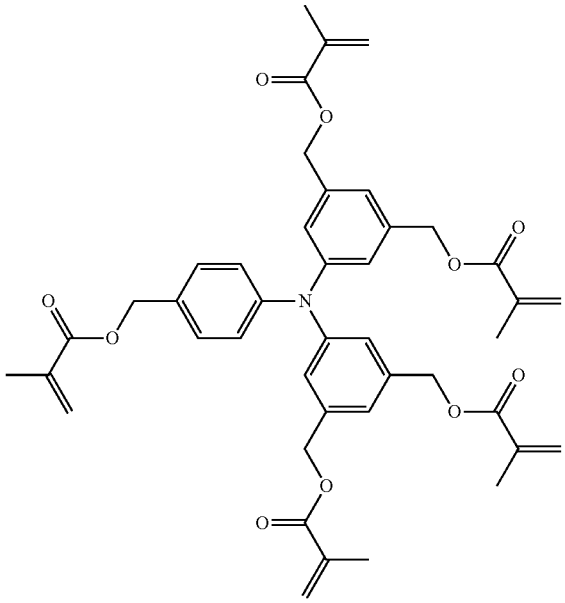 |
| vi-1 | 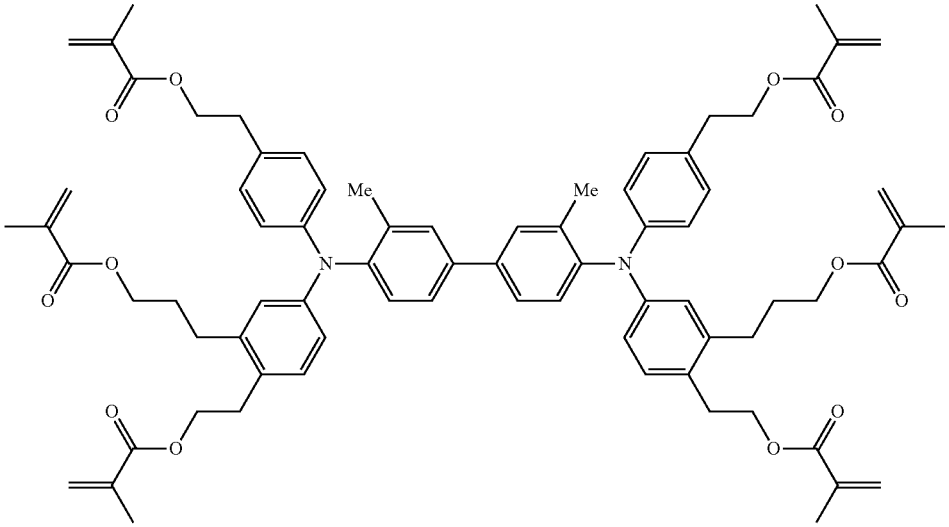 |

-continued
| No. | |
|---|---|
| vi-2 | 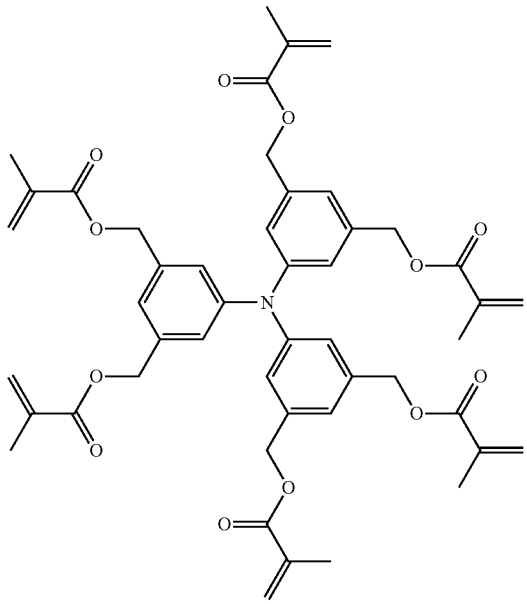 |
Examples of the synthetic pathways of the compounds iv-4 and iv-17 are shown below.
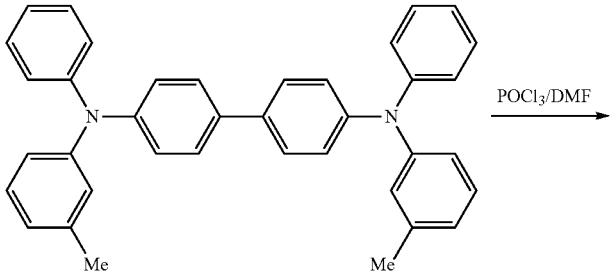
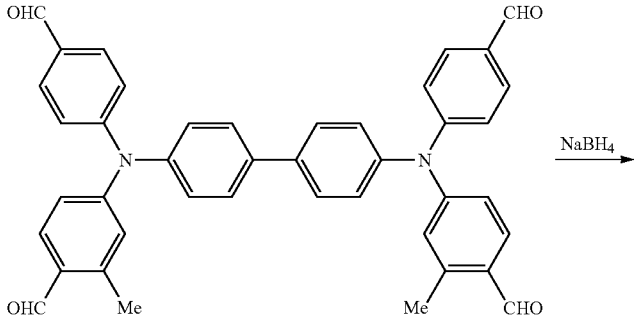

-continued
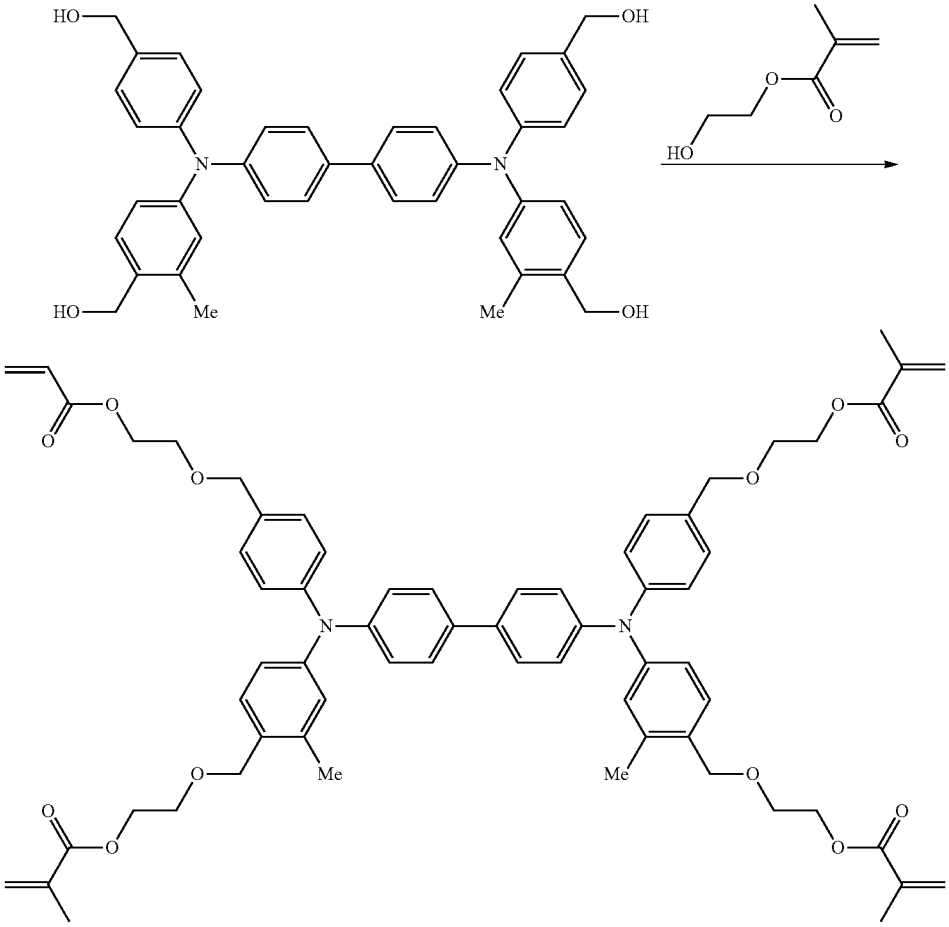
Compound iv-4
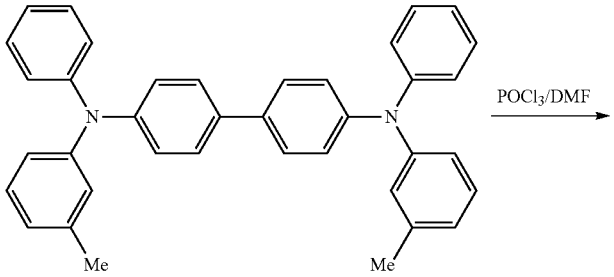
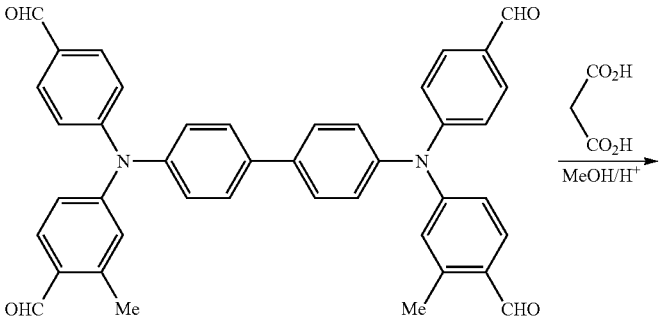

-continued
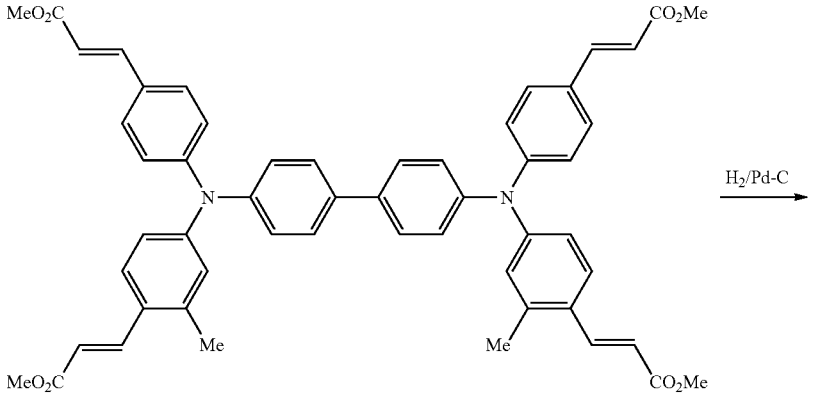
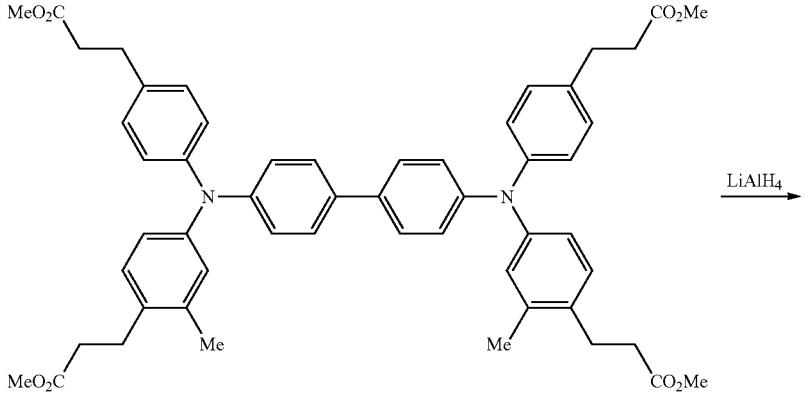
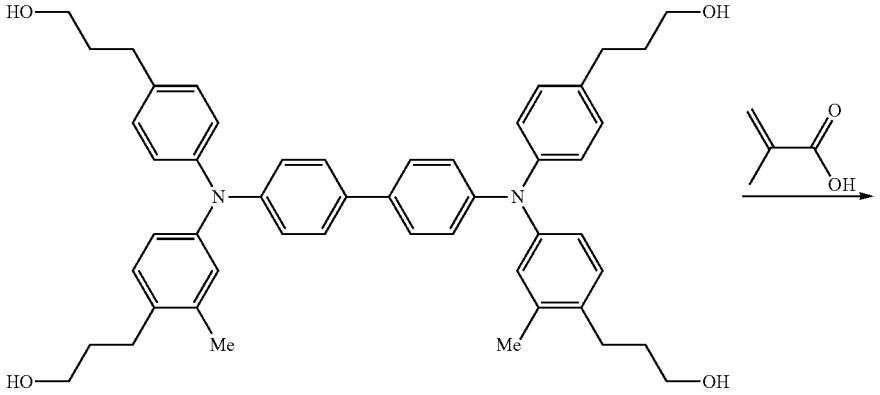

-continued

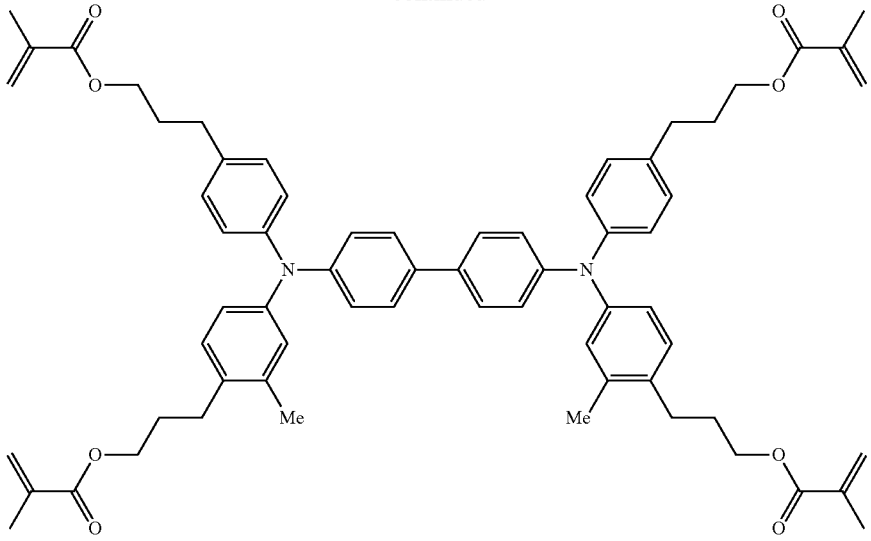

Compound iv-17

Other compounds represented by Formula (I) can be synthesized through, for example, the same synthetic pathway as the compounds iv-4 and iv-17.

In the present exemplary embodiment, as described above, the compound represented by Formula (I) preferably has an n value of 2 or more, and more preferably 4 or more.

The compound represented by Formula (I) may be a combination of a compound having an n value of 4 or more and a compound having an n value of 1 to 3. The combination enables to control strength of the cured film without deterioration of charge transport capability.

When the compound represented by Formula (I) is a combination of a compound having an n value of 4 or more and a compound having an n value of 1 to 3, the content of the compound having an n value of 4 or more is preferably 5% by weight or more, and more preferably 20% by weight or more with respect to the total content of the compound represented by Formula (I).

Specific examples of the charge transporting material having a chain polymerizable functional group other than the compound represented by Formula (I) are shown below. However, the material is not limited to these examples.

| No. | |
|---|---|
| i-15 | 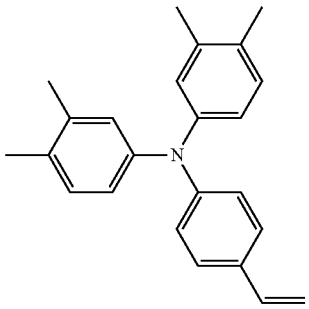 |
| i-16 | 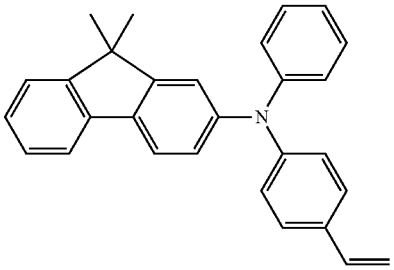 |

-continued
| No. | |
|---|---|
| i-17 | 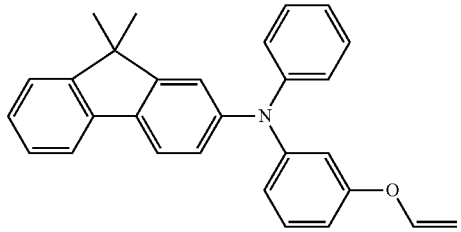 |
| i-18 | 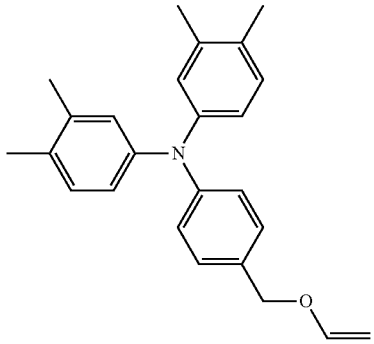 |
| i-19 | 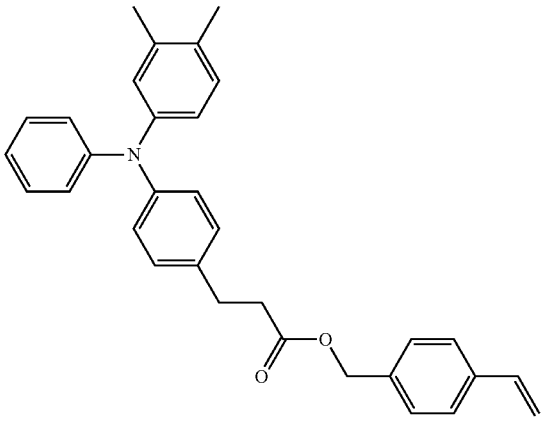 |
| i-20 | 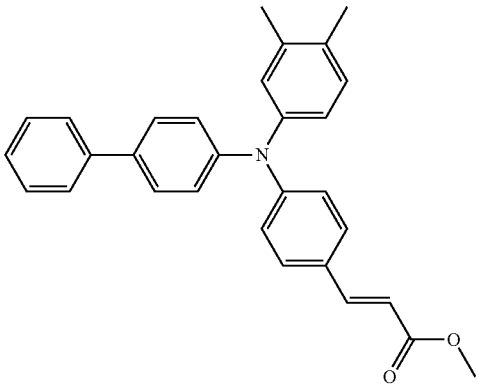 |

-continued
| No. | |
|---|---|
| i-21 | 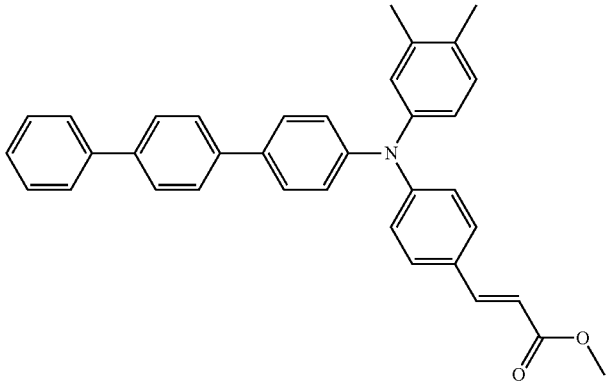 |
| i-22 | 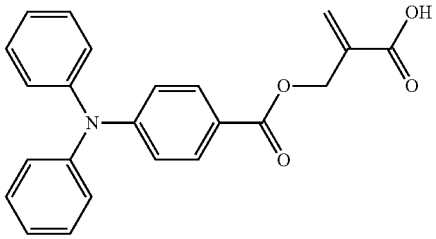 |
| i-23 | 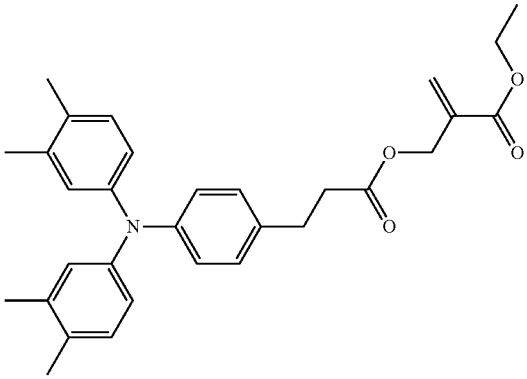 |
| i-24 | 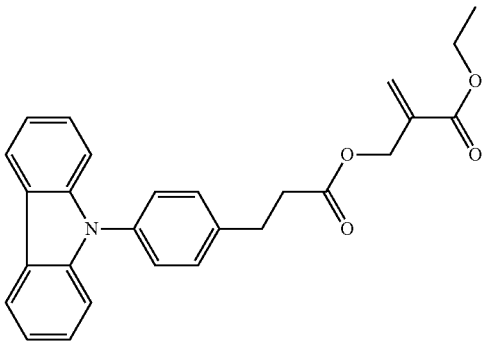 |

-continued
| No. | |
|---|---|
| i-25 | 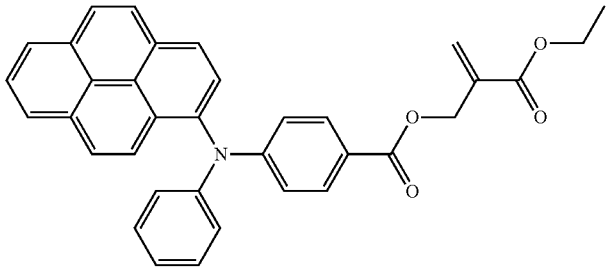 |
| ii-27 | 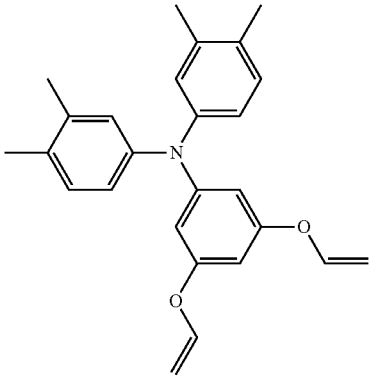 |
| ii-28 | 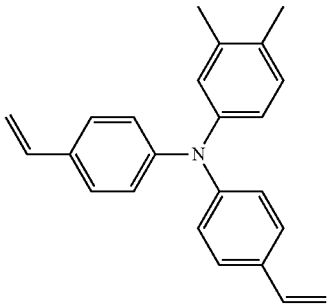 |
| ii-29 | 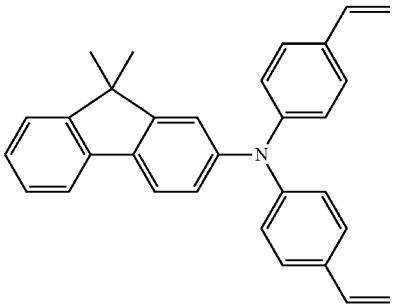 |
| ii-30 | 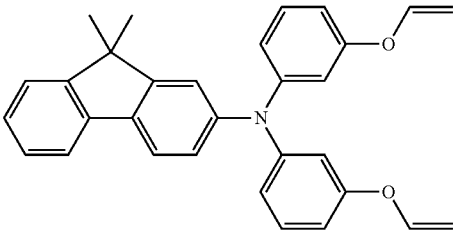 |

-continued
| No. | |
|---|---|
| ii-31 | 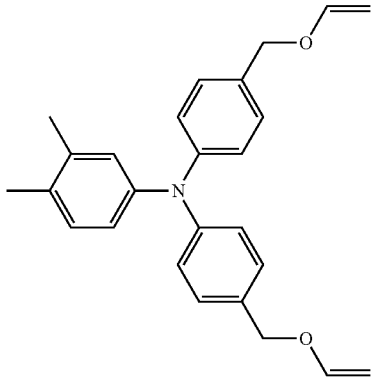 |
| ii-32 | 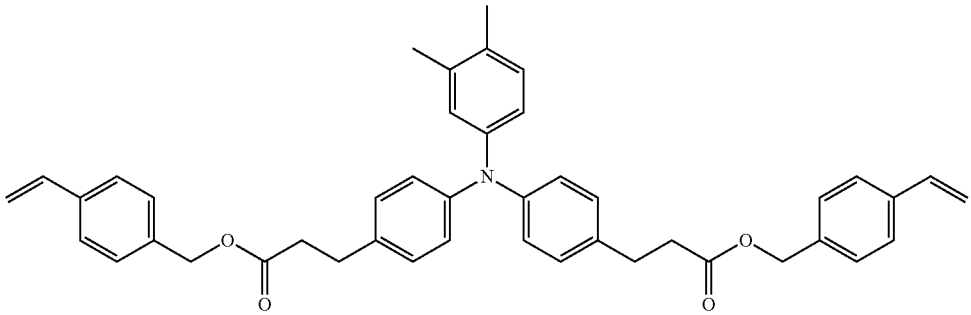 |
| ii-33 | 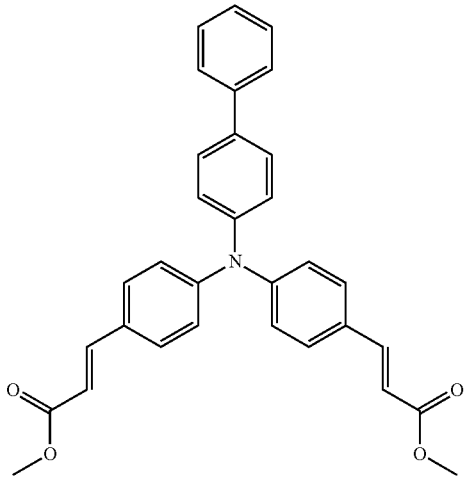 |

-continued
| No. | |
|---|---|
| ii-34 | 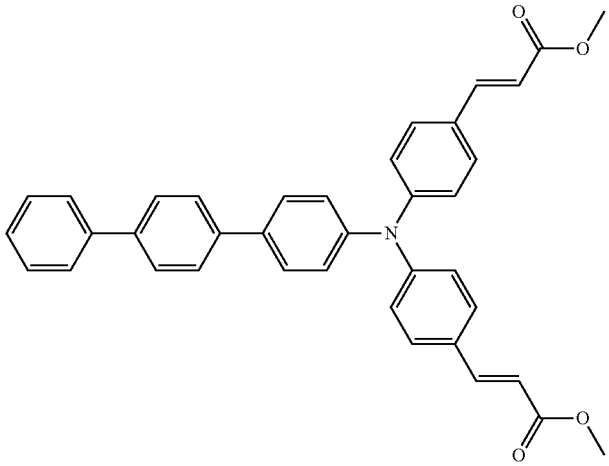 |
| ii-35 | 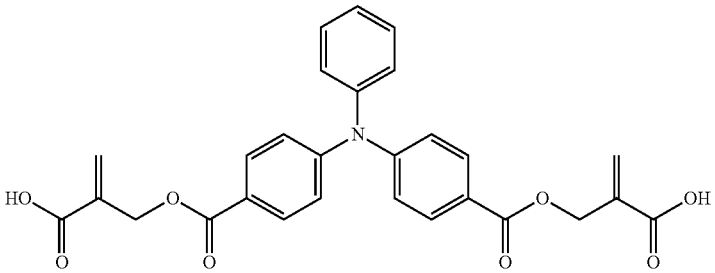 |
| ii-36 | 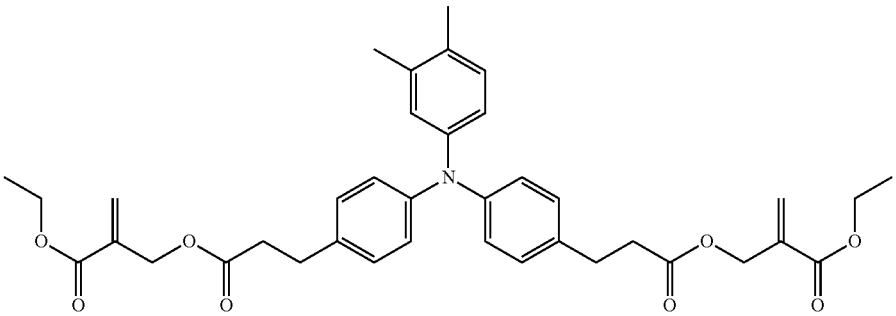 |
| ii-37 | 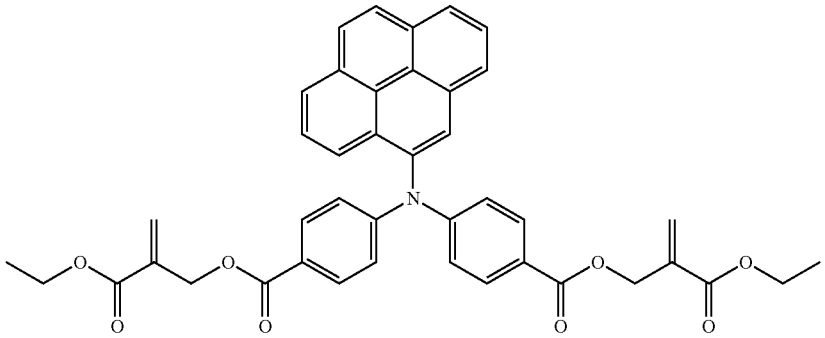 |

-continued
| No. | |
|---|---|
| ii-38 | 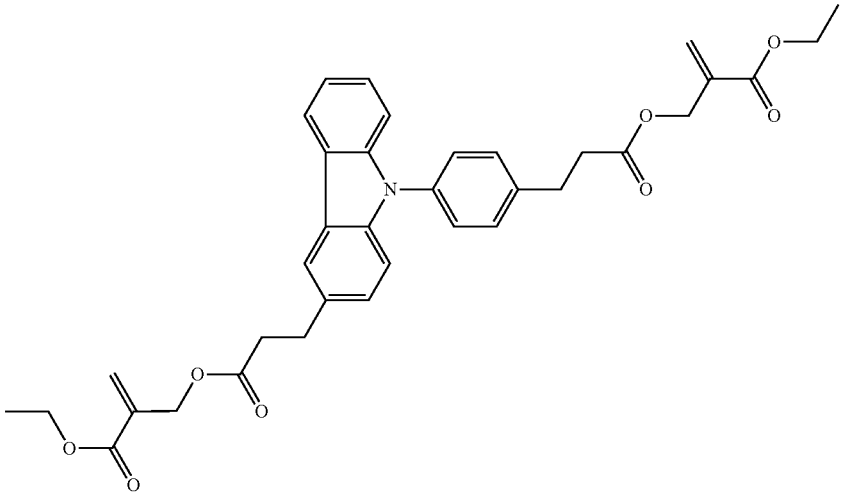 |
| ii-39 | 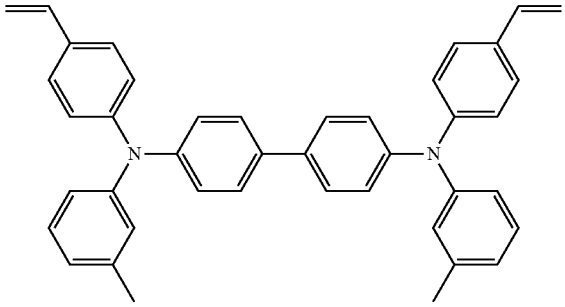 |
| ii-40 | 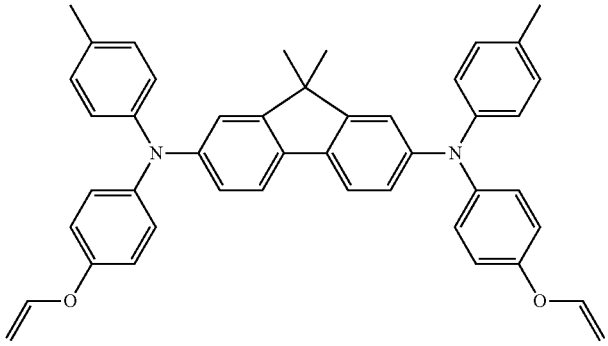 |
| ii-41 | 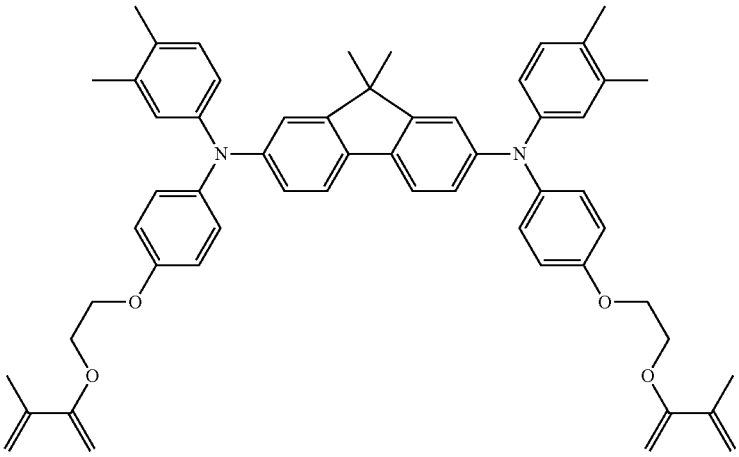 |

-continued
| No. | |
|---|---|
| ii-42 | 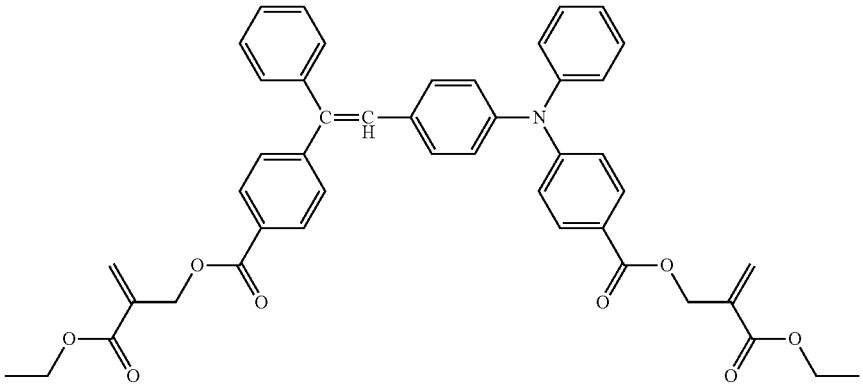 |
| ii-43 | 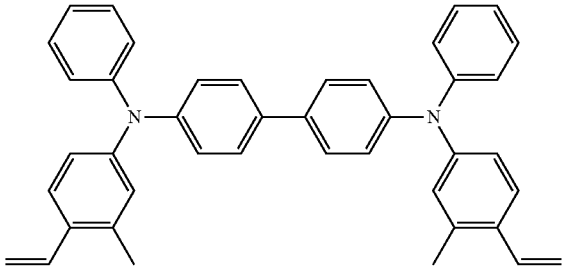 |
| ii-44 | 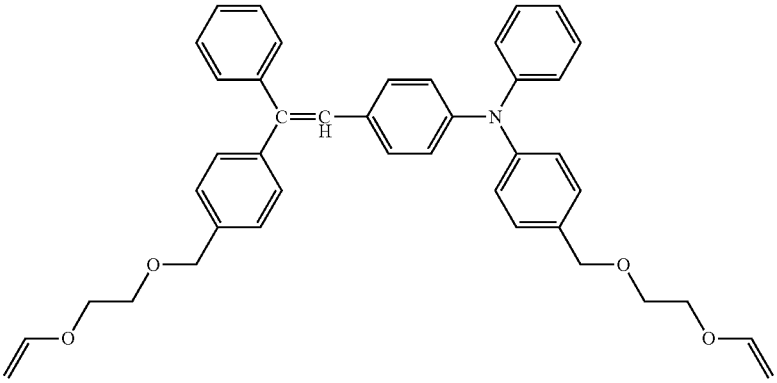 |
| ii-45 | 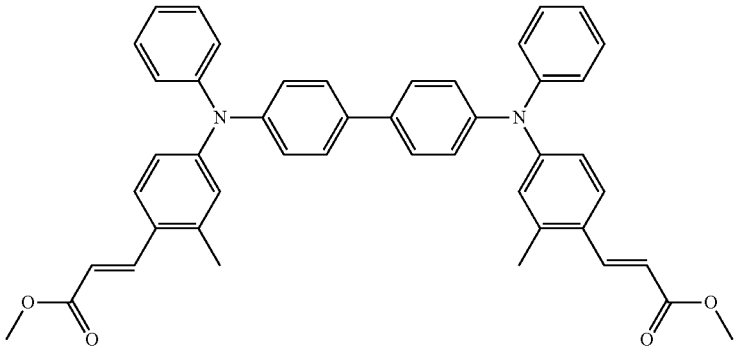 |

-continued
| No. | |
|---|---|
| ii-46 | 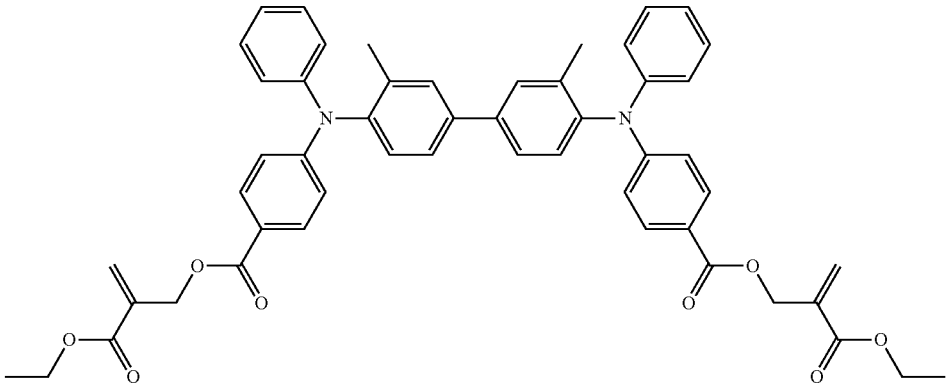 |
| ii-47 | 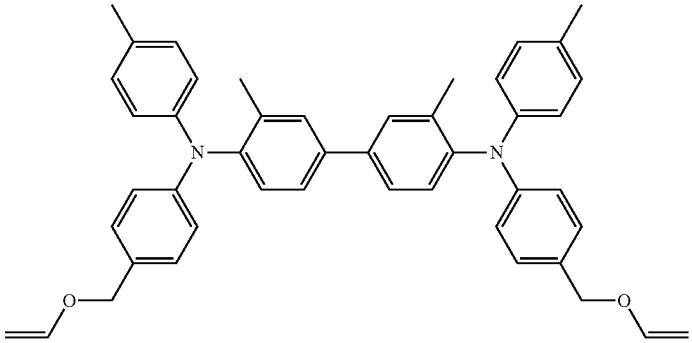 |
| ii-48 | 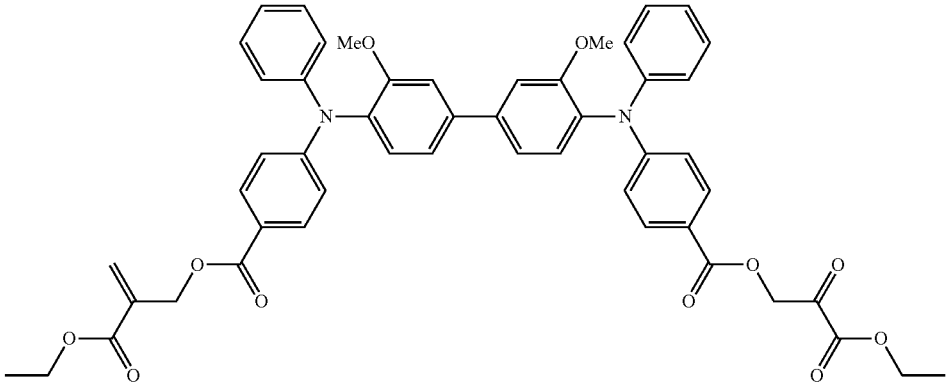 |
| ii-49 | 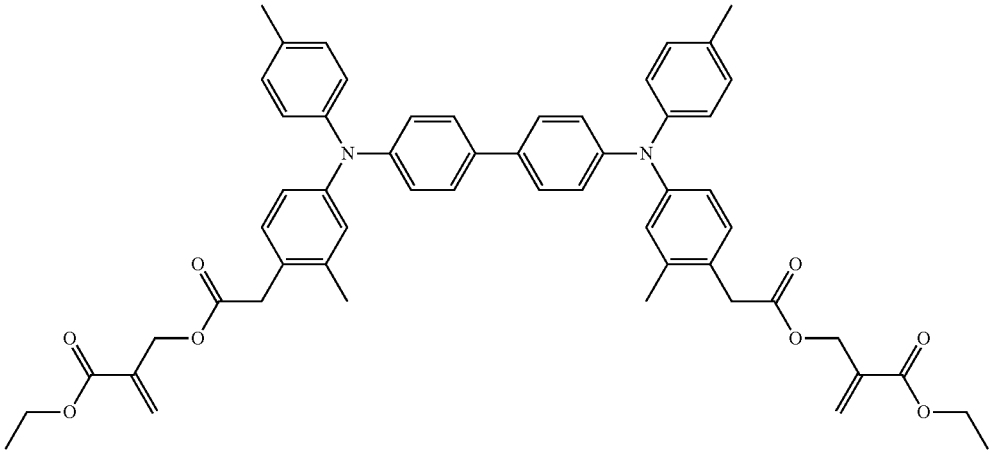 |

-continued
| No. | |
|---|---|
| ii-50 | 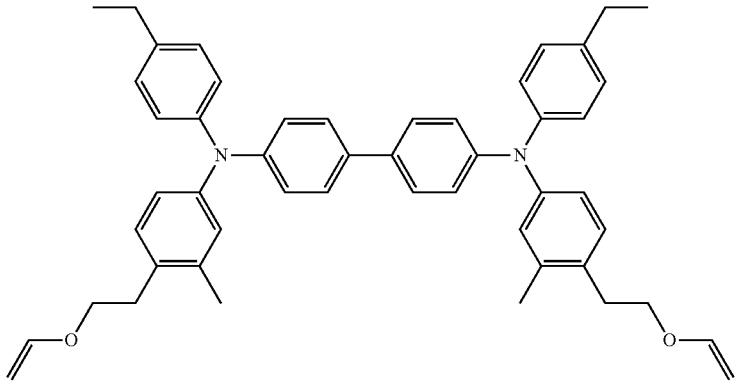 |
| ii-51 | 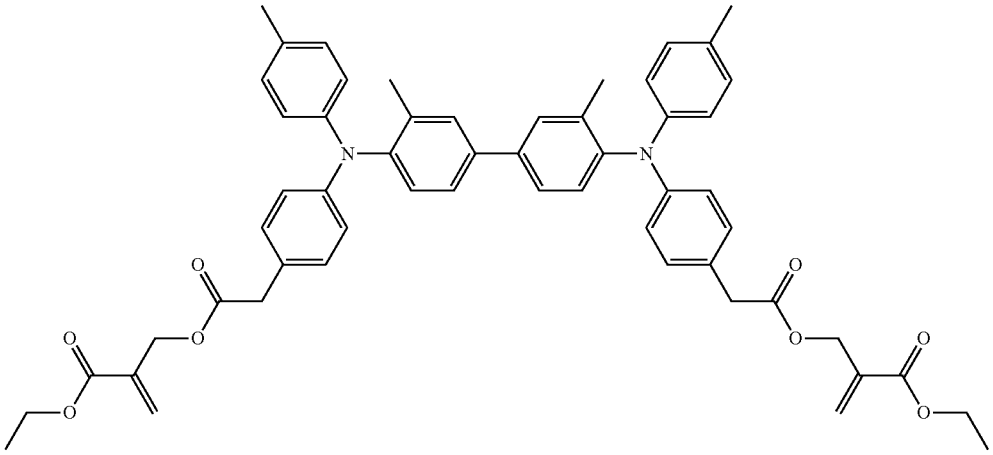 |
| ii-52 | 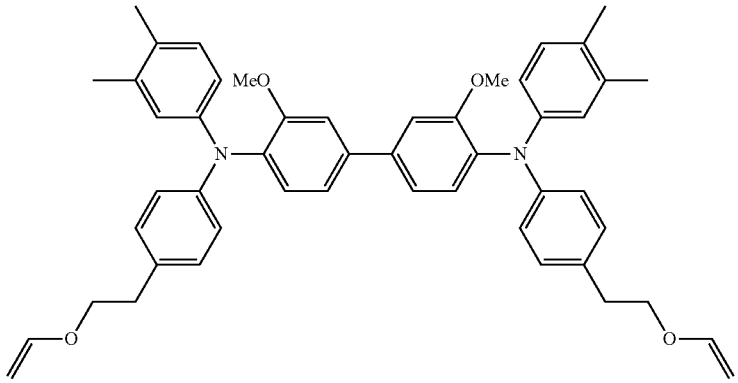 |

-continued
| No. | |
|---|---|
| ii-53 | 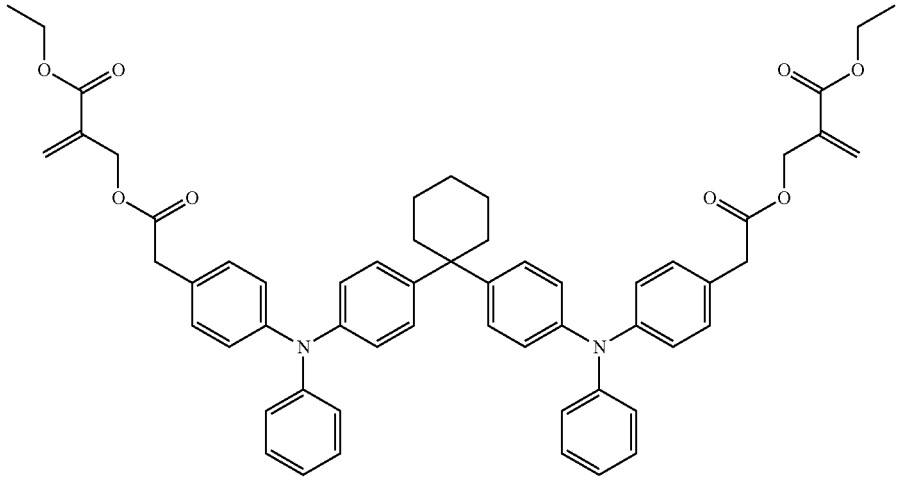 |
| ii-54 | 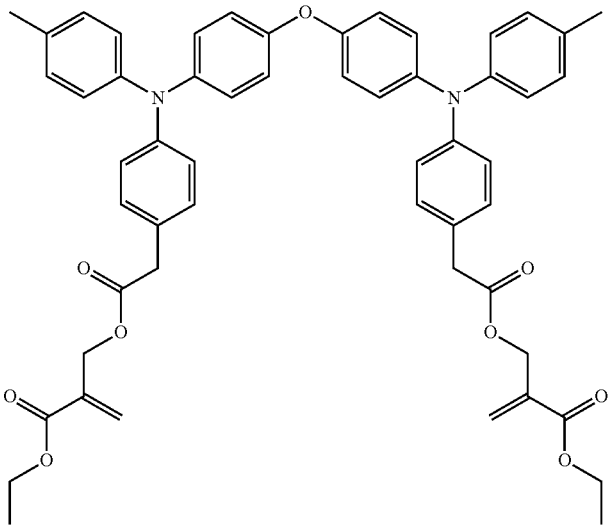 |
| ii-55 | 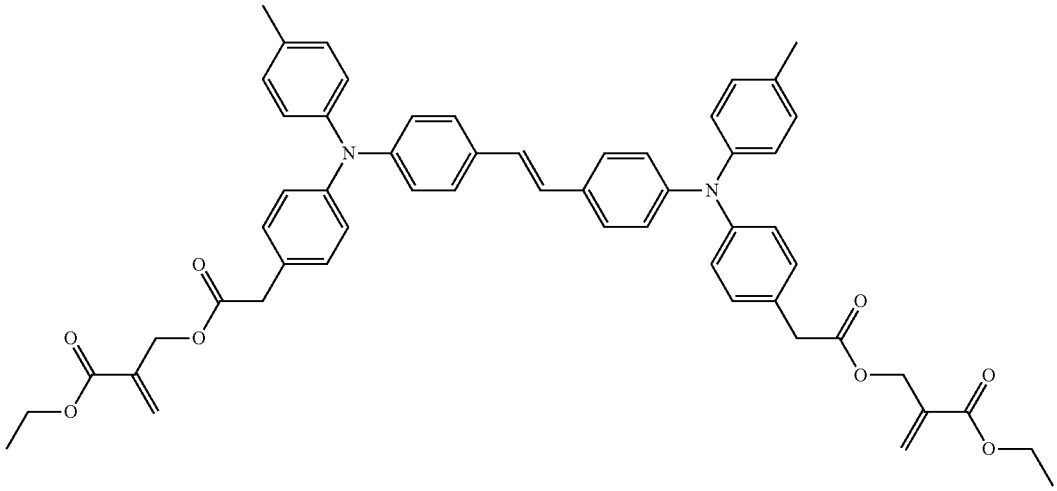 |

-continued
| No. | |
|---|---|
| ii-56 | 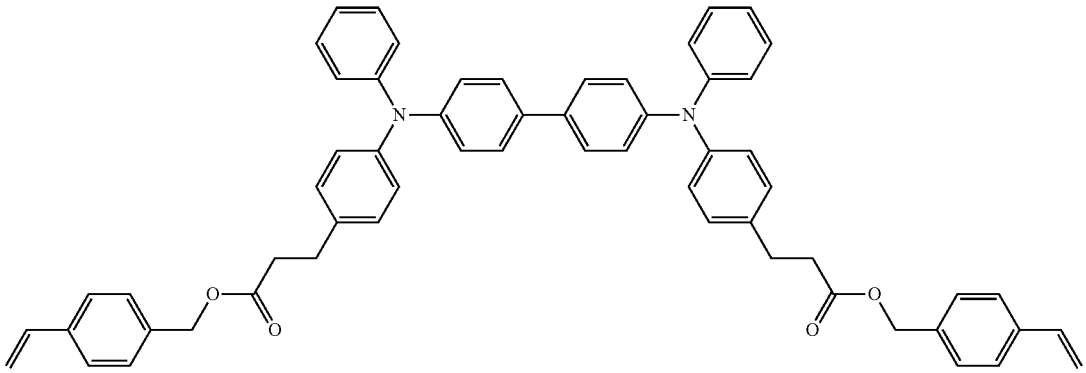 |
| iii-12 | 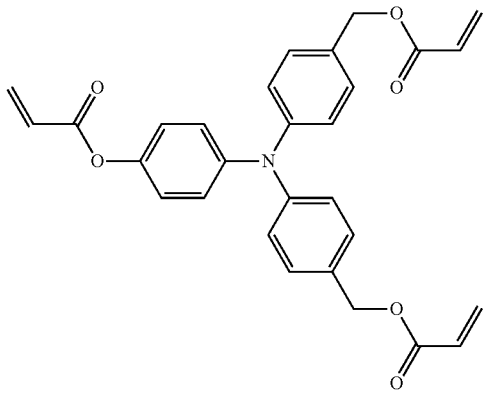 |
| iii-13 | 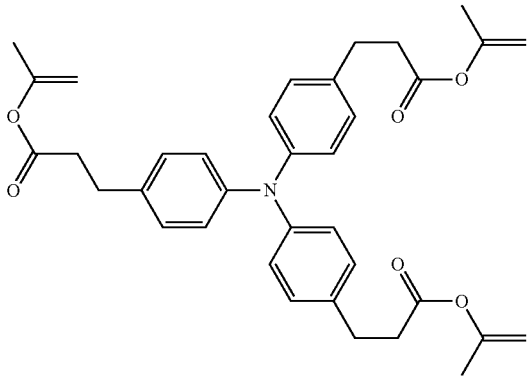 |
| iii-14 | 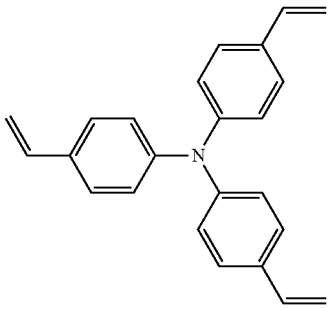 |

-continued
| No. | |
|---|---|
| iii-15 | 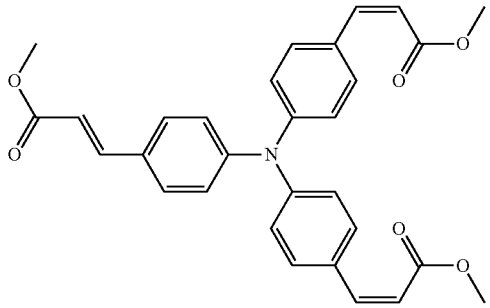 |
| iii-16 | 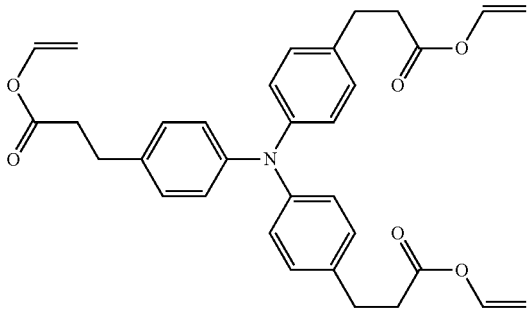 |
| iii-17 | 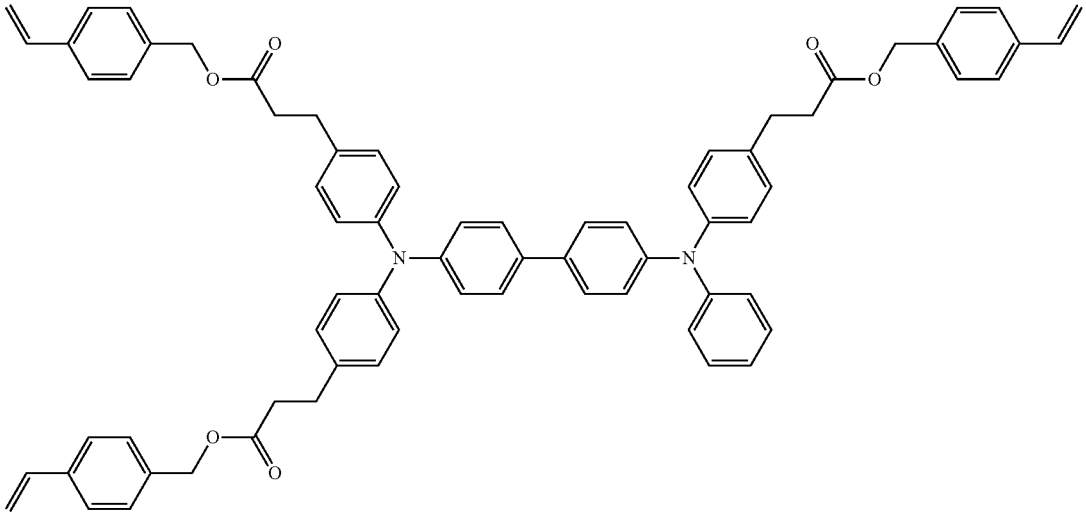 |

-continued
| No. | |
|---|---|
| iii-18 | 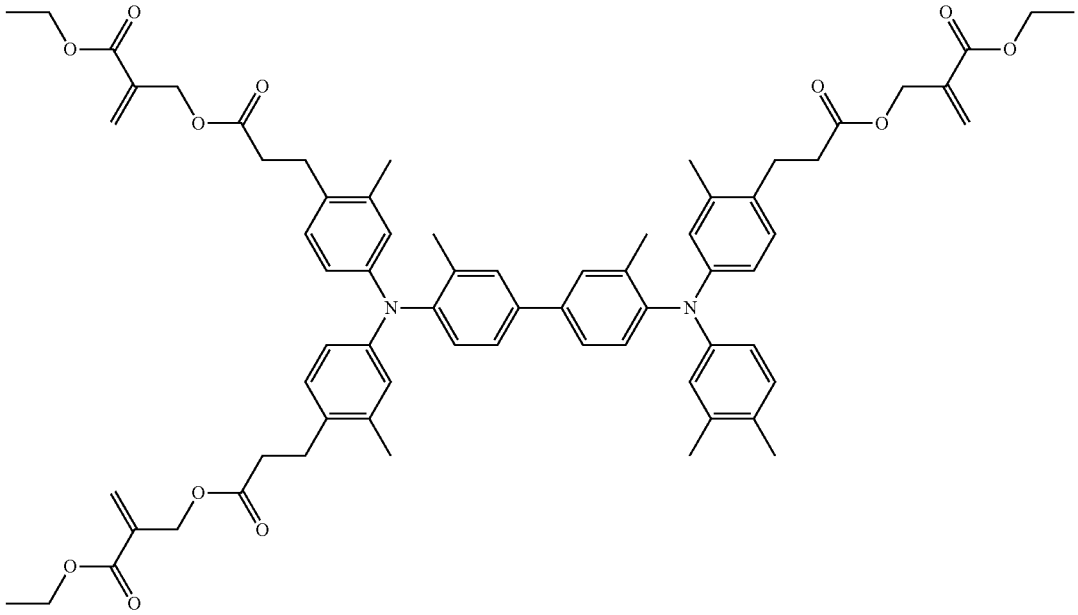 |
| iii-19 | 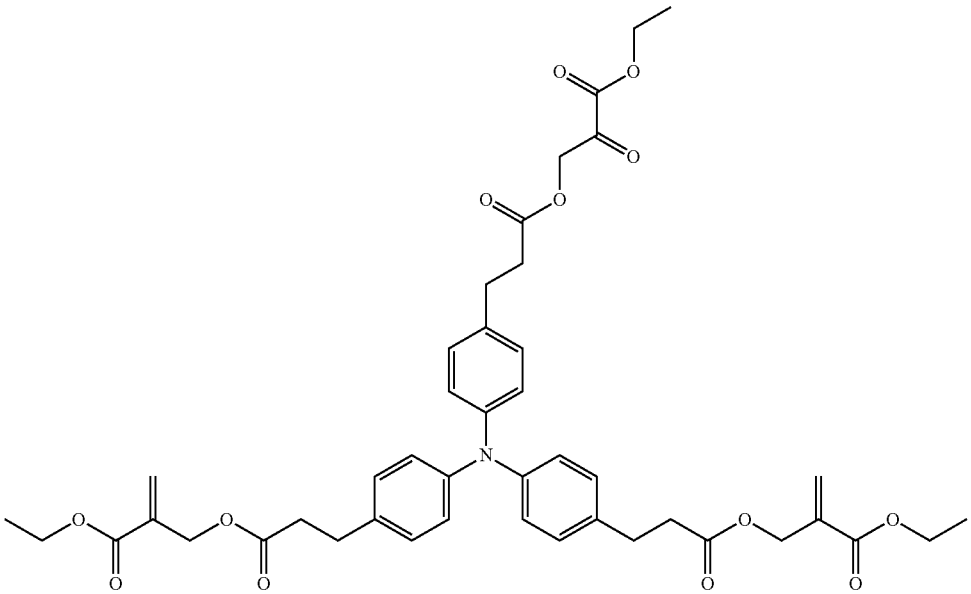 |
| iv-19 | 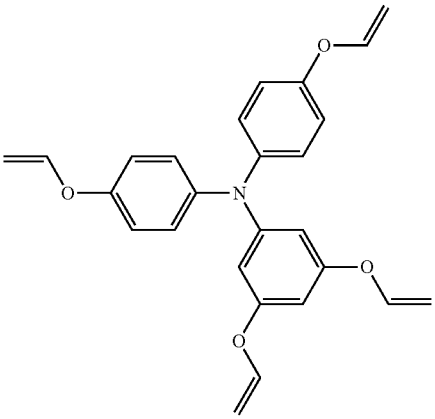 |

-continued
| No. | |
|---|---|
| iv-20 | 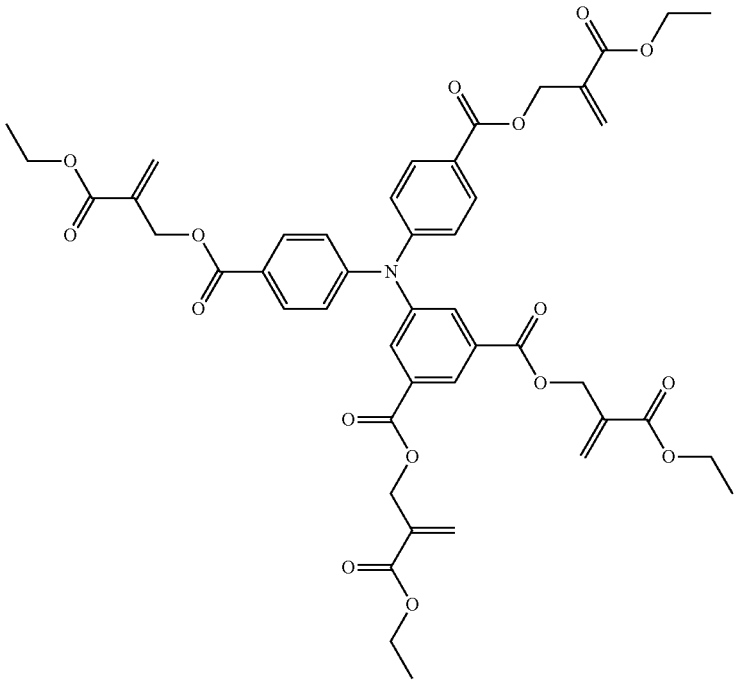 |
| iv-21 | 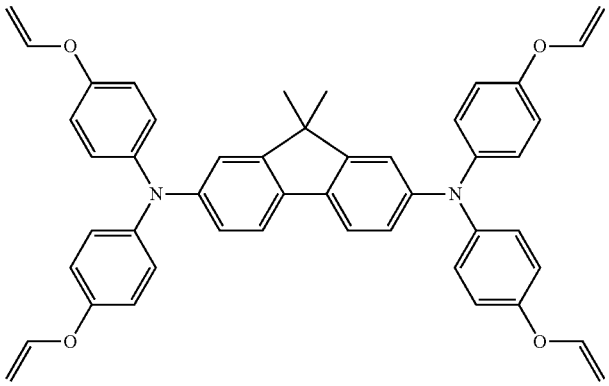 |

-continued
| No. | |
|---|---|
| iv-22 | 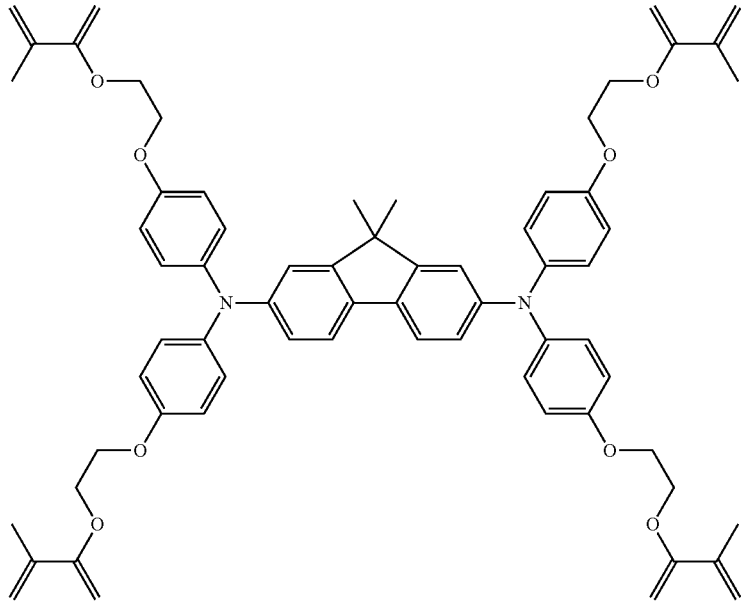 |
| iv-23 | 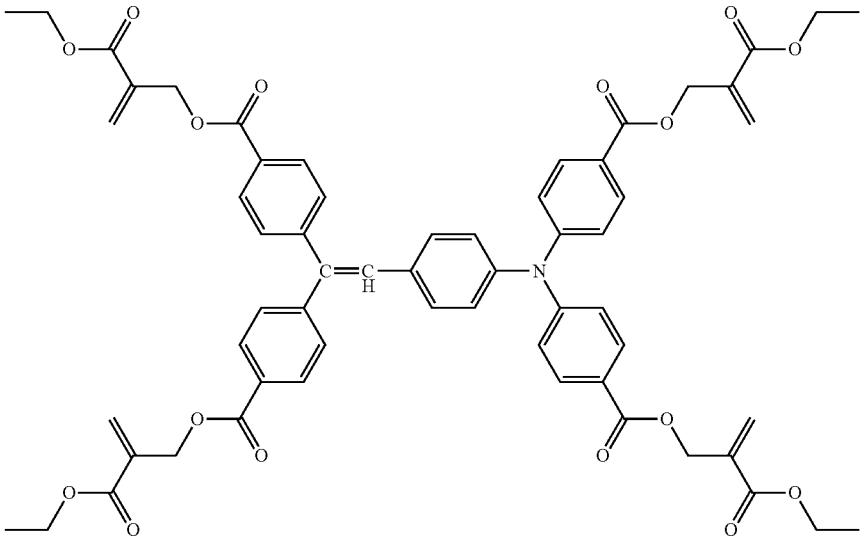 |

-continued
| No. | |
|---|---|
| iv-24 | 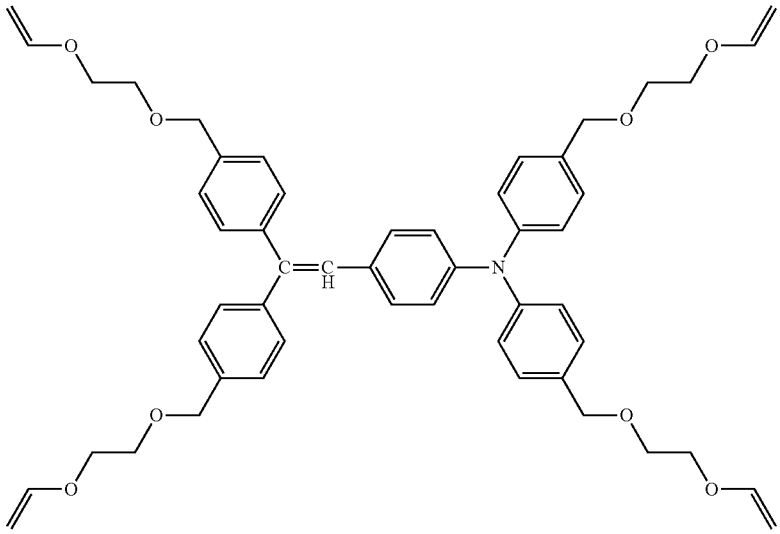 |
| iv-25 | 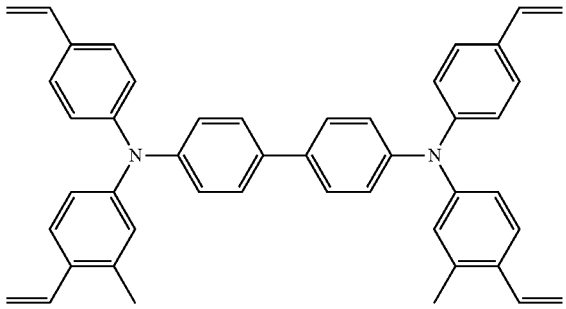 |
| iv-26 | 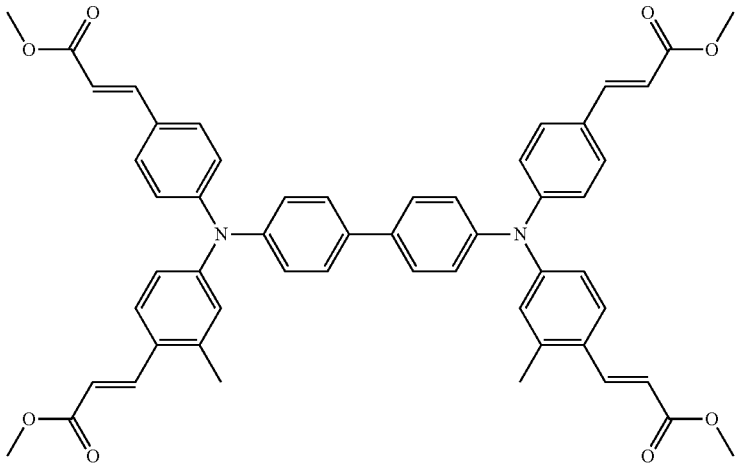 |

-continued
| No. | |
|---|---|
| iv-27 | 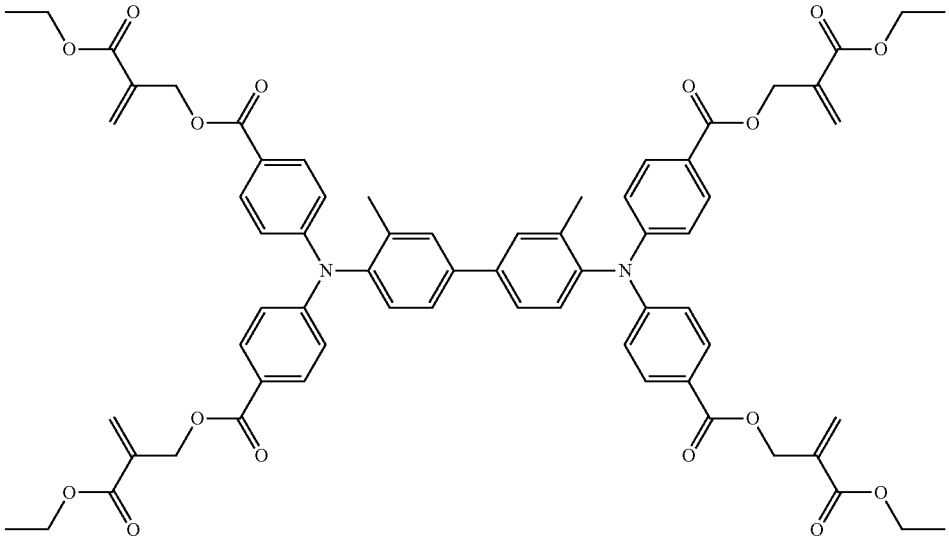 |
| iv-28 | 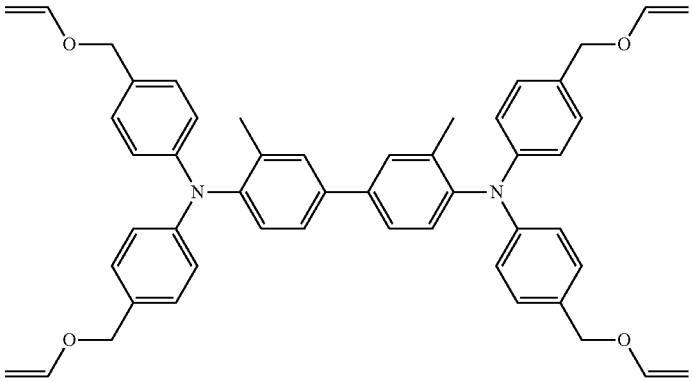 |
| iv-29 | 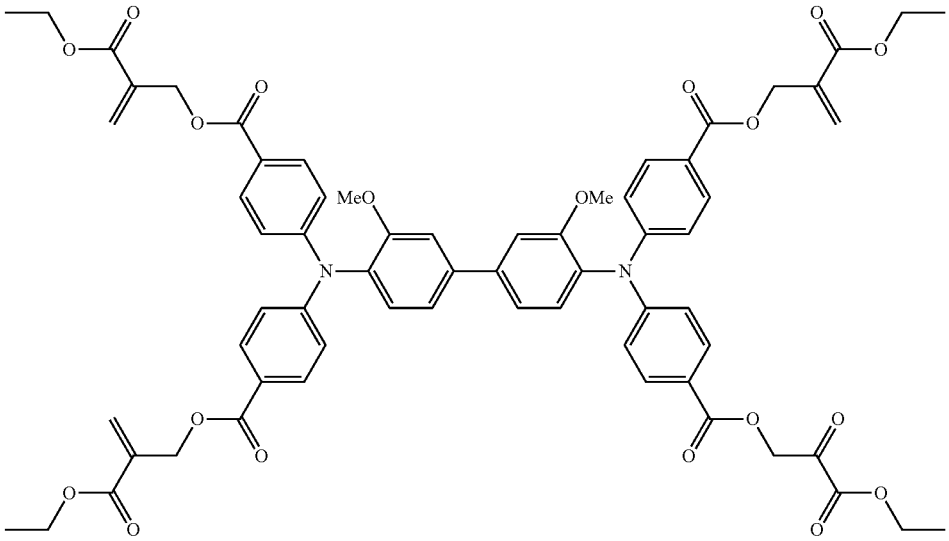 |

-continued
| No. | |
|---|---|
| iv-30 | 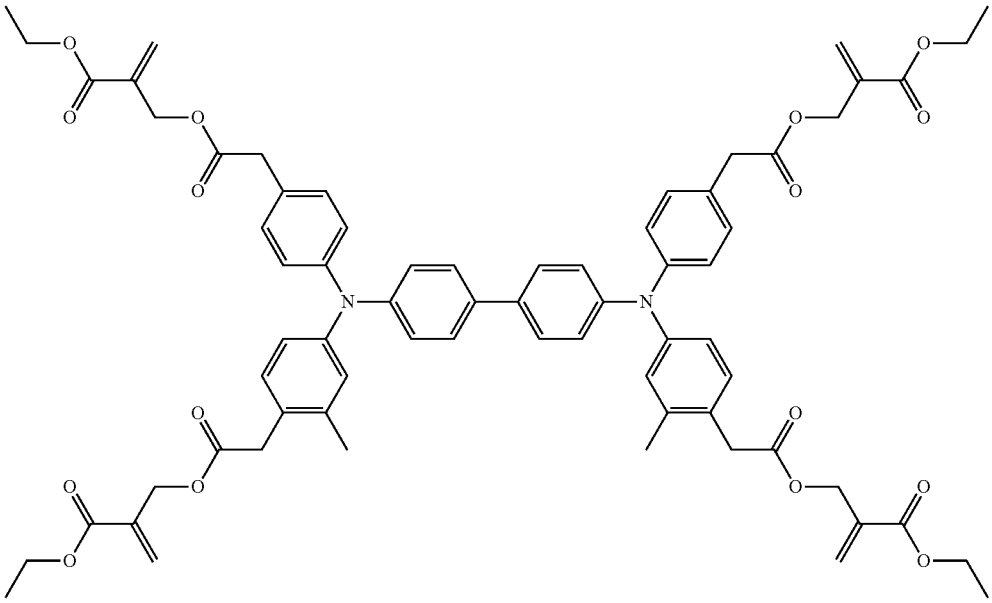 |
| iv-31 | 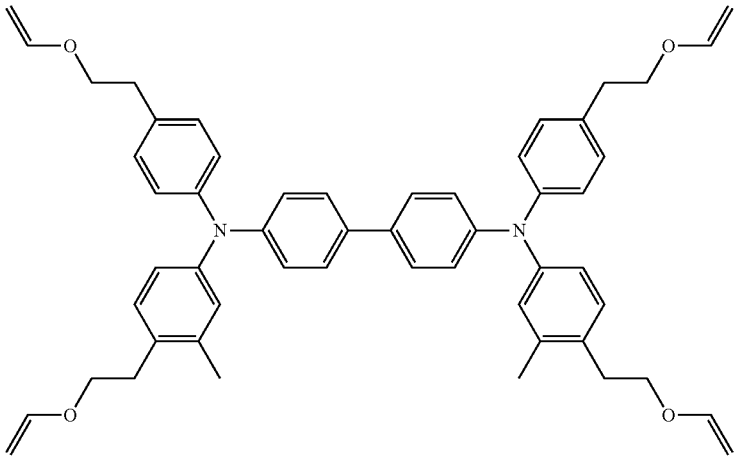 |

-continued
| No. | |
|---|---|
| iv-32 | 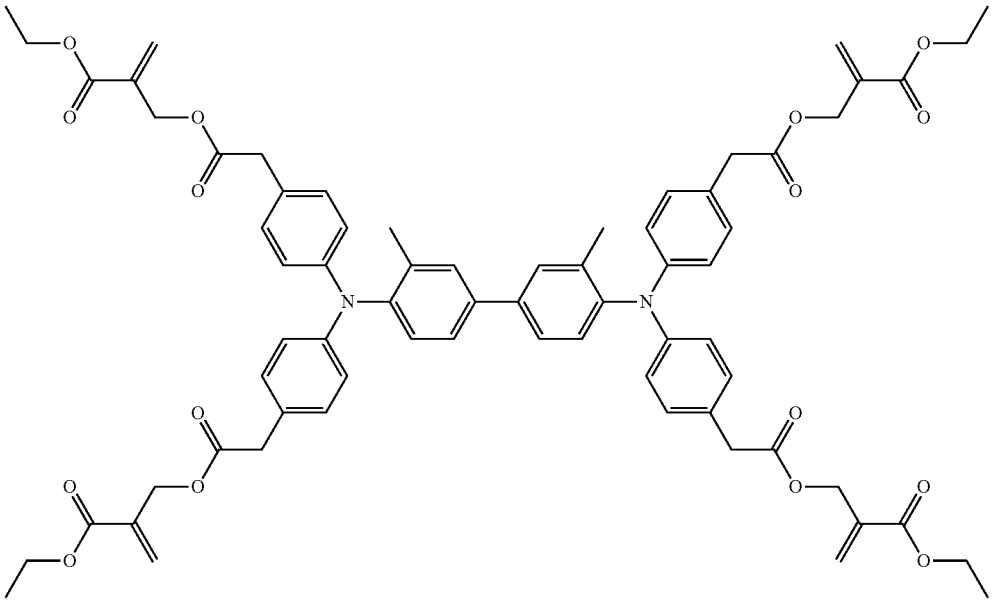 |
| iv-33 | 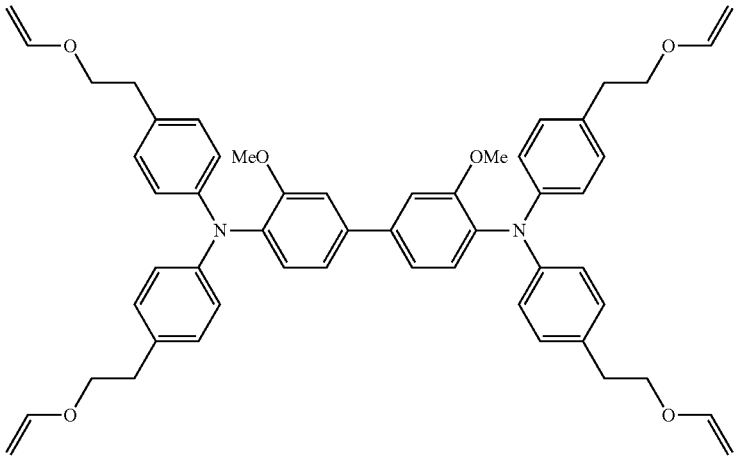 |

-continued
| No. | |
|---|---|
| iv-34 | 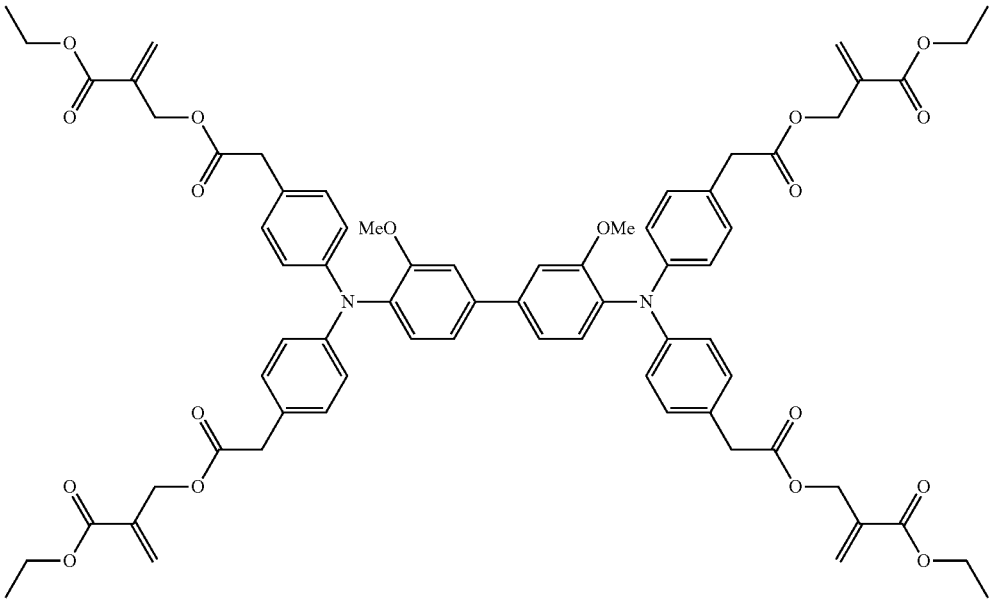 |
| iv-35 | 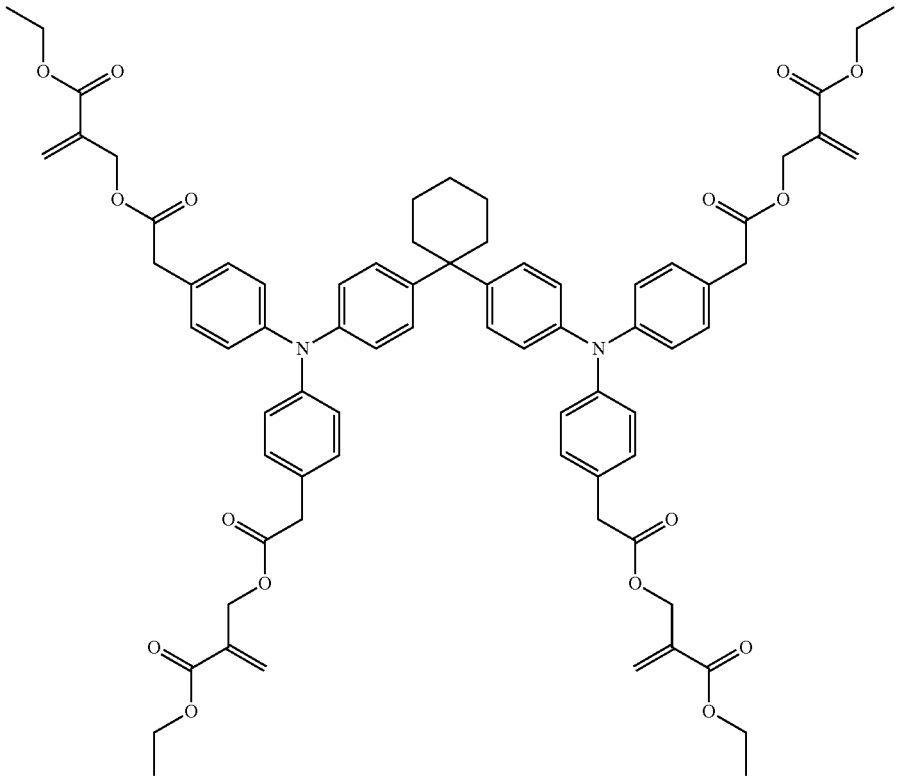 |

-continued
| No. | |
|---|---|
| iv-36 | 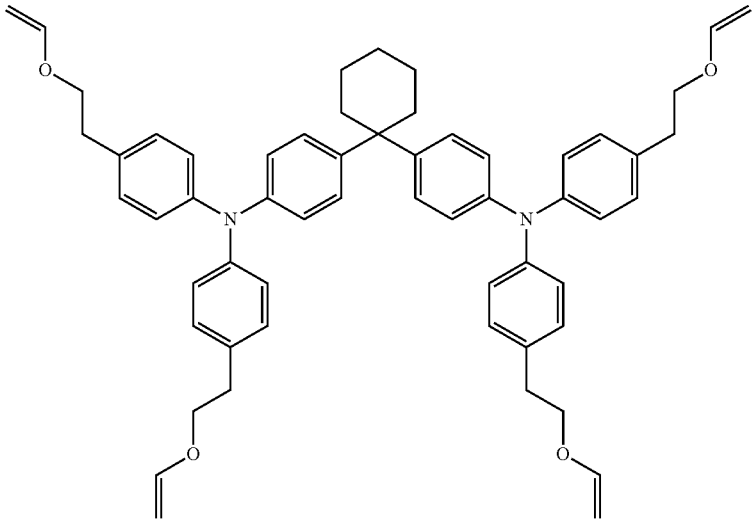 |
| iv-37 | 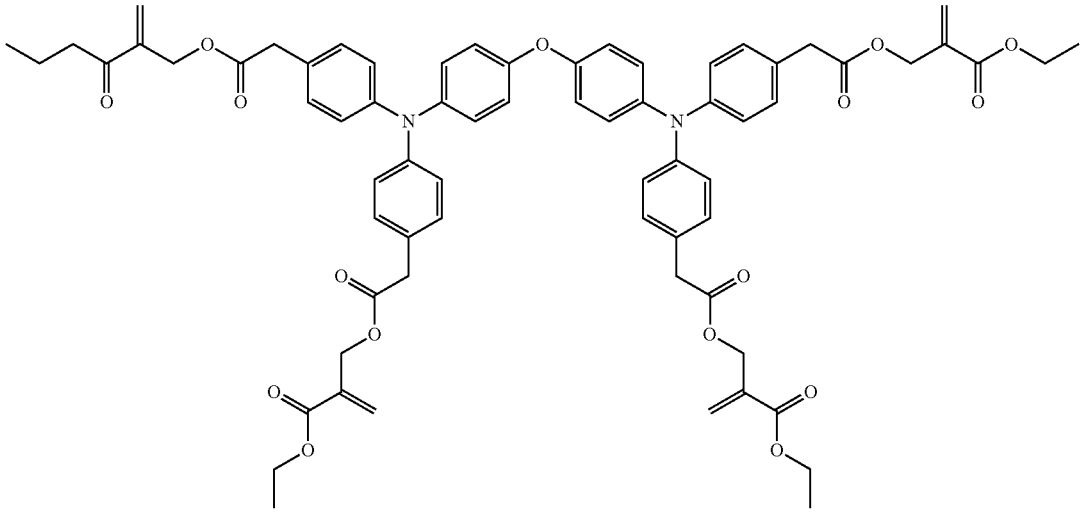 |

-continued
| No. | |
|---|---|
| iv-38 | 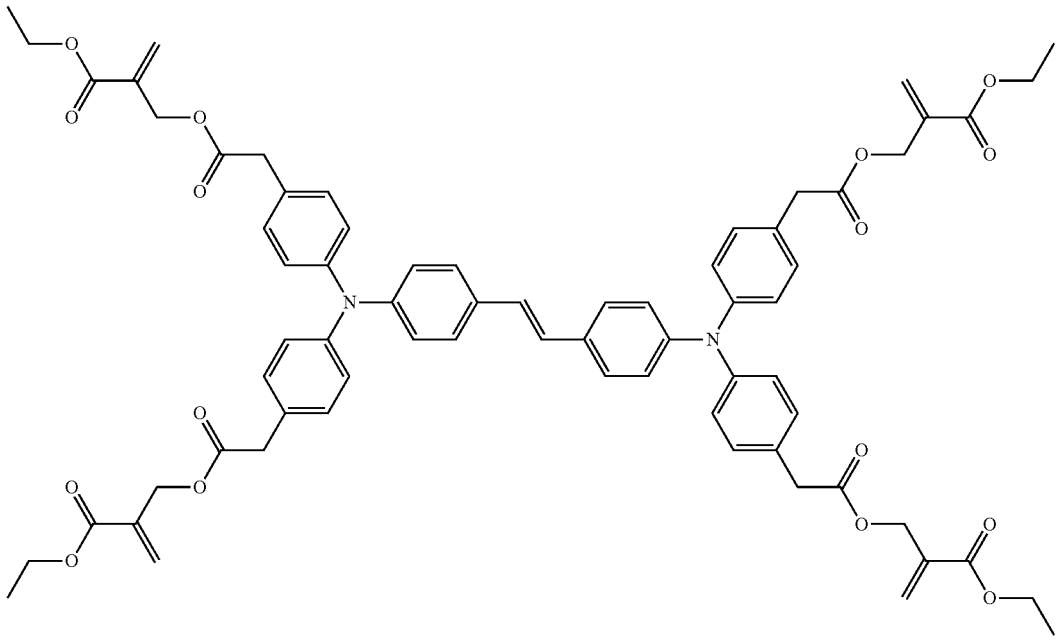 |
| iv-39 | 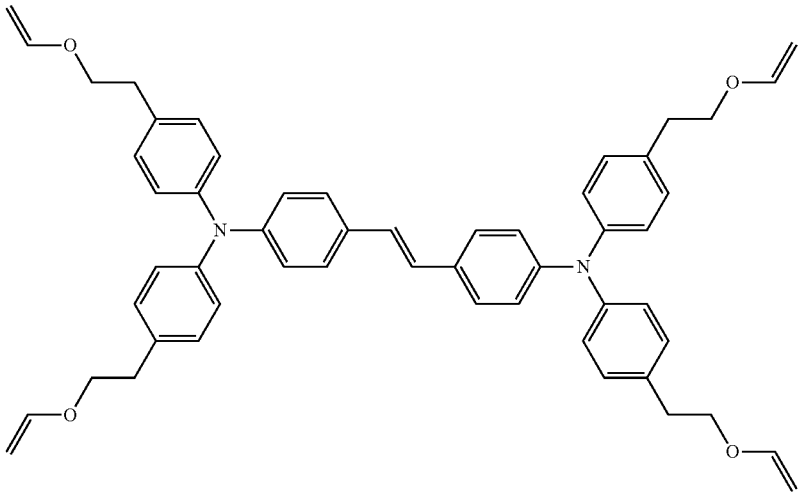 |

-continued
| No. | |
|---|---|
| iv-40 | 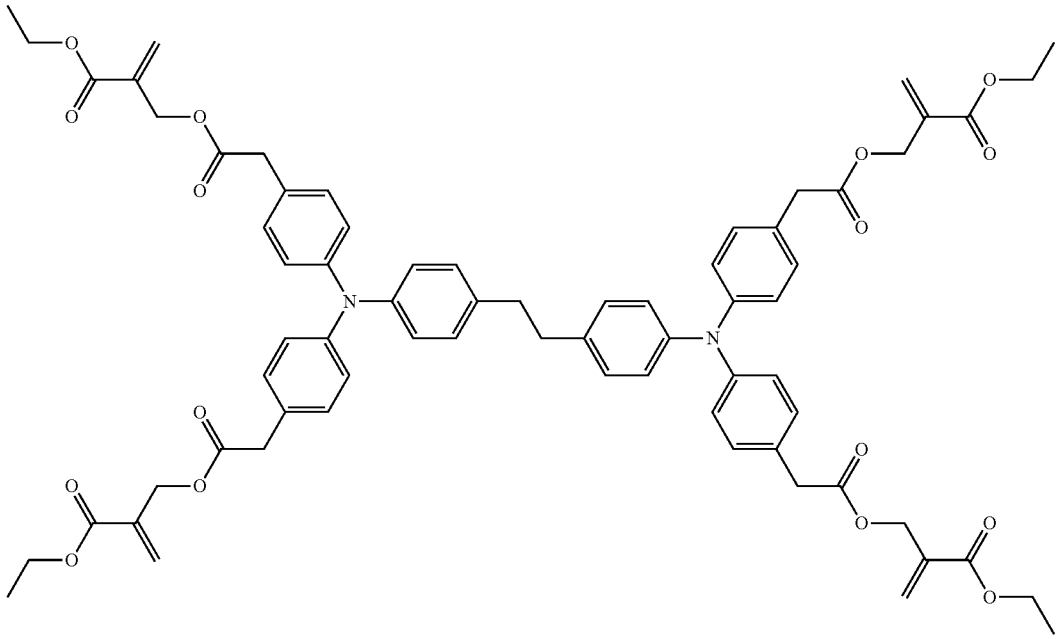 |
| iv-41 | 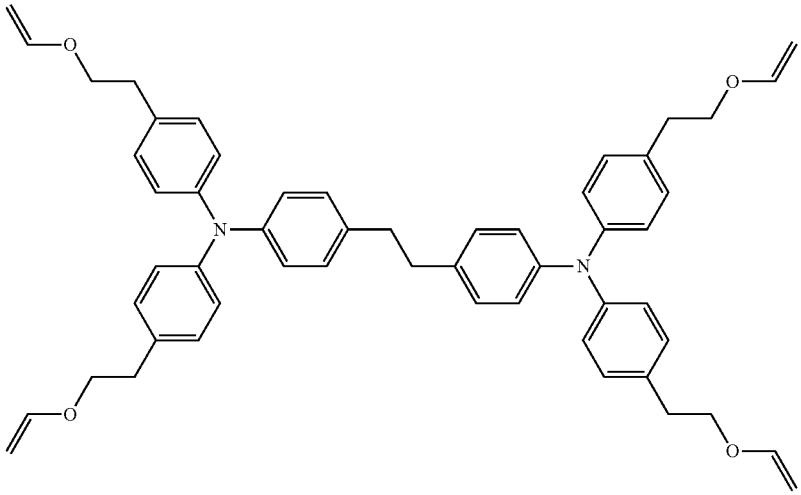 |

-continued
| No. | |
|---|---|
| iv-42 | 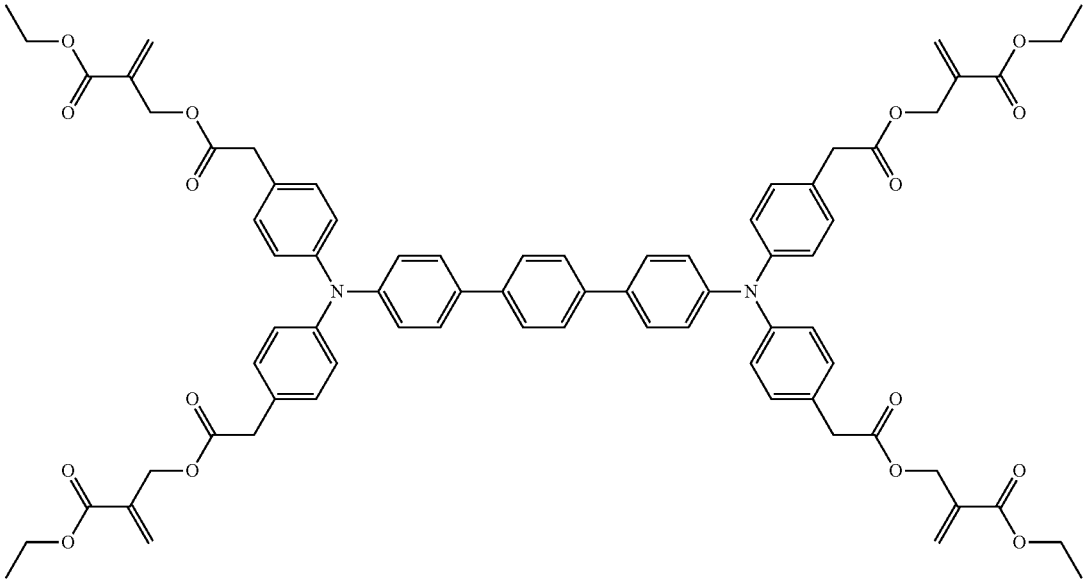 |
| iv-43 | 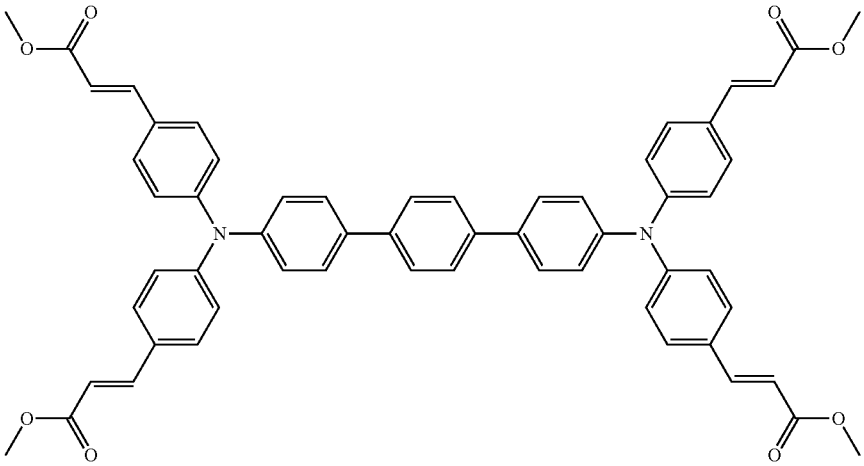 |
| iv-44 | 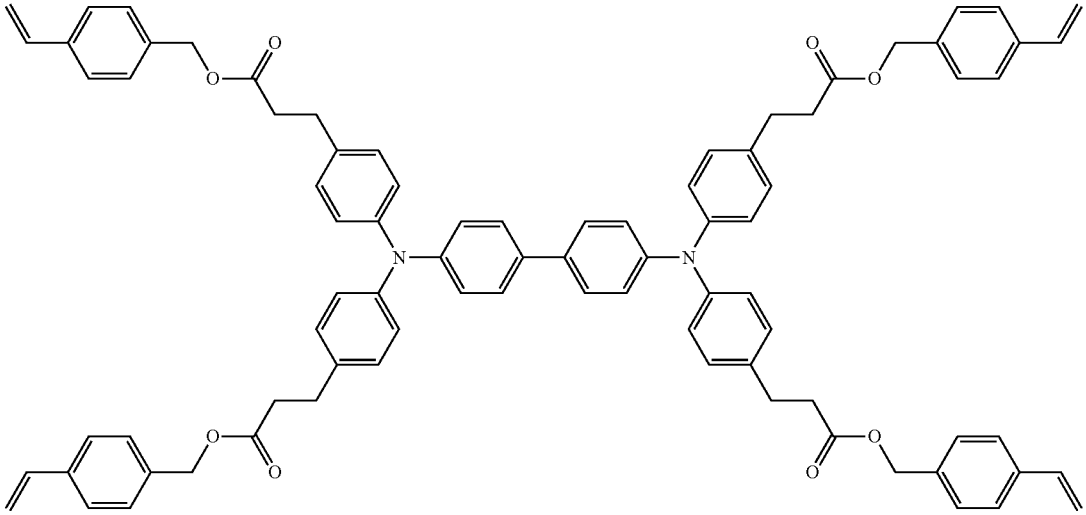 |

-continued
| No. | |
|---|---|
| iv-45 | 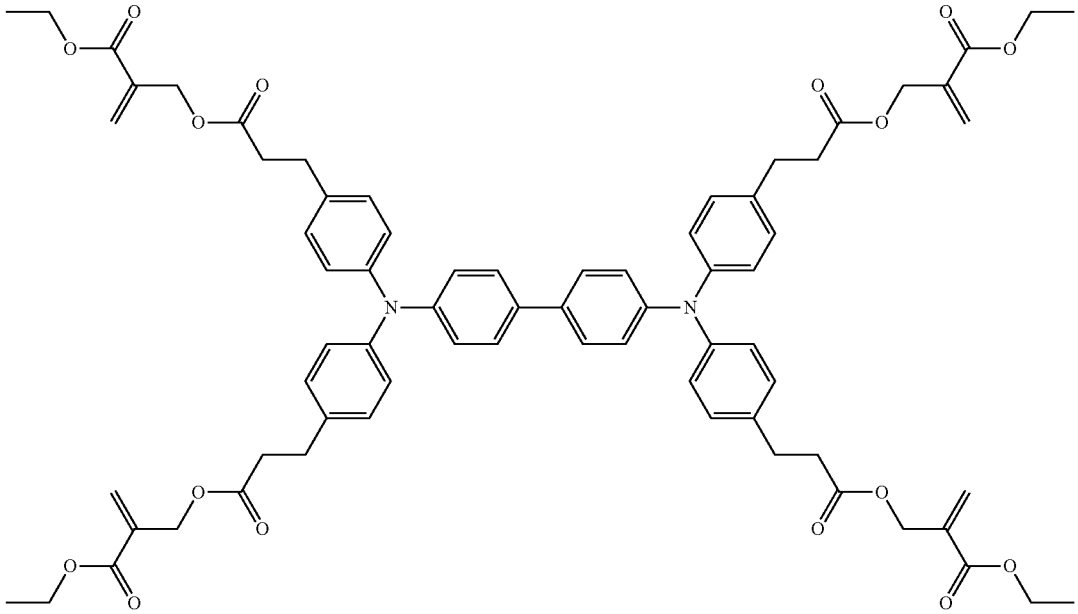 |
| iv-46 | 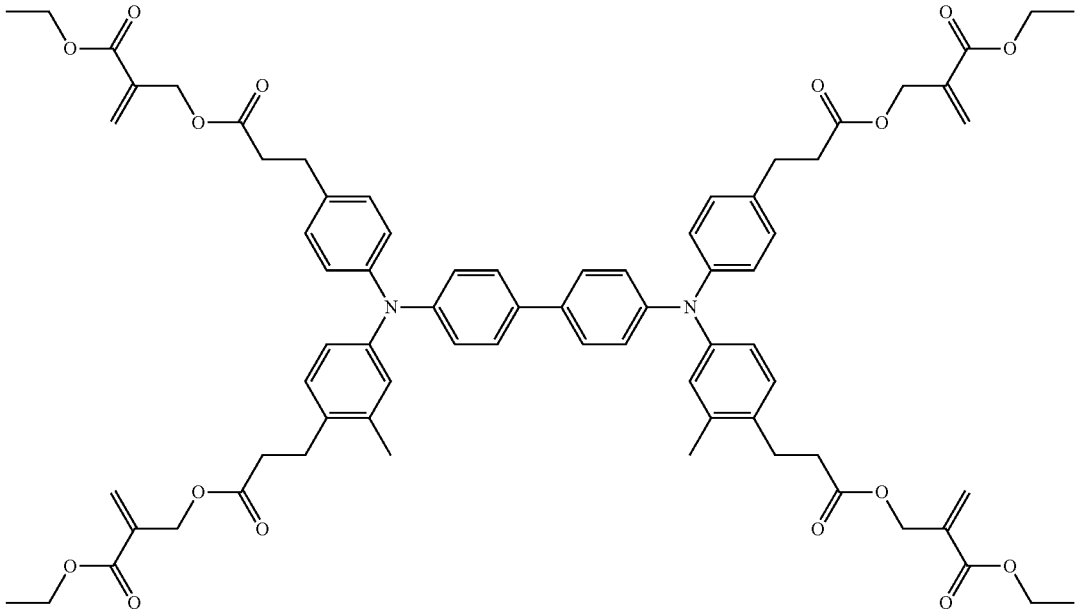 |

-continued
| No. | |
|---|---|
| iv-47 | 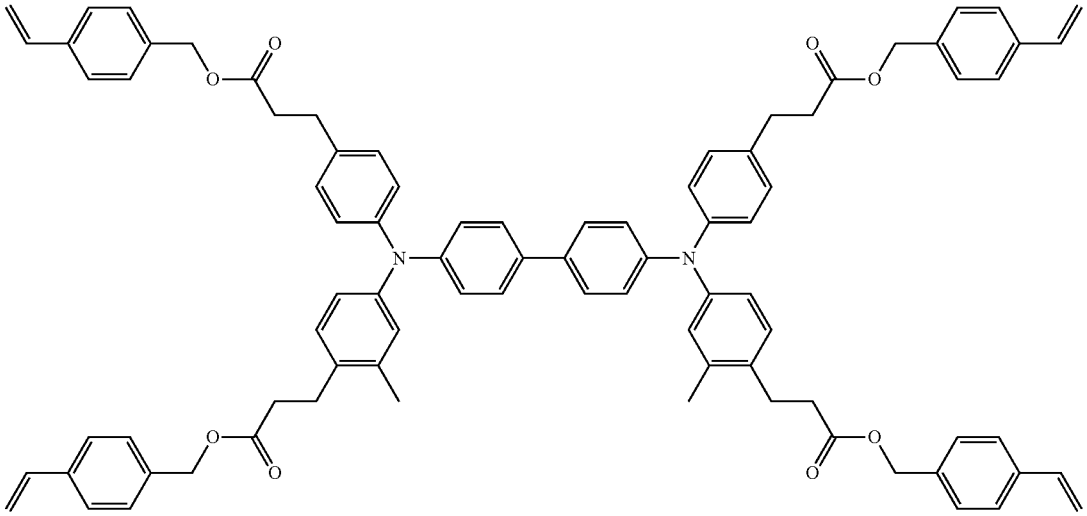 |
| iv-48 | 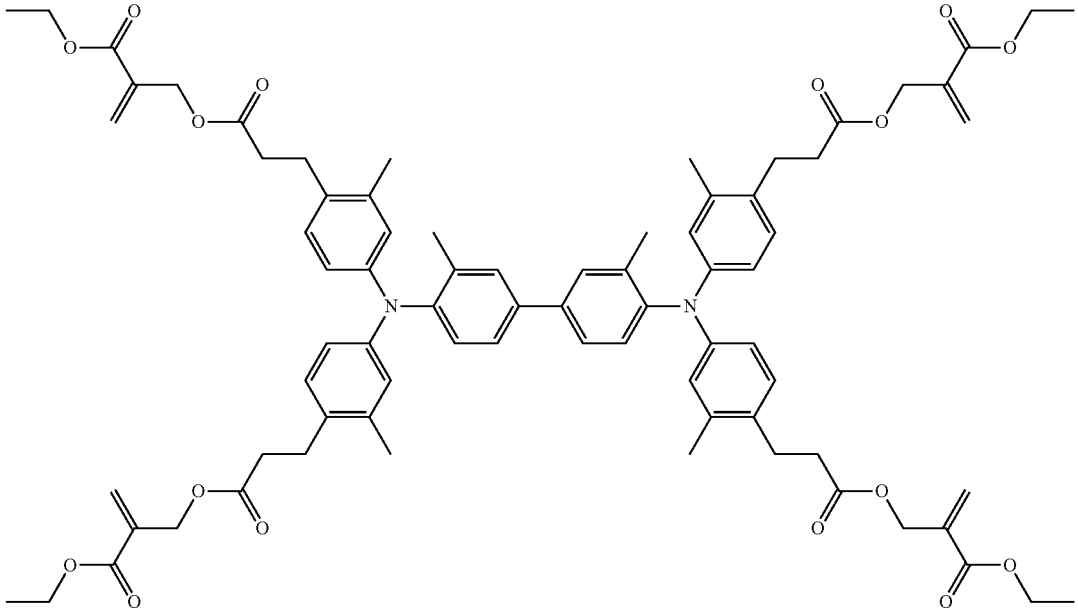 |

-continued
| No. | |
|---|---|
| iv-49 | 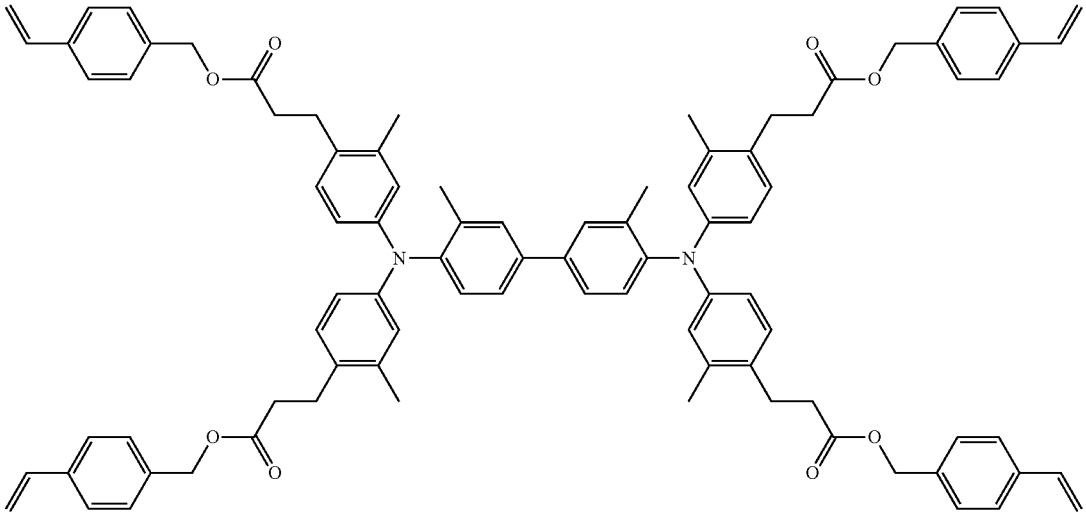 |
| v-2 | 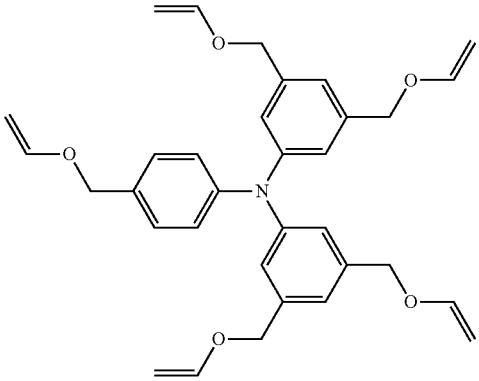 |
| v-3 | 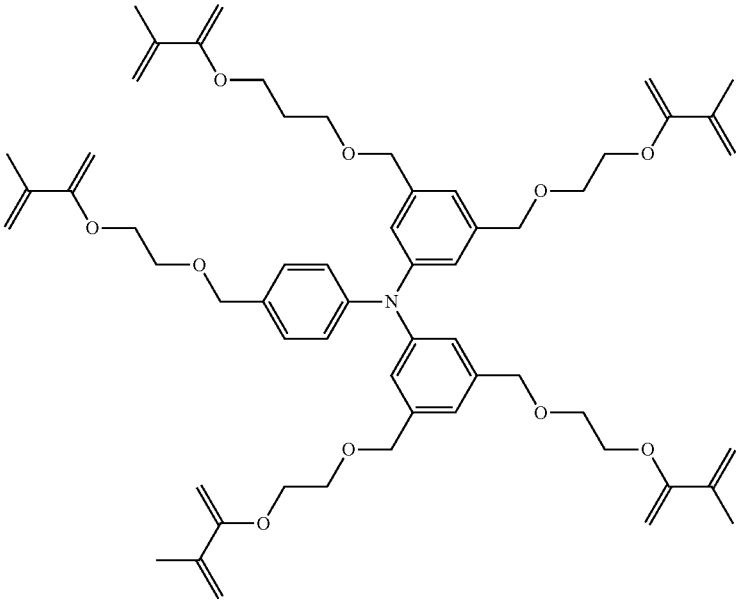 |

-continued
| No. | |
|---|---|
| vi-3 | 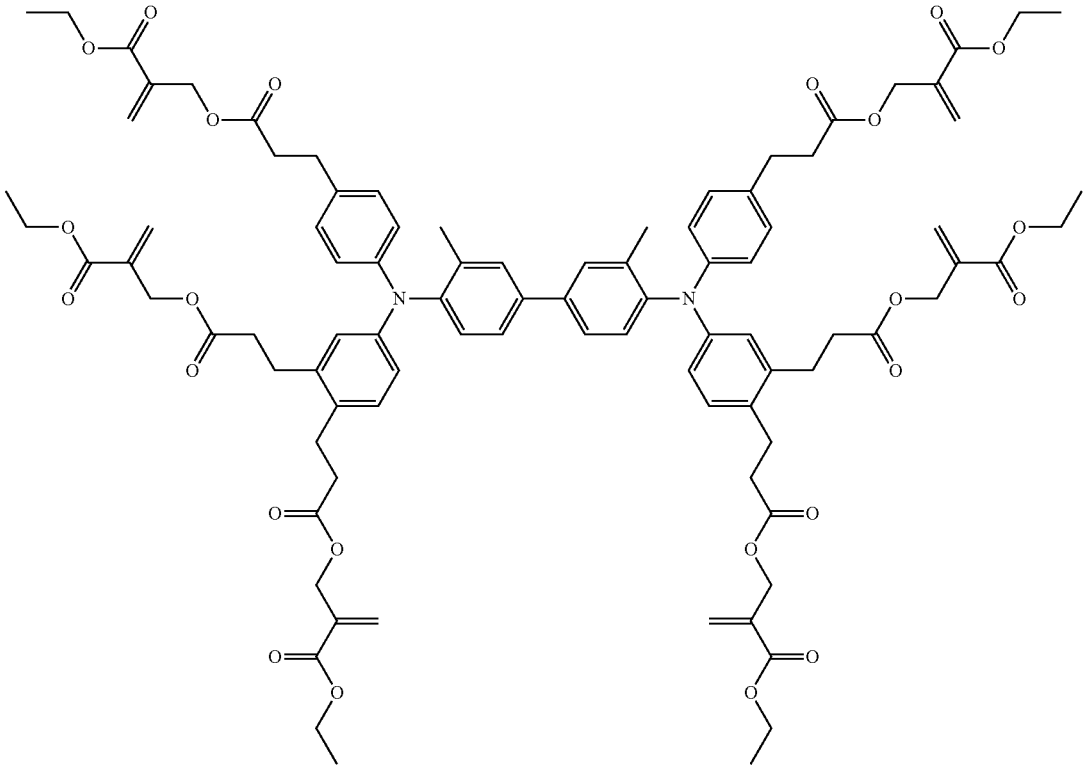 |
| vi-4 | 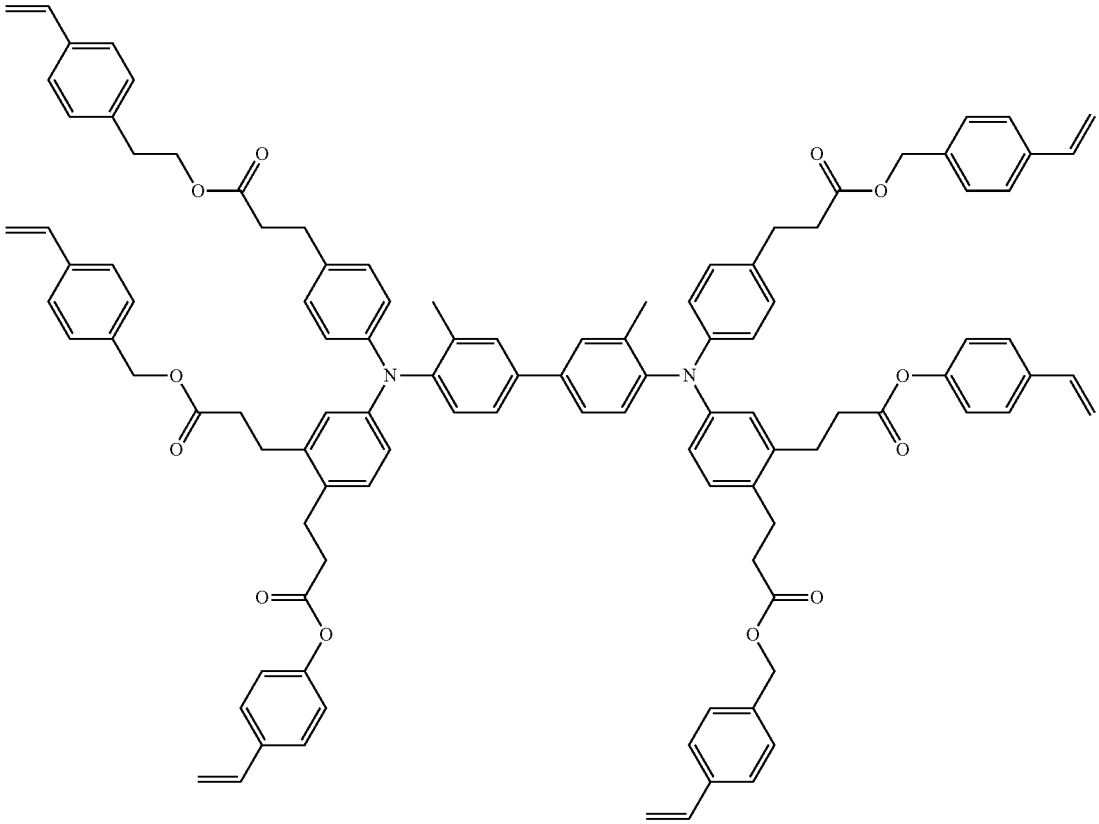 |

-continued
| No. | |
|---|---|
| vi-5 | 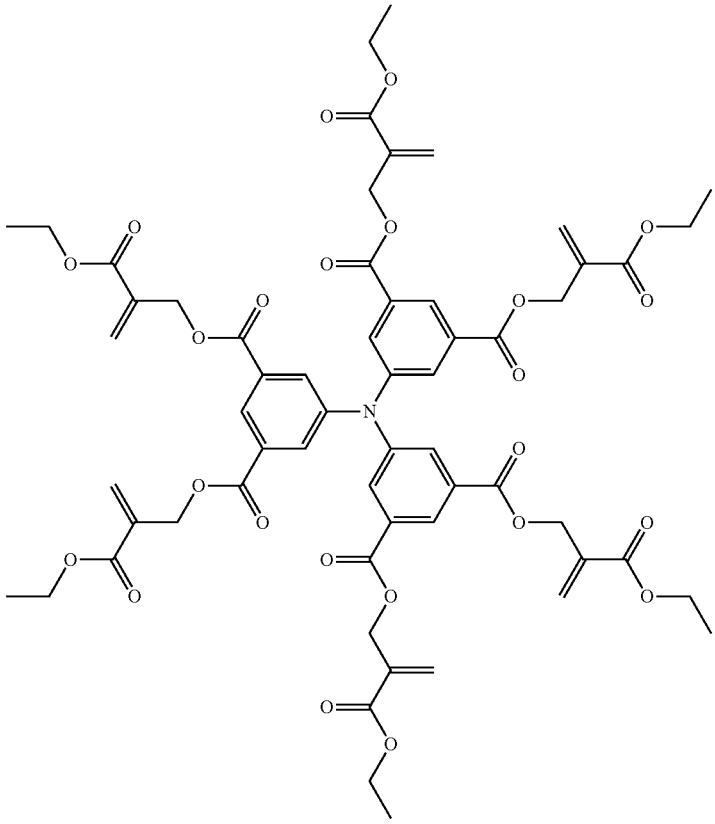 |
| vi-6 | 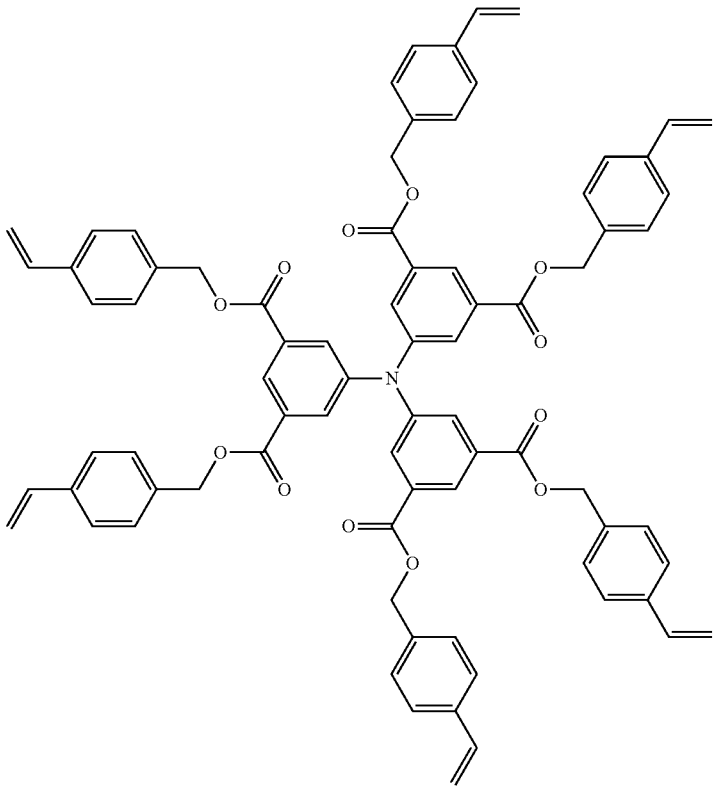 |

The total content of the charge transporting material having a chain polymerizable functional group and a charge-transportable skeleton in the molecule thereof is preferably 40% by weight or more, more preferably 50% by weight or more, and even more preferably 60% by weight or more, with respect to the composition used for the formation of the protective layer.

When the above range is satisfied, good electrical properties are achieved, and a cured film having a sufficient thickness can be made.

In the present exemplary embodiment, a charge transporting material having a chain polymerizable functional group and a charge-transportable skeleton in the molecule thereof may be used in combination with a known charge transporting material having no reactive group. The known charge transporting material having no reactive group has not any reactive group that does not play a role of charge transport, and therefore has an advantage in that a component concentration of the charge transporting material is increased and electric properties are further improved.

As the known charge transporting material, those materials recited as a charge transporting material that constitutes the aforementioned charge transport layer may be used.

Next, the polymerization initiator is explained.

Preferable examples of the polymerization initiator include heat radical initiators.

The cured film (crosslinked film) which constitutes the protective layer (outermost layer) is obtained by curing a composition including the above-mentioned component by various method such as heat, light or electron beam, and heat curing is preferable so as to balance the properties such as the electric properties and mechanical strength of the cured film. Generally, when a general acrylic paint or the like is cured, electron beam which enables the paint or the like to cure with no catalyst, or photopolymerization which enables the paint or the like to cure in a short period of time is preferably used. However, since the photosensitive layer of the electrophotographic photoreceptor which also functions as the outermost layer includes a photosensitive material, heat curing which enables a mild reaction to undergo is preferable so that the photosensitive material may be prevented from damage and the surface characteristic of the obtained cured film may be enhanced.

As the heat radical initiator, one having a 10 hour half-life temperature of from 40° C. to 110° C. is preferable in order to suppress the damage on the photosensitive material in the photosensitive layer during formation of the protective layer.

Examples of commercial products of the heat radical initiator may include azo-based initiators such as V-30 (10 hour half-life temperature: 104° C.), V-40 (the temperature: 88° C.), V-59 (the temperature: 67° C.), V-601 (the temperature: 66° C.), V-65 (the temperature: 51° C.), V-70 (the temperature: 30° C.), VF-096 (the temperature: 96° C.), VAM-110 (the temperature: 111° C.) and VAM-111 (the temperature: 111° C.) (trade names, all manufactured by Wako Pure Chemical Co., Ltd.), OTAZO 15 (the temperature: 61° C.), OTAZO 30, VE-73. AIBN (the temperature: 65° C.), AMBN (the temperature: 67° C.), ADVN (the temperature: 52° C.) and ACVA (the temperature: 68° C.) (trade names, all manufactured by Otsuka Chemical Co., Ltd.); PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT and PERBUTYL Z (trade names, all manufactured by NOF Corporation); KAYAKETAL AM-C55, TRIGONOX 36-C75, LAUROX, PERKADOX L-W75, PERKADOX CH-50L, TRIGONOX TMBH, KAYACUMENE H, KAYABUTYL H-70, PERKADOX BC-FF, KAYAHEXA AD, PERKADOX 14, KAYABUTYL C, KAYABUTYL D, KAYAHEXA YD-E85, PERKADOX 12-XL25, PERKADOX 12-EB20, TRIGONOX 22-N70, TRIGONOX 22-70E, TRIGONOX D-T50, TRIGONOX 423-C70, KAYAESTER CND-C70, KAYAESTER CND-W50, TRIGONOX 23-C70, TRIGONOX 23-W5ON, TRIGONOX 257-C70, KAYAESTER P-70, KAYAESTER TMPO-70, TRIGONOX 121, KAYAESTER O, KAYAESTER HTP-65W, KAYAESTER AN, TRIGONOX 42, TRIGONOX F-C50, KAYABUTYL B, KAYACARBON EH-C70, KAYACARBON EH-W60, KAYACARBON I-20, KAYACARBON BIC-75, TRIGONOX 117 and KAYALENE 6-70 (trade names, all manufactured by Kayaku Akzo Co., Ltd.); LUPEROX LP (10 hour half-life temperature: 64° C.), LUPEROX 610 (the temperature: 37° C.), LUPEROX 188 (the temperature: 38° C.), LUPEROX 844 (the temperature: 44° C.), LUPEROX 259 (the temperature: 46° C.), LUPEROX 10 (the temperature: 48° C.), LUPEROX 701 (the temperature: 53° C.), LUPEROX 11 (the temperature: 58° C.), LUPEROX 26 (the temperature: 77° C.), LUPEROX 80 (the temperature: 82° C.), LUPEROX 7 (the temperature: 102° C.), LUPEROX 270 (the temperature: 102° C.), LUPEROX P (the temperature: 104° C.), LUPEROX 546 (the temperature: 46° C.), LUPEROX 554 (the temperature: 55° C.), LUPEROX 575 (the temperature: 75° C.), LUPEROX TANPO (the temperature: 96° C.), LUPEROX 555 (the temperature: 100° C.), LUPEROX 570 (the temperature: 96° C.), LUPEROX TAP (the temperature: 100° C.), LUPEROX TBIC (the temperature: 99° C.), LUPEROX TBEC (the temperature: 100° C.), LUPEROX JW (the temperature: 100° C.), LUPEROX TAIC (the temperature: 96° C.), LUPEROX TAEC (the temperature: 99° C.), LUPEROX DC (the temperature: 117° C.), LUPEROX 101 (the temperature: 120° C.), LUPEROX F (the temperature: 116° C.), LUPEROX DI (the temperature: 129° C.), LUPEROX 130 (the temperature: 131° C.), LUPEROX 220 (the temperature: 107° C.), LUPEROX 230 (the temperature: 109° C.), LUPEROX 233 (the temperature: 114° C.) and LUPEROX 531 (the temperature: 93° C.) (trade names, all manufactured by Arkema Yoshitomi, Ltd.); IRGACURE 127, IRGACURE 184, IRGACURE 369 (trade names, all manufactured by Ciba Specialty Chemicals Inc.) and the like.

Of these, as the polymerization initiator, azo-based initiators having a weight average molecular weight of 160 or more (desirably from 160 to 1000, more desirably from 160 to 500) (azo compounds: among the above-mentioned commercial products, OTAZO 15, VE-73. AIBN and the like) are preferable in view of electric properties and film strength.

As the polymerization initiator, the following exemplary compounds are specifically preferable in view of electric properties and film strength.

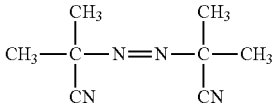

(AIBN)

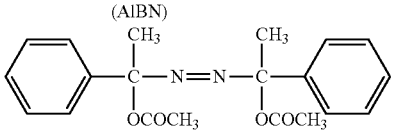

(OTazo15)

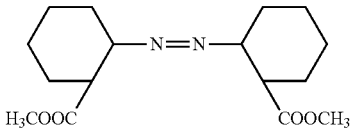

(VE-73)

The polymerization initiator is contained in an amount of, preferably from 0.001% by mass to 10% by mass, more preferably from 0.01% by mass to 5% by mass, and further preferably from 0.1% by mass to 3% by mass, with respect to the reactive compound in the composition.

Next, other additives to the composition used to form a protective layer are explained.

A radical polymerizable monomer, oligomer or the like, which does not have charge transportability, may be added to the composition used to form the protective layer, for the purpose of controlling viscosity of the composition, mechanical strength of a film, flexibility, smoothness and cleaning property.

Examples of the monofunctional radical polymerizable monomer include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyethyl acrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl o-phenylphenol acrylate, and o-phenylphenolglycidylether acrylate.

Examples of bifunctional radical polymerizable monomer include 1,4-butanediol diacrylate, 1,6-hexanediol diacrylate, 1,9-nonanediol diacrylate, 2-n-butyl-2-ethyl-1,3-propanediol diacrylate, tripropylene glycol diacrylate, tetraethylene glycol diacrylate, dioxane glycol diacrylate, polytetramethylene glycol diacrylate, ethoxylated bisphenol A diacrylate, ethoxylated bisphenol A dimethacrylate, tricyclodecanemethanol diacrylate and tricyclodecanemethanol dimethacrylate.

Examples of tri- or higher functional radical polymerizable monomer include trimethylolpropane triacrylate, trimethylolpropane trimethacrylate, pentaerythritol acrylate, trimethylolpropane EO-added triacrylate, glycerin PO-added triacrylate, trisacryloyloxyethyl phosphate, pentaerythritol tetraacrylate and ethoxylated isocyanuric acid triacrylate.

Examples of radical polymerizable oligomer include epoxy acrylate oligomers, urethane acrylate oligomers and polyester acrylate oligomers.

The radical polymerizable monomer or oligomer that does not have charge transportability is preferably contained in an amount of from 0% by weight to 50% by weight, more preferably from 0% by weight to 40% by weight and still more preferably from 0% by weight to 30% by weight, relative to the total solid content in the composition.

Furthermore, a polymer which does not react with the chain-polymerizable functional group in the compound having a chain-polymerizable functional group and a charge-transportable backbone in the molecule thereof may be added to the composition used for forming a protective layer for the purposes of discharging gas resistance, mechanical strength, scratch resistance, particle dispersibility, viscosity control, decreasing in torque, control of wear amount, extension of pot-life, and the like.

Examples of the polymer which does not react with the chain-polymerizable functional group may include those disclosed in Japanese Patent Application Laid-Open (JP-A) No. 5-216249, JP-A No. 5-323630, JP-A No. 11-52603, JP-A No. 2000-264961 and the like. Furthermore, examples of the polymer which cannot react may include known ones such as polycarbonate resins, polyester resins, polyarylate resins, methacrylic resins, acrylic resins, polyvinyl chloride resins, polyvinylidene chloride resins and polystyrene resins.

In the composition used to form the protective layer, another thermosetting resin such as a phenol resin, a melamine resin or a benzoguanamine resin may be added for the purpose of inhibiting excessive absorption of gas generated by discharge and thereby effectively suppressing oxidation caused by the generated gas.

Furthermore, in the composition used to form the protective layer, a coupling agent, a hardcoat agent or a fluorine-containing compound may be further added to adjust a film-forming property of a film, flexibility, lubricity, or adhesive property. Specific examples of the additive include various silane coupling agents and commercially available silicone hardcoat agents.

Examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, tetramethoxysilane, methyltrimethoxysilane, and dimethyldimethoxysilane.

Examples of the commercially available hardcoat agent include KP-85, X-40-9740 and X-8239 (trade name, all manufactured by Shin-Etsu Silicone Co., Ltd.) and AY42-440, AY42-441 and AY49-208 (trade name, all manufactured by Dow Corning Toray Co., Ltd.).

Furthermore, in order to impart water repelling property, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H, 1H, 2H, 2H-perfluoroalkyltriethoxysilane, 1H, 1H, 2H, 2H-perfluorodecyltriethoxysilane, or 1H, 1H, 2H, 2H-perfluorooctyltriethoxysilane may be added.

A silane coupling agent may be used at any amount. However, the amount by weight of a fluorine-containing compound is preferably set at 0.25 times or less as much as a compound that does not contain fluorine. Excessive amount may cause disadvantage in the film-forming property of a crosslinked film.

Furthermore, in the composition used to form the protective layer, a thermoplastic resin may be added in order to improve discharge gas resistance, mechanical strength and scratch resistance, and further in order to reduce torque, to control a wear amount, to extend a pot-life and to control dispersibility of particles and viscosity in the protective layer respectively.

Examples of the thermoplastic resin include a polyvinyl acetal resin such as a polyvinyl butyral resin, a polyvinyl formal resin, or a partially acetalized polyvinyl acetal resin in which butyral is partially modified with formal or acetoacetal (for example, S-LEC B, K (trade name, manufactured by Sekisui Chemical Co., Ltd.)), a polyamide resin, a cellulose resin, and a polyvinyl phenol resin. A polyvinyl acetal resin and a polyvinyl phenol resin are preferred in view of electric characteristics. A weight average molecular weight of the resin is preferably from 2000 to 100,000 and more preferably from 5,000 to 50,000. When the molecular weight of the resin is less than 2,000, an addition effect of the resin tends to be insufficient. On the other hand, when the molecular weight of the resin exceeds 100,000, the solubility is lowered to tend to result in limiting an addition amount and causing film-forming defect during coating. An addition amount of the resin is preferably from 1% by weight to 40% by weight, more preferably from 1% by weight to 30% by weight and still more preferably from 5% by weight to 20% by weight. When the addition amount of the resin is less than 1% by weight, an addition effect of the resin tends to be insufficient. On the other hand, when the addition amount thereof exceeds 40% by weight, image blurring tends to occur under a high temperature and high humidity (for example, 28° C., 85% RH) environment.

Furthermore, in the composition used to form the protective layer, various particles may be added in order to reduce a residual potential or to improve mechanical strength of the protective layer.

Examples of the particles include silicon-containing particles. The silicon-containing particles are those containing silicon as a constituent element, and, specifically, colloidal silica and silicone particles are exemplified. Colloidal silica used as a silicon-containing particle is selected from acidic or alkaline aqueous dispersion, and organic solvent (such as alcohol, ketone or ester) dispersions containing colloidal silica having an average particle diameter of from 1 nm to 100 nm and preferably from 10 nm to 30 mn. Commercially available colloidal silica may be used. A solid content of colloidal silica in the protective layer is not particularly restricted. However, the solid content of colloidal silica relative to the total solid content in the protective layer is used in the range of from 0.1% by weight to 50% by weight and preferably in the range of from 0.1% by weight to 30% by weight, from the viewpoints of film-forming property, electric characteristics and mechanical strength.

A silicone particle that is used as a silicon-containing particle is selected from a silicone resin particle, a silicone rubber particle and a silica particle surface treated with silicone, and commercially available silicone particles are generally used. The silicone particle is spherically formed and an average particle diameter thereof is preferably from 1 nm to 500 nm and more preferably from 10 nm to 100 nm. The silicone particle is a fine particle that is chemically inactive, excellent in the dispersibility in a resin and low in content necessary to obtain sufficient characteristics; accordingly, a surface property of an electrophotographic photoreceptor is improved without disturbing a crosslinking reaction. That is, in a state where silicone particles are introduced in a rigid crosslinking structure without causing fluctuation, lubricity and water repellency of a surface of an electrophotographic photoreceptor are improved and thereby excellent wear resistance and contamination attachment resistance are maintained over a long period of time.

The content of silicone particles in the protective layer is preferably from 0.1% by weight to 30% by weight and more preferably from 0.5% by weight to 10% by weight, relative to the total solid content in the protective layer.

Examples of other particle include fluorine-based particles of tetrafluoroethylene, trifluoroethylene, hexafluoropropylene, vinyl fluoride, or vinylidene fluoride; particles made of resins obtained by copolymerizing a fluororesin and a monomer having a hydroxy group as descrubed in "Preprints of the 8th Polymer Material Forum, p. 89"; and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO or MgO. Furthermore, oil such as silicone oil may be added for the same purpose. Examples of silicone oil include silicone oil such as dimethylpolysiloxane, diphenylpolysiloxane, or phenylmethylsiloxane; reactive silicone oil such as amino-modified polysiloxane, epoxy-modified polysiloxane, carboxyl-modified polysiloxane, carbinol-modified polysiloxane, methacryl-modified polysiloxane, mercapto-modified polysiloxane, or phenol-modified polysiloxane; cyclic dimethylcyclosiloxanes such as hexamethylcyclotrisiloxane, octamethylcyclotetrasiloxane, decamethylcyclopentasiloxane or dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane or 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as a methylhydrosiloxane mixture, pentamethylcyclopentasiloxane or phenylhydrocyclosiloxane; and vinyl group-containing cyclosiloxanes such as pentavinylpentamethylcyclopentasiloxane.

In the composition used to form the protective layer, metal, metal oxide, carbon black or the like may be added. Examples of the metal include aluminum, zinc, copper, chromium, nickel, silver and stainless steel are cited, and plastic particles on a surface of which any of these metals is deposited. Examples of the metal oxide include zinc oxide, titanium oxide, tin oxide, antimony oxide, indium oxide, bismuth oxide, tin-doped indium oxide, antimony or tantalum-doped tin oxide and antimony-doped zirconium oxide. These may be used alone or in a combination of at least two of them. When at least two of them are used in combination, any one of a simple mixture, a solid solution thereof and a fused metal oxide may be used. An average particle diameter of conductive particles is preferably 0.3 μm or less and particularly preferably 0.1 μm or less from the viewpoint of transparency of a protective layer.

The composition used to form the protective layer is preferably prepared as a coating solution for forming the protective layer. The coating solution for forming the protective layer may be free from a solvent or may contain, as required, a solvent such as alcohols such as methanol, ethanol, propanol, butanol, cyclopentanol or cyclohexanol; ketones such as acetone or methyl ethyl ketone; or ethers such as tetrahydrofuran, diethyl ether or dioxane.

These solvents may be used alone or in a mixture of at least two of them and preferably have a boiling temperature of 100° C. or less. As the solvent, at least one of solvents having a hydroxyl group (for example, alcohols) is preferably used.

Next, the method for forming the protective layer is explained.

First, the coating liquid for forming the protective layer composed of the above-mentioned composition is applied on the charge transport layer by a general method such as blade coating method, wire bar coating method, spray coating method, immerse coating method, bead coating method, air knife coating method and curtain coating method.

The coating is then dried at from 20° C. to 150° C. for from 1 minute to 2 hours if necessary, and thereafter cured at, for example, a temperature of from 100° C. to 170° C. to give a cured film. Consequently, the protective layer composed of this cured film (outermost layer) is obtained. During the heat curing, a radical is generated from the polymerization initiator, and the radical causes the polymerization reaction (chain polymerization reaction) of the chain-polymerizable functional group.

The above-mentioned heat curing is preferably carried out under a vacuum or inactivated gas atmosphere (for example, under an atmosphere in which the oxygen concentration is 5% or less (desirably 2% or less)) so that the radical generated from the polymerization initiator may contribute to the polymerization reaction (chain polymerization reaction) of the chain-polymerizable functional group without deactivation thereof.

In this way, the protective layer composed of the cured film of the above-mentioned composition is formed.

In the protective layer composed of the cured film of the above-mentioned composition, the reaction ratio of the chain-polymerizable functional group (for example, an acryloyl group, a methacryloyl group, a styrene group, or derivatives thereof) is 60% or more (preferably from 70% to 100%, more preferably from 80% to 95%). By adjusting the reaction ratio to the above-mentioned range, the electric properties and film strength are improved.

The reaction ratio is calculated by the residual amount of the chain-polymerizable functional group in the film. Furthermore, the residual amount of the chain-polymerizable functional group is obtained by the infrared absorbance of the chain-polymerizable functional group.

For details, the reaction ratio is calculated by the following procedures.

1) A coating liquid for forming the cured film is applied on a silicone wafer by spin coating method. The liquid is dried in vacua at temperature of from 25 to 80° C. to prepare a pre-reaction sample. The film thickness of the pre-reaction sample is adjusted to 10 μm.

2) A pre-reaction sample is prepared in the same manner as 1), and a heat curing treatment of the sample is performed under the same condition as that for the production of the electrophotographic photoreceptor to prepare a post-reaction sample.

3) The infrared absorbance spectrum of each of the pre-reaction sample and the post-reaction sample is measured. The area of the peak at 1640 $cm^{-1}$ derived from the C═C bond of the chain polymerizable functional group and the area of the peak at 1600 $cm^{-1}$ derived from the C═C bond of the aromatic ring of each sample are obtained, and the reaction ratio is calculated according to the following equation.

For the measurement of the infrared absorbance spectra, FT/IR-6100 (trade name, manufactured by JASCO) was used.

Reaction rate=(Peak area at 1640 $cm^{-1}$ after reaction)/(Peak area at 1600 $cm^{-1}$ after reaction)/(Peak area at 1640 $cm^{-1}$ before reaction)/(Peak area at 1600 $cm^{-1}$ before reaction)×100

As an electrophotographic photoreceptor, an example of a function separation type has been described above. The content of the charge generating material in a single layer photosensitive layer 6 (charge generating/charge transport layer) is from 10% by weight to 85% by weight, or from about 10% by weight to about 85% by weight, and preferably from 20% by weight to 50% by weight. Content of a charge transporting material is preferably from 5% by weight to 50% by weight. A method for forming the monolayer type photosensitive layer 6 (charge generating/charge transport layer) is conducted in the same manner as in the method for forming the charge generating layer 2 and the charge transport layer 3. A film thickness of the monolayer type photosensitive layer (charge generating/charge transport layer) 6 is set at preferably substantially from 5 μm to 50 μm, or from about 5 μm to about 50 μm, and more preferably from 10 μm to 40 μm.

In the foregoing exemplary embodiment, a form where the outermost surface layer made of a cured material of the specific composition is a protective layer has been described. However, in the case of a layer structure where a protective layer is not formed, a charge transport layer locating at the outermost surface in the layer structure is the outermost surface layer.

Image Forming Apparatus/Process Cartridge

Figure 4:
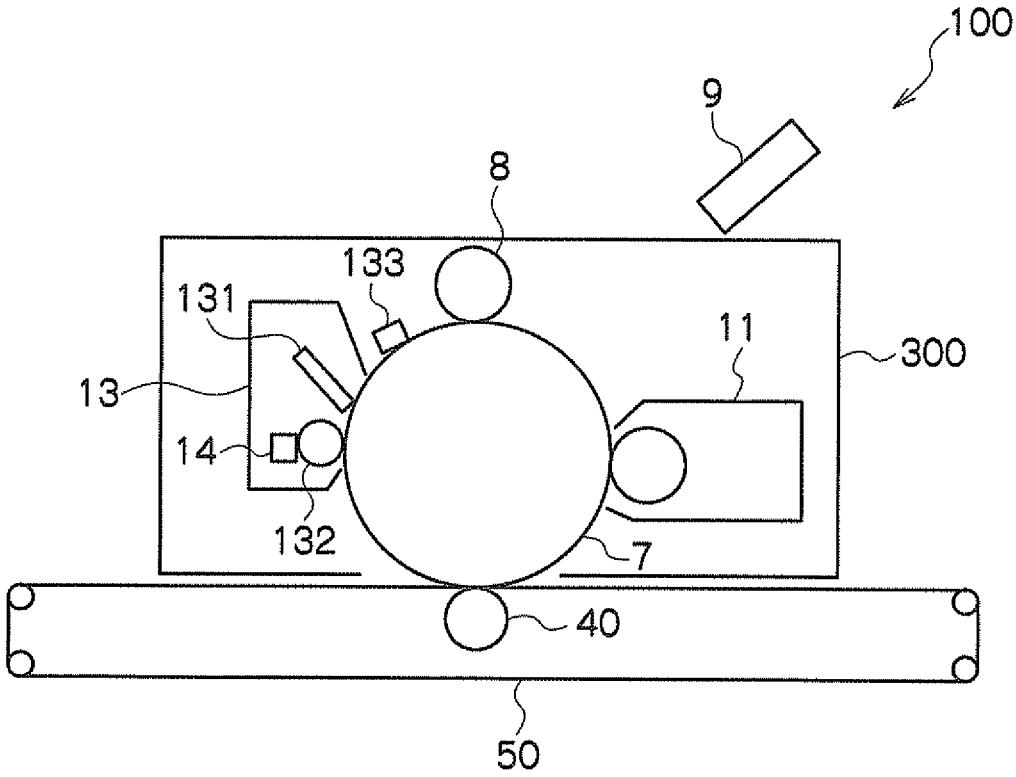
FIG. 4 is a schematic view showing an image forming apparatus according to an exemplary embodiment of the invention.

FIG. 4 is a schematic configuration diagram showing an image forming apparatus 100 involved in the exemplary embodiment of the invention.

The image forming apparatus 100 shown in FIG. 4 includes: a process cartridge 300 provided with an electrophotographic photoreceptor 7; an exposing apparatus (electrostatic latent image forming unit) 9; a transfer apparatus (transfer unit) 40; and an intermediate transfer medium 50. In the image forming apparatus 100, the exposing apparatus 9 is disposed at a position capable of exposing the electrophotographic photoreceptor 7 from an opening of the process cartridge 300, the transfer apparatus 40 is disposed at a position facing the electrophotographic photoreceptor 7 via the intermediate transfer medium 50, and the intermediate transfer medium 50 is disposed partially in contact with the electrophotographic photoreceptor 7.

The process cartridge 300 in FIG. 4 integrally supports the electrophotographic photoreceptor 7, a charging apparatus (charging unit) 8, a developing apparatus (developing unit) 11 and a cleaning apparatus 13 in a housing. The cleaning apparatus 13 includes a cleaning blade (cleaning member), and the cleaning blade 131 is disposed so as to come into contact with a surface of the electrophotographic photoreceptor 7.

In FIG. 4, an example where, as the cleaning apparatus 13, a fibrous member 132 (roll) for supplying a lubricant 14 on a surface of the photoreceptor 7 is provided and a fibrous member 133 (planar brush) for assisting cleaning is used is shown. However, these may be used as required.

As the charging apparatus 8, a contact charging device that uses, for example, a conductive or semiconductive charging roller, charging brush, charging film, charging rubber blade or charging tube is used. A known charging device such as a non-contact roller charging device, Scorotron corona charger or Corotron corona charger that makes use of corona discharge may be used as well.

Though not shown in the drawing, a photoreceptor heating member for elevating a temperature of the electrophotographic photoreceptor 7 to reduce a relative temperature may be disposed around the electrophotographic photoreceptor 7 to enhance stability of an image.

As the exposing apparatus 9, an optical device for desirably image-wise exposing light of semiconductor laser beam, LED light or liquid crystal shutter light on a surface of the photoreceptor 7 is exemplified. A wavelength of a light source, which is in a spectral sensitivity range of a photoreceptor, is used. As a wavelength of a semiconductor laser, near-infrared having an oscillation wavelength in the proximity of 780 nm is mainly used. However, without restricting to the wavelength, a laser having an oscillation wavelength of 600 something nm or a laser having an oscillation wavelength in the vicinity of from 400 nm to 450 nm as a blue laser may be used. Furthermore, when a color image is formed, a surface-emitting laser light source capable of outputting multi-beams as well is effective.

As the developing apparatus 11, a general developing apparatus where, for example, a magnetic or nonmagnetic single component developing agent or two-component developing agent is used in contact or without contact to develop may be used. The developing apparatus is selected in accordance with the object as long as the foregoing functions are possessed. For example, a known developing device where the single component or two-component developing agent is attached to a photoreceptor 7 by use of a brush or a roller is cited. Among these, a developing roller retaining a developing agent on a surface thereof is preferably used.

Hereinafter, a toner that is used in the developing apparatus 11 is described.

The developing agent may be a single component developing agent composed of a toner, or two-component developing agent including a toner and a carrier.

The toner is composed of, for example, toner particles containing a binder resin, a coloring agent, and other optional additives such as a release agent, and external additives as necessary.

The average shape factor of the toner particles (number average shape factor, the shape factor being expressed by $(ML^2/A)\times(\pi/4)\times100$, wherein ML represents the maximum particle length, and A represents the projected area of a particle) is preferably from 100 to 150, more preferably from 105 to 145, and even more preferably from 110 to 140. The volume average particle size of the toner is preferably from 3 μm to 12 μm, more preferably from 3.5 μm to 10 μm, and even more preferably from 4 μm to 9 μm.

A toner is not particularly restricted by the production method thereof. A toner that is produced according to, for example, a kneading and crashing method in which a binder resin, a colorant, a release agent and, as required, a charge controlling agent are added, followed by kneading, crashing and classifying; a method in which particles obtained according to the kneading and crashing method are changed in shape by mechanical impact or thermal energy; an emulsion-polymerization-condensation method in which a polymerizable monomer for obtaining a binder resin is emulsion-polymerized, and the resulting dispersion liquid, a colorant and a release agent and, as required, a dispersion liquid of a charge controlling agent are mixed, followed by condensation, heating and fusing to obtain a toner; a suspension polymerization method in which a polymerizable monomer for obtaining a binder resin, a colorant and a release agent, and as required, a solution of a charge controlling agent are suspended in an aqueous solvent to polymerize; or a dissolution suspension method in which a binder resin, a colorant and a release agent and, as required, a solution of a charge controlling agent are suspended in an aqueous solvent to granulate, is used.

Furthermore, a known production method such as a method in which the toner obtained by the foregoing method is used as a core, and flocculating particles are further attached thereto, followed by heating and fusing to form a core-shell structure may be used. As a method for producing a toner, a suspension polymerization method, an emulsion-polymerization-condensation method and a dissolution suspension method, in all of which an aqueous solvent is used to produce, are preferable from the viewpoints of shape control and particle size distribution control, and an emulsion-polymerization-condensation method is particularly preferred.

The toner is produced by mixing the toner particles with the external additives using, for example, a Henschel mixer or a V blender. When the toner particles are produced in a wet process, the external additives may be added in a wet process.

When the toner is used as a 2-component developer, the mixing ratio of the toner to the carrier is set at a well-known ratio. The carrier is not particularly limited, but preferred examples thereof include magnetic particles the surface of which is coated with a resin.

As the transfer apparatus 40, a known charging device such as a contact transfer charging device that uses, for example, a belt, a roller, a film or a rubber blade; or a Scorotron corona charger or Corotron corona charger using corona discharge may be used as well.

As the intermediate transfer medium 50, a belt (intermediate transfer belt) made of semiconductive polyimide, polyamideimide, polycarbonate, polyarylate, polyester, rubber or the like may be used. As a form of the intermediate transfer medium 50, a drum may be used in addition to a belt.

The image fowling apparatus 100 may have, in addition to the above respective apparatuses, for example, an optical eraser that optically erases the photoreceptor 7.

Figure 5:
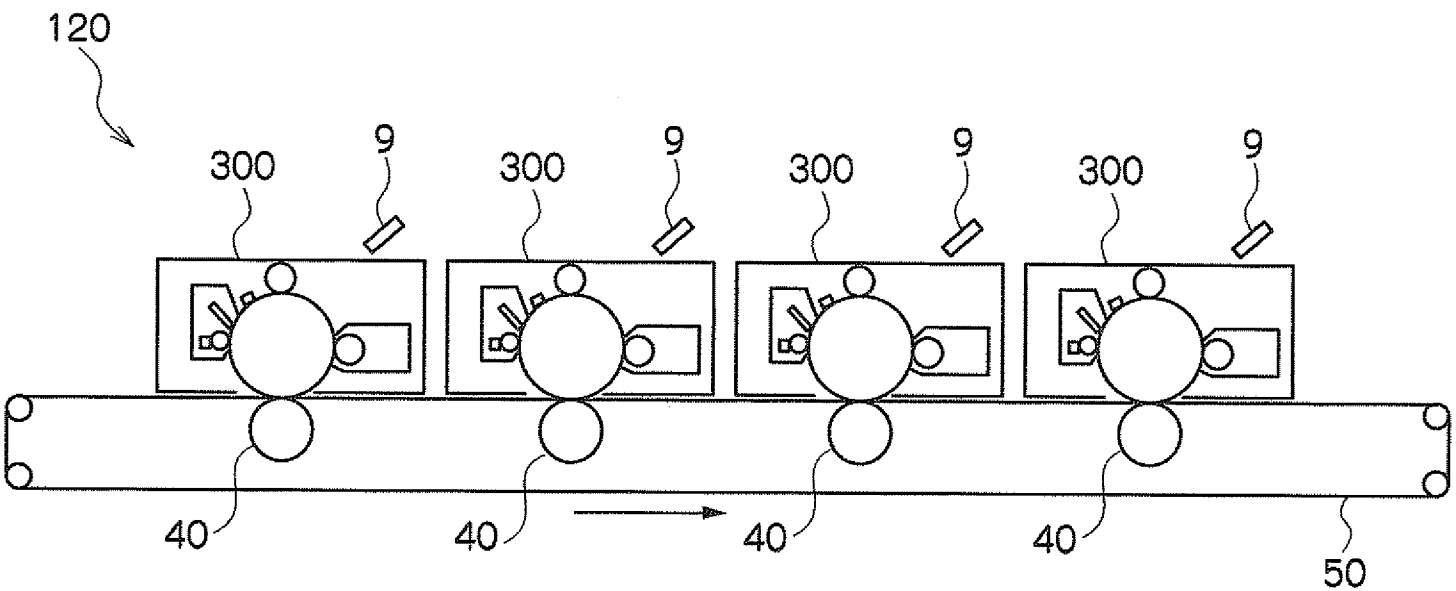
FIG. 5 is a schematic view showing an image forming apparatus according to another exemplary embodiment of the invention.

FIG. 5 is a schematic sectional view showing an image forming apparatus 120 involved in another exemplary embodiment of the invention.

The image forming apparatus 120 shown in FIG. 5 is a tandem full-color image forming apparatus including four process cartridges 300.

The image forming apparatus 120 has four process cartridges 300 each disposed side by side on an intermediate transfer medium 50 and has a configuration in which one electrophotographic photoreceptor is used for one color. The image forming apparatus 120 has the same configuration as the image forming apparatus 100 except that the image forming apparatus 120 is formed into a tandem system.

The image forming apparatus involved in the present exemplary embodiment is not limited to the above structure, and other image forming apparatus of a well-known system may be used.

Exemplary embodiments of the present invention are listed below. However, the exemplary embodiments are not limited thereto.

The aspect of the invention according to claim 1 is an electrophotographic photoreceptor including at least an electroconductive substrate and a photosensitive layer provided on or above the electroconductive substrate, wherein an outermost layer of the electrophotographic photoreceptor is a layer composed of a cured film of a composition including at least one of compound having a chain-polymerizable functional group and a charge-transportable backbone in the molecule thereof, a polymerization initiator and a radical deactivator.

The aspect of the invention according to claim 2 is the electrophotographic photoreceptor according to claim 1, wherein the radical deactivator is at least one selected from the group consisting of phenol-based radical deactivators, amine-based radical deactivators, hydroxyacetophenone-based radical deactivators, benzoin-based radical deactivators and peroxide-type radical deactivators.

The aspect of the invention according to claim 3 is the electrophotographic photoreceptor of claim 1 or 2, wherein the radical inactivator is selected from a phenol-based radical deactivator or an amine-based radical deactivator.

The aspect of the invention according to claim 4 is the electrophotographic photoreceptor of any one of claims 1 to 3, wherein the radical deactivator is selected from the group consisting of compounds represented by the above-described Formulae (M-1) to (M-8).

The aspect of the invention according to claim 5 is the electrophotographic photoreceptor of any one of claims 1 to 4, wherein the charge-transportable backbone includes a triphenylamine backbone.

The aspect of the invention according to claim 6 is the electrophotographic photoreceptor of any one of claims 1 to 5, wherein the chain polymerizable functional group includes an acryloyl group, a methacryloyl group, a styrene group or a derivative thereof.

The aspect of the invention according to claim 7 is the electrophotographic photoreceptor of any one of claims 1 to 6, wherein the chain polymerizable functional group includes a methacryloyl group or a derivative thereof.

The aspect of the invention a according to claim 8 is the electrophotographic photoreceptor of any one of claims 1 to 7, wherein the polymerization initiator includes a heat radical initiator.

The aspect of the invention according to claim 9 is the electrophotographic photoreceptor of any one of claims 1 to 8, further comprising a protective layer on or above the photosensitive layer, wherein the protective layer is the outermost layer.

The aspect of the invention a according to claim 10 is the electrophotographic photoreceptor of any one of claims 1 to 8, wherein the photosensitive layer is the outermost layer.

The aspect of the invention a according to claim 11 is the electrophotographic photoreceptor of any one of claims 1 to 10, wherein the photosensitive layer comprises a charge generating layer and a charge transport layer.

The aspect of the invention a according to claim 12 is the electrophotographic photoreceptor of any one of claims 1 to 11, wherein the photosensitive layer comprises a charge generating material and a charge transporting material.

The aspect of the invention a according to claim 13 is the electrophotographic photoreceptor of any one of claims 1 to 12, wherein the electroconductive substrate includes an aluminum substrate.

The aspect of the invention a according to claim 14 is the electrophotographic photoreceptor of any one of claims 1 to 13, further comprising an undercoat layer provided on the electroconductive substrate.

The aspect of the invention a according to claim 15 is the electrophotographic photoreceptor of any one of claims 1 to 14, further comprising, together with the compound having a chain-polymerizable functional group and a charge-transportable backbone in the molecule thereof, a charge transporting material having no reactive group.

The aspect of the invention a according to claim 16 is the electrophotographic photoreceptor of claim 9, wherein the protective layer further comprises a polymer which does not react with the chain-polymerizable functional group in the compound having a chain-polymerizable functional group and a charge-transportable backbone in the molecule thereof.

The aspect of the invention a according to claim 17 is a process cartridge including the electrophotographic photoreceptor of any one of claims 1 to 16 and at least one unit selected from the group consisting of a charging unit for charging the electrophoto graphic photoreceptor; a development unit for developing an electrostatic latent image formed on the electrophotographic photoreceptor with a toner; and a toner removal unit for removing residual toner from the surface of the electrophotographic photoreceptor.

The aspect of the invention a according to claim 18 is an image forming apparatus including the electrophotographic photoreceptor of any one of claims 1 to 16; a charging unit for charging the electrophotographic photoreceptor; an electrostatic latent image forming unit for forming an electrostatic latent image on the charged electrophotographic photoreceptor; a development unit for developing the electrostatic latent image formed on the electrophotographic photoreceptor with a toner thereby forming a toner image; and a transfer unit for transferring the toner image to a transfer medium.

The aspects of the invention according to claims 1 and 5-16 provide an electrophotographic photoreceptor in which generation of an afterimage phenomenon (ghosting) which is caused by a residual history of the former image is more suppressed as compared to the case where at least one compound having a chain-polymerizable functional group and a charge-transportable backbone in the molecule thereof, a polymerization initiator and a radical deactivator are not combined as the materials for the outermost layer.

The aspect of the invention according to claims 2 to 4 provides an electrophotographic photoreceptor in which generation of an afterimage phenomenon (ghosting) which is caused by a residual history of the former image is more suppressed as compared to the case where the radical deactivator is not a radical deactivator as recited in claims 2 to 4.

The aspects of the invention according to claims 17 and 18 provide a process cartridge and an image forming apparatus which may provide an image in which generation of an afterimage phenomenon (ghosting) which is caused by a residual history of the former image is more suppressed as compared to the case where an electrophotographic photoreceptor in which at least one compound having a chain-polymerizable functional group and a charge-transportable backbone in the molecule thereof, a polymerization initiator and a radical deactivator are not combined as the materials for the outermost layer is applied.

EXAMPLE

Exemplary embodiments of the invention are further described below with reference to examples, but the invention is not limited to these examples.

Example 1

Production of Electrophotographic Photoreceptor

Preparation of Undercoat Layer

In the beginning, 100 parts by weight of zinc oxide (average particle diameter: 70 nm, specific surface area: 15 $m^2/g$, manufactured by TAYCA Co., Ltd.) and 500 parts by weight of toluene are mixed and stirred, 1.3 parts by weight of a silane coupling agent (trade name: KBM503, manufactured by Shin-Etsu Chemical Co., Ltd.) are added thereto, followed by stirring for 2 hr. Thereafter, toluene is distilled away under reduced pressure, followed by baking at 120° C. for 3 hr, thereby obtaining a zinc oxide surface-treated with a silane coupling agent.

In the next place, 110 parts by weight of surface-treated zinc oxide and 500 parts by weight of tetrahydrofuran are mixed while stirring. To the mixture, a solution obtained by dissolving 0.6 parts by weight of alizarin in 50 parts by weight of tetrahydrofuran is added, followed by stirring at 50° C. for 5 hr. Thereafter, alizarin-added zinc oxide is filtered under reduced pressure, followed by drying at 60° C. under reduced pressure, thereby obtaining alizarin-added zinc oxide.

Then, 38 parts by weight of a solution obtained by mixing 60 parts by weight of the alizarin-added zinc oxide, 13.5 parts by weight of a hardener (blocked isocyanate, trade name: SUMIDULE 3175, manufactured by Sumitomo-Bayer Urethane Co., Ltd.) and 15 parts by weight of a butyral resin (trade name: S-LEC BM-1, manufactured by Sekisui Chemical Co., Ltd.) in 85 parts by weight of methyl ethyl ketone and 25 parts by weight of methyl ethyl ketone are mixed, followed by dispersing for 2 hr by use of a sand mill with glass beads having a diameter of 1 mmϕ, thereby obtaining a dispersion liquid.

To the resulting dispersion liquid, 0.005 parts by weight of dioctyltin dilaurate as a catalyst and 40 parts by weight of silicone resin particles (trade name: TOSPEARL 145, manufactured by GE-Toshiba Silicone Co., Ltd.) are added, thereby obtaining a coating liquid for forming an undercoat layer. The coating liquid is coated by dipping on an aluminum substrate, followed by drying and curing at 170° C. for 40 min, thereby obtaining an undercoat layer having a thickness of 20 μm.

Preparation of Charge Generating Layer

In the beginning, a mixture containing 15 parts by weight of hydroxygallium phthalocyanine having diffraction peaks at least at 7.3°, 16.0°, 24.9° and 28.0° by Bragg angle (2θ±0.2°) in an X-ray diffraction spectrum obtained with CuKα characteristic X-ray as a charge generating material, 10 parts by weight of a vinyl chloride/vinyl acetate copolymer resin (trade name: VMCH, manufactured by Nippon Unicar Co., Ltd.) and 200 parts by weight of n-butyl acetate is dispersed for 4 hr by use of a sand mill with glass beads having a diameter of 1 mmϕ. To the resulting dispersion liquid, 175 parts by weight of n-butyl acetate and 180 parts by weight of methyl ethyl ketone are added, followed by stirring, thereby obtaining a coating liquid for forming a charge generating layer. The coating liquid for forming a charge generating layer is coated on the undercoat layer by dipping, followed by drying at room temperature (25° C.), thereby forming a charge generating layer having a film thickness of 0.2 μm.

Preparation of Charge Transport Layer

Firstly, 45 parts by weight of N,N'-diphenyl-N,N'-bis (3-methylphenyl) [1,1']biphenyl-4,4'-diamine (hereinafter, referred to as "TPD") and 55 parts by weight of a bisphenol Z polycarbonate resin (hereinafter, referred to as "PCZ 500", viscosity average molecular weight: 50000) are dissolved in 800 parts by weight of chlorobenzene, thereby obtaining a coating liquid for forming a charge transpot layer. The coating liquid is coated on the charge generating layer, followed by heating at 130° C. for 45 min, thereby forming a charge transport layer having a thickness of 20 μm.

Preparation of Protective Layer 80 parts by weight of the compound represented by Formula (I) (compound ii-19) and 20 parts by weight of a monomer having no charge transport capability (trade name: A-DCP, manufactured by Shin-Nakamura Chemical Co., Ltd.) are dissolved in 100 parts by weight of tetrahydrofuran (THF). Subsequently, 5 parts by weight (30.5 mmol) of an initiator (trade name: AIBN, manufactured by Otsuka Chemical Co., Ltd.) and 6.7 parts by weight (30.5 mmol) of 2,6-di-tert-butyl-4-methylphenol (BHT) as a deactivator are dissolved in the solution, thereby obtaining a protective layer forming coating liquid. The coating liquid is coated on the charge transport layer, and heated in an atmosphere having an oxygen concentration of about 100 ppm at 145° C. for 40 minutes, thereby forming a protective layer having a thickness of 8 μm.

An electrophotographic photoreceptor is obtained in this manner. The photoreceptor is referred to as a photoreceptor 1.

Evaluation

The electrophotographic photoreceptor thus produced is mounted on 700 Digital Color Press (manufactured by Fuji Xerox Co., Ltd.), and a 10% halftone image is continuously printed on 10,000 sheets at environment of 10° C. and 15% RH.

After printing 10,000 sheets, the image evaluation test (1) is carried out in the same environment. After the image evaluation test (1), the image forming apparatus is left at 28° C. and 80% RH for 24 hours, and then printing is resumed. The image quality of the image on the first sheet is subjected to the image quality evaluation test (2) in the same environment.

In the image evaluation tests (1) and (2), the below-described density unevenness, streaks, image degradation, and ghosting are evaluated. Further, surface observation and adhesion property of a protective layer are evaluated. Further, reaction rate of a protective layer is also measured according to the above description.

P paper (A4 size, transverse feed, manufactured by Fuji Xerox Co., Ltd.) is used in the image formation tests.

The evaluation results are shown in Table 1.

Evaluation of Density Unevenness

Evaluation of the density unevenness is visually performed using the 10% halftone sample.

A: Excellent.

B: Partial density unevenness is seen.

C: Density unevenness that is problematic from image quality point of view is seen.

Evaluation of Streaks

Evaluation of streaks is visually performed using the 10% halftone sample.

A: Excellent.

B: Partial streaks are seen.

C: Streaks that are problematic from image quality point of view are seen.

Evaluation of Image Degradation (Image Flow)

Together with the above tests, the image degradation (image flow) as well is evaluated according to the following criterion:

Evaluation of the image degradation is visually performed using the 10% halftone sample.

A: Excellent.

B: There is no problem of image degradation during a continuous print test but a problem is caused after leaving for 24 hr.

C: There is a problem even during a continuous print test.

Evaluation of Ghosting

Figure 6A:
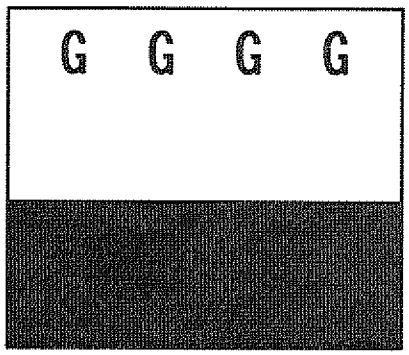
FIGS. 6A to 6C are explanatory drawings showing the criteria for evaluating ghost.

Evaluation of the ghosting is performed by visually observing a degree of appearance of a figure G in a black region after a chart of a pattern having G and a black region, which are shown in FIG. 6A, is printed.

A: Excellent or very slight as shown in FIG. 6A.

Figure 6B:
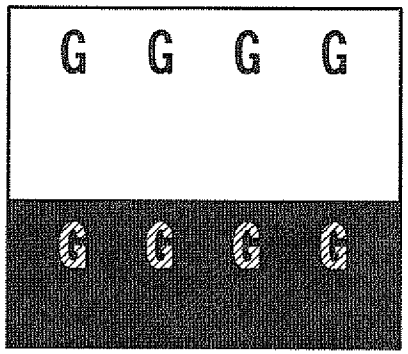

B: Slightly conspicuous as shown in FIG. 6B.

Figure 6C:
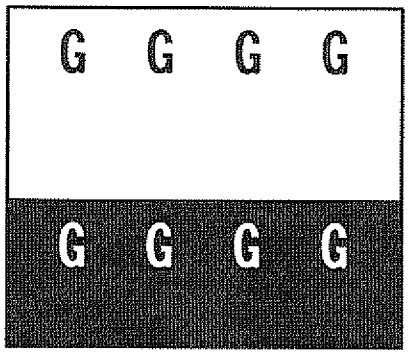

C: Clearly confirmed as shown in FIG. 6C.

Evaluation of Fogging

Evaluation of the fogging is performed by visually observing and determining the degree of adhesion of a toner on a blank portion (white background) using a chart having the same pattern as that used in the evaluation of ghosting.

A: Fine.

B: Light fogging is observed.

C: Fogging that is problematic in image quality is observed.

Surface Observation

A surface of the electrophotographic photoreceptor in the image quality evaluation tests (1) and (2) is observed and evaluated according to the following criterion:

A: Excellent, that is, there is neither scratch nor attachment even under 20 times magnification.

B: Under 20 times magnification, slight scratch or attachment is found.

C: Scratch or attachment is observed by naked eye.

Evaluation of Adhesion Property of Protective Layer

Evaluation of the adhesion property of the protective layer is performed by making 5×5 cuts in a 2 mm square with a cutter knife on the photoreceptor after the image formation test, and then attaching a mending tape manufactured by 3M, and then peeling the tape, and then counting the number of the remaining cuts.

The results are shown in Table 2.

A: 21 or more cuts remained.

B: 11 to 20 cuts remained.

C: 10 or less cuts remained.

Examples 2 to 26

Production of Electrophotographic Photoreceptor

The steps up to the formation of the charge transport layer are conducted in the same manner as those in Example 1. The ingredients of the protective layer are changed to those shown in Tables 1 and 2, and thus a protective layer forming coating liquid is obtained. Each coating liquid is coated on the charge transport layer, and heated at 145° C. for 40 minutes in an atmosphere having an oxygen concentration of about 100 ppm, thereby forming a protective layer having a thickness of 8 μm.

Electrophotographic photoreceptors are obtained by the above-described method. These photoreceptors are referred to as photoreceptors 2 to 26, respectively.

Evaluation

Evaluation of the photoreceptors thus obtained is performed in the same manner as in Example 1. The results are shown in Tables 1 to 3.

Comparative Example 1

Production of Electrophotographic Photoreceptor

The steps up to the formation of the charge transporting layer are conducted in the same manner as those in Example 1. The ingredients of the protective layer are changed to those shown in Tables 1 and 2, and thus a protective layer forming coating liquid is obtained. The coating liquid is coated on the charge transport layer, and heated at 145° C. for 40 minutes in an atmosphere having an oxygen concentration of about 100 ppm, thereby forming a protective layer having a thickness of 8 μm.

Electrophotographic photoreceptors are obtained by the above-described method. These photoreceptors are referred to as comparative photoreceptors 1 to 3, and comparative photoreceptor 1 respectively.

Evaluation

The photoreceptors thus obtained are evaluated in the same manner as in Example 1. The results are shown in Table 4.

Results of the above-mentioned examples are arranged in the following tables. In the tables, the "parts" means "parts by weight".

TABLE 1

| | | Example 1 Photoreceptor 1 | Example 2 Photoreceptor 2 | Example 3 Photoreceptor 3 | Example 4 Photoreceptor 4 | Example 5 Photoreceptor 5 |
|---|---|---|---|---|---|---|
| Monomer having charge-transporting ability | | ii-19 80 parts | ii-19 80 parts | ii-19 80 parts | ii-19 80 parts | ii-19 70 parts |
| Monomer which does not have charge-transporting ability | | A-DCP 20 parts | A-DCP 20 parts | — | A-DCP 20 parts | A-DCP 20 parts |
| Polymerization initiator | | AIBN 5 parts (30.5 mmol) | VE-73 2 parts (6.4 mmol) | VE-73 2 parts (6.4 mmol) | OTazo15 5 parts (14.1 mmol) | VE-73 2 parts (6.4 mmol) |
| Radical deactivator | | BHT 6.7 parts (30.5 mmol) | MDPS 2.2 parts (6.4 mmol) | HQ 1.4 parts (12.8 mmol) | MDPS 4.8 parts (14.1 mmol) | HMOBP 7.3 parts (32 mmol) |
| Compound not reacting with chain polymerizable functional group | | — | — | — | — | PCZ 500 10 parts |
| Reaction ratio of protective layer | | 80% | 95% | 65% | 80% | 70% |
| * (1) | Density Unevenness | A | A | A | A | A |
| | Streaks | A | A | A | A | A |
| | Image flow | A | A | A | A | A |
| | Ghosting | A | A | A | A | A |
| | Fogging | A | A | A | A | A |
| | Observation of surface | A | A | A | A | A |
| ** (2) | Density Unevenness | A | A | A | A | A |
| | Streaks | A | A | A | A | A |
| | Image flow | A | A | A | A | A |
| | Ghosting | A | A | A | A | A |
| | Fogging | A | A | A | A | A |
| | Observation of surface | A | A | B | A | A |
| Adhesion property of protective layer | | A | A | B | A | A |

TABLE 1-continued

| | | Example 6 Photoreceptor 6 | Example 7 Photoreceptor 7 | Example 8 Photoreceptor 8 | Example 9 Photoreceptor 9 |
|---|---|---|---|---|---|
| Monomer having charge-transporting ability | | ii-19 70 parts | ii-19 80 parts | ii-19 80 parts | ii-19 80 parts |
| Monomer which does not have charge-transporting ability | | A-DCP 20 parts | A-DCP 20 parts | A-DCP 20 parts | A-DCP 20 parts |
| Polymerization initiator | | VE-73 2 parts (6.4 mmol) | VE-73 2 parts (6.4 mmol) | VE-73 2 parts (6.4 mmol) | VE-73 2 parts (6.4 mmol) |
| Radical deactivator | | DOPE 2.7 parts (6.4 mmol) | TBOB 2.4 parts (6.4 mmol) | TPTA 2.0 parts (6.4 mmol) | DMAPE 1.62 parts (6.4 mmol) |
| Compound not reacting with chain polymerizable functional group | | TPB 10 parts | — | — | — |
| Reaction ratio of protective layer | | 80% | 80% | 75% | 75% |
| * (1) | Density Unevenness | A | A | A | A |
| | Streaks | A | A | A | A |
| | Image flow | A | A | A | A |
| | Ghosting | A | A | A | A |
| | Fogging | A | A | A | A |
| | Observation of surface | A | A | A | A |
| ** (2) | Density Unevenness | A | A | A | A |
| | Streaks | A | A | A | A |
| | Image flow | A | A | A | A |
| | Ghosting | A | A | A | A |
| | Fogging | A | A | A | A |
| | Observation of surface | A | A | A | A |
| Adhesion property of protective layer | | A | A | A | A |

* Evaluation of image (1)
** Evaluation of image (2)

TABLE 2

| | | Example 10 Photoreceptor 10 | Example 11 Photoreceptor 11 | Example 12 Photoreceptor 12 | Example 13 Photoreceptor 13 | Example 14 Photoreceptor 14 |
|---|---|---|---|---|---|---|
| Monomer having charge-transporting ability | | ii-22 80 parts | iv-17 80 parts | iv-17 90 parts | ii-19 80 parts | iv-17 80 parts |
| Monomer which does not have charge-transporting ability | | A-DCP 20 parts | A-DCP 20 parts | A-DCP 10 parts | A-DCP 20 parts | A-DCP 20 parts |
| Polymerization initiator | | VE-73 3 parts (9.7 mmol) | VE-73 5 parts (16.1 mmol) | VE-73 0.5 parts (1.6 mmol) | VE-73 2 parts (6.4 mmol) | VE-73 2 parts (6.4 mmol) |
| Radical deactivator | | MDPS 3.1 parts (9.7 mmol) | RC101 5.5 parts (16.1 mmol) | RC101 2.7 parts (7.8 mmol) | RC101 6.3 parts (6.4 mmol) | C15HA 1.8 parts (6.4 mmol) |
| Compound which does not react with chain-polymerizable functional group | | — | — | — | — | — |
| Reaction ratio of protective layer | | 70% | 90% | 60% | 50% | 60% |
| * (1) | Density Unevenness | A | A | A | A | A |
| | Streaks | A | A | A | A | A |
| | Image flow | A | A | A | A | A |

TABLE 2-continued

| | | | | | | |
|---|---|---|---|---|---|---|
| | Ghosting | A | A | A | A | A |
| | Fogging | A | A | A | B | B |
| | Observation of surface | A | A | A | B | B |
| ** (2) | Density Unevenness | A | A | A | A | A |
| | Streaks | A | A | A | A | A |
| | Image flow | A | A | A | A | A |
| | Ghosting | A | A | A | B | B |
| | Fogging | A | A | A | B | B |
| | Observation of surface | A | A | A | B | B |
| Adhesion property of protective layer | | A | A | A | B | A |

| | | Example 15 Photoreceptor 15 | Example 16 Photoreceptor 16 | Example 17 Photoreceptor 17 | Example 18 Photoreceptor 18 |
|---|---|---|---|---|---|
| Monomer having charge-transporting ability | | iv-17 80 parts | iv-17 80 parts | iv-17 80 parts | ii-19 80 parts |
| Monomer which does not have charge-transporting ability | | A-DCP 20 parts | A-DCP 20 parts | A-DCP 20 parts | A-DCP 20 parts |
| Polymerization initiator | | VE-73 2 parts (6.4 mmol) | VE-73 2 parts (6.4 mmol) | VE-73 2 parts (6.4 mmol) | VE-73 2 parts (6.4 mmol) |
| Radical deactivator | | pTSA 1.2 parts (6.4 mmol) | RC102 3.1 parts (6.4 mmol) | Tris-TPM 2.9 parts (6.4 mmol) | BDETPM 2.7 parts (6.4 mmol) |
| Compound which does not react with chain-polymerizable functional group | | — | — | — | — |
| Reaction ratio of protective layer | | 40% | 70% | 65% | 65% |
| * (1) | Density Unevenness | A | A | A | A |
| | Streaks | A | A | A | A |
| | Image flow | B | A | A | A |
| | Ghosting | B | A | A | A |
| | Fogging | B | B | B | B |
| | Observation of surface | B | B | B | B |
| ** (2) | Density Unevenness | B | A | A | A |
| | Streaks | B | A | A | A |
| | Image flow | B | A | A | A |
| | Ghosting | B | B | B | B |
| | Fogging | B | B | B | B |
| | Observation of surface | B | B | B | B |
| Adhesion property of protective layer | | B | A | A | B |

* Evaluation of image (1)

** Evaluation of image (2)

TABLE 3

| | Example 19 Photoreceptor 19 | Example 20 Photoreceptor 20 | Example 21 Photoreceptor 21 | Example 22 Photoreceptor 22 | Example 23 Photoreceptor 23 |
|---|---|---|---|---|---|
| Monomer having charge-transporting ability | ii-19 80 parts | ii-19 80 parts | ii-19 80 parts | ii-19 80 parts | ii-19 80 parts |
| Monomer which does not have charge-transporting ability | A-DCP 20 parts | A-DCP 20 parts | A-DCP 20 parts | A-DCP 20 parts | A-DCP 20 parts |

TABLE 3-continued

| | | | | | |
|---|---|---|---|---|---|
| Polymerization initiator | VE-73 2 parts (6.4 mmol) | VE-73 2 parts (6.4 mmol) | IRGACURE 369 3 parts (8.2 mmol) | IRGACURE 127 1 part (3.2 mmol) | IRGACURE 184 3 parts (14.6 mmol) |
| Radical deactivator | DHTPM 2.9 parts (6.4 mmol) | HMOBP 3.1 parts (13.6 mmol) | HMOBP 3.1 parts (13.6 mmol) | HMOBP 3.1 parts (13.6 mmol) | HMOBP 3.1 parts (13.6 mmol) |
| Compound which does not react with chain-polymerizable functional group | — | — | — | — | — |
| Reaction ratio of protective layer | 65% | 90% | 80% | 55% | 65% |
| * (1) Density Unevenness | A | A | A | A | B |
| Streaks | A | A | A | A | A |
| Image flow | A | B | B | B | A |
| Ghosting | A | B | B | B | A |
| Fogging | B | B | B | B | B |
| Observation of surface | B | B | B | B | B |
| ** (2) Density Unevenness | A | A | A | A | B |
| Stripes | A | B | B | A | A |
| Image flow | A | B | B | A | A |
| Ghost | B | B | B | B | B |
| Fogging | B | B | B | B | B |
| Observation of surface | B | B | B | B | B |
| Adhesion property of protective layer | B | A | A | B | B |

| | Example 24 Photoreceptor 24 | Example 25 Photoreceptor 25 | Example 26 Photoreceptor 26 |
|---|---|---|---|
| Monomer having charge-transporting ability | ii-19 70 parts | ii-19 80 parts | ii-19 80 parts |
| Monomer which does not have charge-transporting ability | A-DCP 20 parts | A-DCP 20 parts | A-DCP 20 parts |
| Polymerization initiator | PERHEXYL O 3 parts (7.3 mmol) | PERHEXYL D 3 parts (6.1 mmol) | PERHEXYL HC 3 parts (9.5 mmol) |
| Radical deactivator | BHT 3.2 parts (14.6 mmol) | BHT 2.7 parts (12.2 mmol) | BHT 4.2 parts (19.0 mmol) |
| Compound which does not react with chain-polymerizable functional group | — | — | — |
| Reaction ratio of protective layer | 85% | 90% | 85% |
| * (1) Density Unevenness | A | A | A |
| Streaks | A | A | A |
| image flow | A | B | A |
| Ghosting | A | B | A |
| Fogging | B | B | B |
| Observation of surface | B | B | B |
| ** (2) Density Unevenness | A | A | A |
| Stripes | A | B | A |
| Image flow | B | B | A |
| Ghost | A | B | A |
| Fogging | B | B | B |
| Observation of surface | B | B | B |
| Adhesion property of protective layer | A | A | A |

* Evaluation of image (1)

** Evaluation of image (2)

TABLE 4

| | | Comparative Example 1 Comparative photoreceptor 1 | Comparative Example 2 Comparative photoreceptor 2 | Comparative Example 3 Comparative photoreceptor 3 |
|---|---|---|---|---|
| Monomer having charge-transporting ability | | ii-19 80 parts | ii-19 80 parts | |
| Monomer which does not have charge-transportingability | | A-DCP 20 parts | A-DCP 20 parts | A-DCP 20 parts |
| Polymerization initiator | | AIBN 5 parts (30.5 mmol) | — | AIBN 5 parts (30.5 mmol) |
| Radical deactivator | | — | BHT 6.7 parts (30.5 mmol) | BHT 6.7 parts (30.5 mmol) |
| Compound which does not react with chain-polymerizable functional group | | — | — | TPB 80 parts |
| Reaction ratio of protective layer | | 90% | 10% | 80% |
| Evaluation of image (1) | Density Unevenness | C | Not cured | C |
| | Streaks | C | Not cured | C |
| | Image flow | C | Not cured | C |
| | Ghosting | C | Not cured | C |
| | Fogging | C | Not cured | C |
| | Observation of surface | C | Not cured | C |
| Evaluation of image (2) | Density Unevenness | C | Not cured | C |
| | Streaks | C | Not cured | C |
| | Image flow | C | Not cured | C |
| | Ghosting | C | Not cured | C |
| | Fogging | C | Not cured | C |
| | Observation of surface | C | Not cured | C |
| Adhesion property of protective layer | | C | Not cured | C |

From the above-mentioned results, it is understood that entirely improved results in terms of density unevenness, streaks, image flow, ghosting, fogging, observation of the surface and adhesion property of the protective layer are obtained by the present examples, compared to those of Comparative Examples.

The compounds described in the above-mentioned Tables 1 to 4 are explained below.

A-DCP: a monomer which does not have charge transportability, manufactured by Shin-Nakamura Chemical Co., Ltd.

PCZ500: a bisphenol Z polycarbonate resin (viscosity average molecular weight: 50,000) manufactured by Mitsubishi Gas Chemical Company, Inc.

TPB: 1,1,4,4-tetraphenyl-1,3-butadiene

Monomers Having Charge-Transporting Ability (Compounds having chain-polymerizable functional group and charge-transporting backbone in the molecule thereof)

| Code | Structural Formula |
|---|---|
| ii-19 | 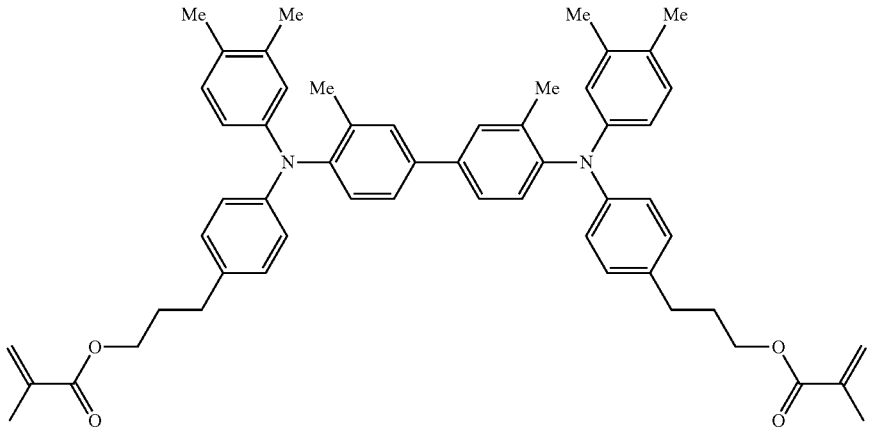 |

-continued
| Code | Structural Formula |
|---|---|
| ii-22 | 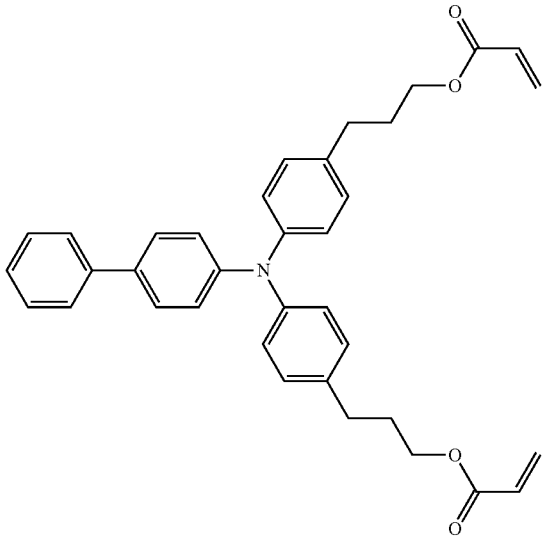 |
| iv-17 | 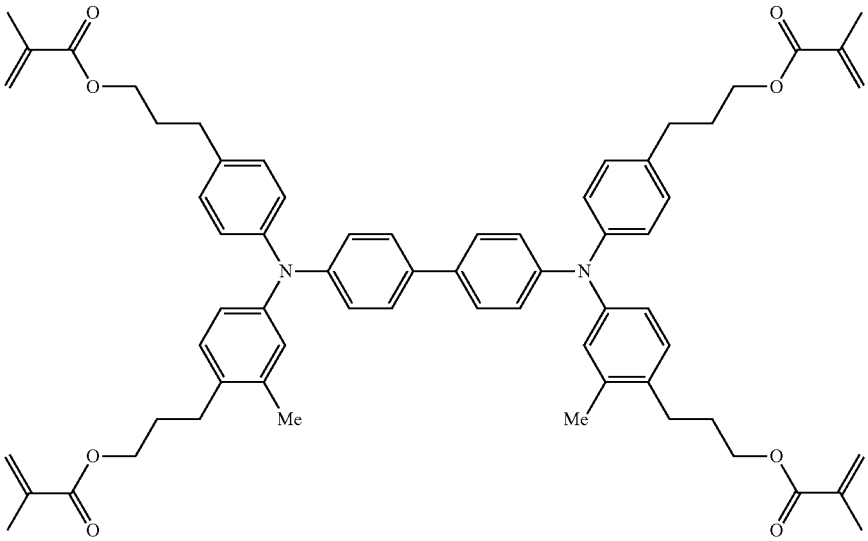 |
Polymerization initiator: 1
| Section | Code | Manufacturer | Structural formula | Molecular weight |
|---|---|---|---|---|
| Azo-based | AIBN | Otsuka Chemical | 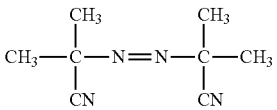 | 164.2 |
| | Otazo 15 | Otsuka Chemical | 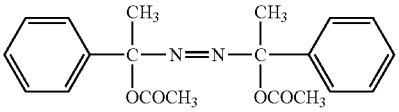 | 354.4 |

-continued

Polymerization initiator: 1

| Section | Code | Manufacturer | Structural formula | Molecular weight |
|---|---|---|---|---|
| | VE-73 | Otsuka Chemical | 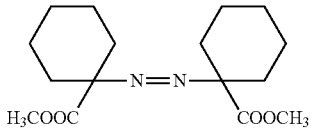 | 310.39 |
| α-Aminoacetophenone | IRGACURE 369 | Ciba Specialty Chemicals Inc. | 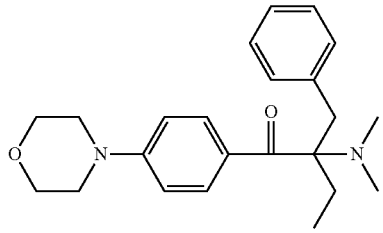 | 366.24 |
| α-Hydroxyacetophenone-based | IRGACURE 127 | Ciba Specialty Chemicals Inc. | 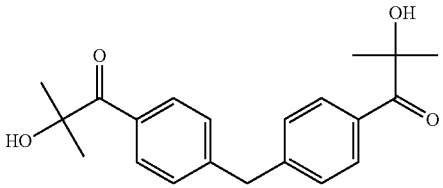 | 308.42 |

Polymerization initiator: 2

| Section | Code | Manufacturer | Structural formula | Molecular weight |
|---|---|---|---|---|
| Benzoin | IRGACURE 184 | Ciba Specialty Chemicals Inc. | 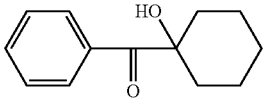 | 205.28 |
| Peroxide | PERHEXYL O | NOF Corporation | 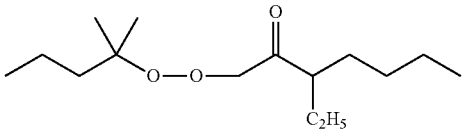 | 244.36 |
| | PERHEXYL D | NOF Corporation | 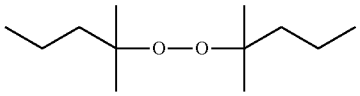 | 202.34 |
| | PERHEXYL HC | NOF Corporation | 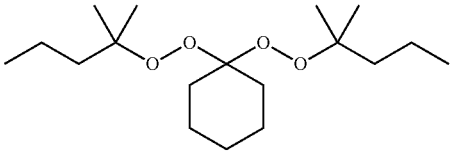 | 316.47 |

Radical deactivators: 1
| Section | Code | Structural formula | Molecular weight |
|---|---|---|---|
| Phenol-based | BHT | 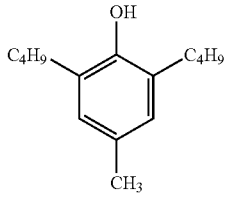 | 220.35 |
| | MDPS | 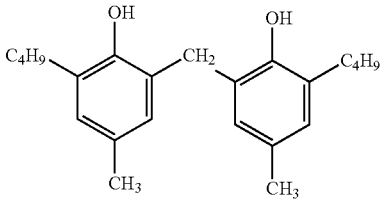 | 340.51 |
| | HQ | 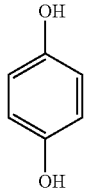 | 110.11 |
| | HMOBP | 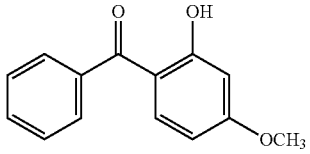 | 228.24 |
| | DOPE | 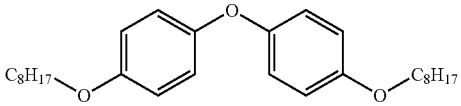 | 426.65 |
| | TBOB | 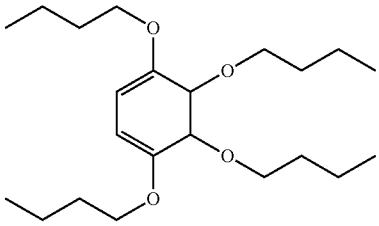 | 368.56 |

Radical deactivators: 2
| Section | Code | Structural formula | Molecular weight |
|---|---|---|---|
| Alkylamine-based | TPTA | 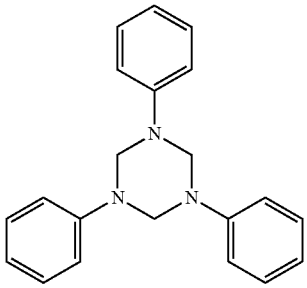 | 315.42 |
| | DMAPE | 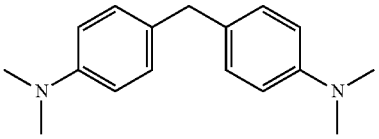 | 254.38 |
| Sulfur-based | RC101 | 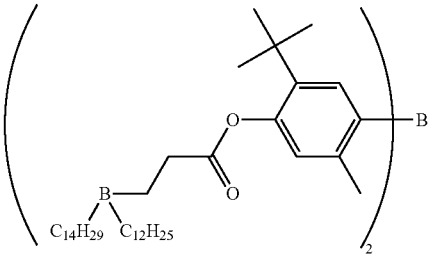 | 991.56 |
| Hydroxyamine-based | C15HA | 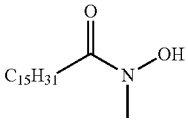 | 285.47 |
Radical deactivators: 3
| Section | Code | Structural formula | Molecular weight |
|---|---|---|---|
| Phosphorous-based | RC102 | 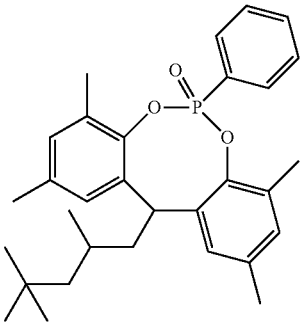 | 490.62 |

-continued

Radical deactivators: 3

| Section | Code | Structural formula | Molecular weight |
|---|---|---|---|
| Alkylaminotriphenylmethane-based | Tris-TPM | 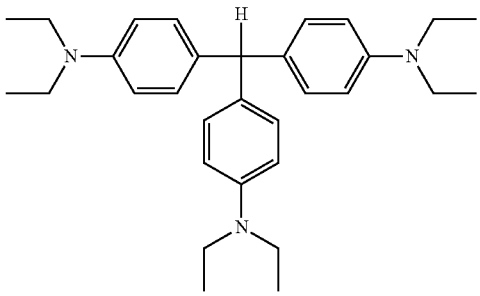 | 457.71 |
| | BDETPM | 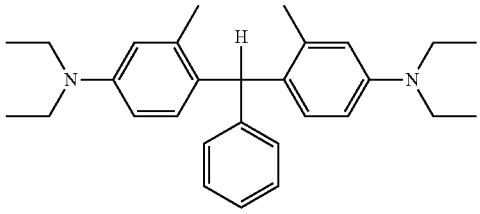 | 414.64 |
| | DHTPM | 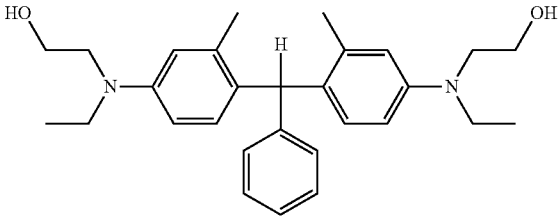 | 446.64 |

What is claimed is:

1. An electrophotographic photoreceptor comprising at least:

an electroconductive substrate; and a photosensitive layer provided on or above the electroconductive substrate, wherein an outermost layer of the electrophotographic photoreceptor is a layer composed of a cured film of a composition comprising at least:

one compound having a chain-polymerizable functional group and a charge-transportable backbone in the molecule thereof;

a polymerization initiator; and a radical deactivator, a content of the radical deactivator being from equal mol number to 5-fold mol number of a content of the polymerization initiator in the composition of the outermost layer.

2. The electrophotographic photoreceptor according to claim 1, wherein the radical deactivator is at least one selected from the group consisting of phenol-based radical deactivators, amine-based radical deactivators, hydroxyacetophenone-based radical deactivators, benzoin-based radical deactivators and peroxide-based radical deactivators.

3. The electrophotographic photoreceptor according to claim 1, wherein the radical deactivator is selected from a phenol-based radical deactivator or an amine-based radical deactivator.

4. The electrophotographic photoreceptor according to claim 1, wherein the radical deactivator is selected from the group consisting of compounds represented by the following Formulae (M-1) to (M-8):

(M-1)

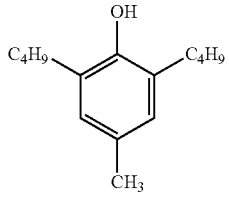

(M-2)

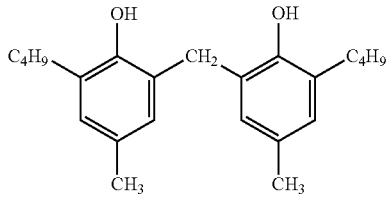

(M-3)

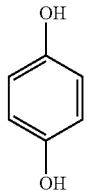

-continued (M-4)

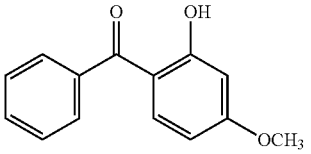

(M-5)

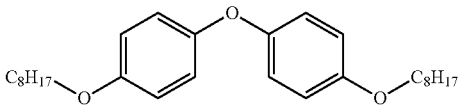

(M-6)

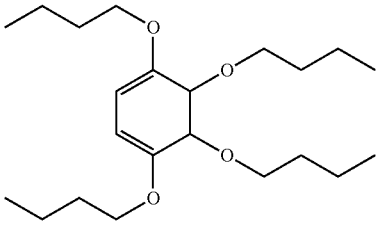

(M-7)

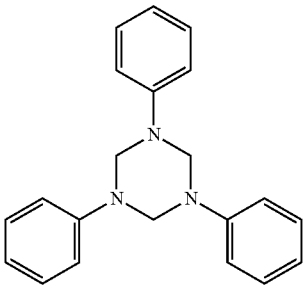

(M-8)

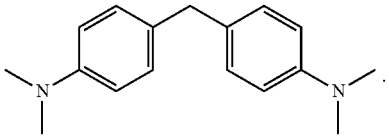

5. The electrophotographic photoreceptor according to claim 1, wherein the charge-transportable backbone comprises a triphenylamine backbone.

6. The electrophotographic photoreceptor according to claim 1, wherein the chain polymerizable functional group comprises an acryloyl group, a methacryloyl group, a styrene group or a derivative thereof.

7. The electrophotographic photoreceptor according to claim 1, wherein the chain polymerizable functional group comprises a methacryloyl group or a derivative thereof.

8. The electrophotographic photoreceptor according to claim 1, wherein the polymerization initiator comprises a heat radical initiator.

9. The electrophotographic photoreceptor according to claim 1, wherein the outermost layer is a protective layer on or above the photosensitive laver.

10. The electrophotographic photoreceptor according to claim 1, wherein the photosensitive layer is the outermost layer.

11. The electrophotographic photoreceptor according to claim 1, wherein the photosensitive layer comprises a charge generating layer and a charge transport layer.

12. The electrophotographic photoreceptor according to claim 1, wherein the photosensitive layer comprises a charge generating material and a charge transporting material.

13. The electrophotographic photoreceptor according to claim 1, wherein the electroconductive substrate comprises an aluminum substrate.

14. The electrophotographic photoreceptor according to claim 1, further comprising an undercoat layer provided on the electroconductive substrate.

15. The electrophotographic photoreceptor according to claim 1, further comprising, together with the compound having a chain-polymerizable functional group and a charge-transportable backbone in the molecule thereof, a charge transporting material having no reactive group.

16. The electrophotographic photoreceptor according to claim 7, wherein the protective layer further comprises a polymer which does not react with the chain-polymerizable functional group in the compound having a chain-polymerizable functional group and a charge-transportable backbone in the molecule thereof.

17. A process cartridge comprising:

the electrophotographic photoreceptor according to claim 1; and at least one unit selected from the group consisting of:

a charging unit that charges the electrophotographic photoreceptor;

a development unit that develops an electrostatic latent image formed on the electrophotographic photoreceptor with a toner; and a toner removal unit that removes residual toner from the surface of the electrophotographic photoreceptor.

18. An image forming apparatus comprising:

the electrophotographic photoreceptor according to claim 1;

a charging unit that charges the electrophotographic photoreceptor;

an electrostatic latent image forming unit that forms an electrostatic latent image on the charged electrophotographic photoreceptor;

a development unit that develops the electrostatic latent image formed on the electrophotographic photoreceptor with a toner thereby forming a toner image; and a transfer unit that transfers the toner image to a transfer medium.

* * * * *